US005213477A

United States Patent [19]

Watanabe et al.

[11] Patent Number: 5,213,477

[45] Date of Patent: May 25, 1993

[54] PUMP DELIVERY FLOW RATE CONTROL APPARATUS

[75] Inventors: Michio Watanabe, Ayase; Takahiko Ohbayashi, Yokohama, both of Japan

[73] Assignee: Kabushiki Kaisha Toshiba, Kawasaki, Japan

[21] Appl. No.: 684,171

[22] Filed: Apr. 11, 1991

[30] Foreign Application Priority Data

Apr. 13, 1990 [JP] Japan ..... 2-97885
Jul. 19, 1990 [JP] Japan ..... 2-191283

[51] Int. Cl.[5] ..... F04B 49/06

[52] U.S. Cl. ..... 417/20; 417/7; 417/32

[58] Field of Search ..... 417/2, 3, 4, 5, 6, 7, 417/20, 32

[56] References Cited

U.S. PATENT DOCUMENTS 2,870,716 1/1959 Meneley ..... 417/20
4,576,197 3/1986 Kempers ..... 417/38
4,678,405 7/1987 Allen ..... 417/245

FOREIGN PATENT DOCUMENTS 1-127993 8/1989 Japan .

*Primary Examiner*—Richard A. Bertsch
*Assistant Examiner*—David W. Scheuermann
*Attorney, Agent, or Firm*—Foley & Lardner

[57] ABSTRACT

A control apparatus for controlling a delivery flow rate of a pump pressure-feeding process liquid within a process pipe system is described. The control apparatus has detecting means for detecting available N.P.S.H. of a pump on the basis of a pressure and a temperature of the process liquid within the suction portion of the pump, and calculating means for calculating an allowable maximum flow rate of the pump so as to hold the relationship: available N.P.S.H. required N.P.S.H. The control apparatus also has outputting means for outputting a control signal to control the delivery flow rate of the pump on the basis of the smaller value, the allowable maximum flow rate or a required flow rate of the pump.

8 Claims, 37 Drawing Sheets

FIG. 39

| Pump No. | Allowable maximum (delivery) flow rate | Increment portion corresponding to required flow rate set value $a_1$ through $a_x$ to each flow rate adjuster portion from total flow rate adjuster portion | Remarks |
|---|---|---|---|
| $2_{-1}$ | 1000T/H | $\frac{1000\times200}{1000+500\times3+400\times(x-5)} = \frac{2000}{10+15+4(x-5)}$ | |
| $2_{-2}$ | 1000T/H | | This pump already has a flow rate limit and no further increase can be requested |
| $2_{-3}$ | 500T/H | $\frac{500\times200}{1000+500\times3+400\times(x-5)} = \frac{1000}{10+15+4(x-5)}$ | |
| $2_{-4}$ | 500T/H | $\frac{500\times200}{1000+500\times3+400\times(x-5)} = \frac{1000}{10+15+4(x-5)}$ | |
| $2_{-5}$ | 500T/H | $\frac{500\times200}{1000+500\times3+400\times(x-5)} = \frac{1000}{10+15+4(x-5)}$ | |
| $2_{-6}$ total<br>\|<br>$2_{-x}$<br>$(x-5)$ | each pump 400T/H | $\frac{400\times200}{1000+500\times3+400\times(x-5)} = \frac{800}{10+15+4(x-5)}$ (for each pump) | |
| $2_{-(x+1)}$<br>\|<br>$2_{-n}$ | - | - | stopped |

PUMP DELIVERY FLOW RATE CONTROL APPARATUS

BACKGROUND OF THE INVENTION

The present invention relates to delivery flow rate control apparatus that control the delivery flow rate of pumps installed in process piping systems such as a fossil fuel, nuclear and other types of power generation plants.

In general, many pumps are installed in process piping systems at power generation plants (hereinafter termed simply "plants") so as to send the process liquids under pressure.

These pumps usually control the flow rate so that the flow describes those operation limit conditions that relate to the pump delivery flow rate (or the suction flow rate).

a) Maximum allowable flow rate: This is the flow rate for which when a delivery flow rate (or a suction flow rate) greater than this flow rate flows through a pump, air bubbles are formed in the process liquid on the suction side of the pump and cause cavitation which may possibly destroy the pump and cause other problems such as a dramatic lowering of the pump delivery head (delivery pressure).

b) Minimum allowable flow rate: This is the flow rate for which when there is operation of the pump at a delivery flow rate lower than this, there is the possibility of a sharp increase in the temperature of the process liquid inside the pump and of the occurrence of trouble in the pump.

The present invention relates particularly to a) above, and controls the delivery flow rate of the pump while monitoring the maximum allowable flow rate.

FIG. 36 is a view of a conventional pump delivery flow control apparatus.

In the Figure, 1 represents a tank for the temporary storage of the process liquid, and the pressure of the process liquid that is stored in this tank is increased by two pumps $2_{-1}$, $2_{-2}$ which are arranged in parallel and which are respectively provided with drive apparatus 3.1, 3-2, and is sent to the process piping system via a flow rate adjuster valve 4 that controls the total delivery flow of the two pumps $2_{-1}$, $2_{-2}$.

The pump delivery flow rate control apparatus is provided with a flow rate meter 5 that detects the total delivery flow of the two pumps $2_{-1}$, $2_{-2}$, a flow rate adjuster 15*e*, an electro-pneumatic converter 13, and a flow rate adjuster valve 4 that is driven by pneumatic signals. Here, the flow rate adjuster 15*e* is configured from a flow rate deviation calculation portion 17 that outputs the deviation between the measured value (available flow rate value) from the flow rate meter 5 and the required flow rate value "a" from the side of the plant or the like, a PID calculation portion 8 that performs integral and differential calculation, a signal converter portion 12 that converts a valve degree of opening of the flow rate adjuster valve 4 into a predetermined fixed degree of opening value when one of the two pumps $2_{-1}$, $2_{-2}$ has failed and stopped.

Since it can be generally said that the pump delivery flow rate is equal to the pump suction flow rate, the flow rate meter 5 can be disposed on either the delivery side or the suction side of the two pumps $2_{-1}$, $2_{-2}$ but here, the description will be given in terms of when it is disposed on the delivery side of the pumps $2_{-1}$, $2_{-2}$.

The following is a description of the operation of a pump delivery flow rate control apparatus having the configuration described above.

The flow rate adjuster 15*e* has as its input the required flow rate set value "a" and the available flow rate value b measured by the flow rate meter 5 for the process liquid that is actually sent to the plant by the two pumps $2_{-1}$, $2_{-2}$. In the flow rate adjuster 15*e*, the flow rate deviation calculation portion 7 calculates the deviation between the available flow rate value b to the plant and the required flow rate set value "a" from the plant, and the PID calculation portion 8 outputs signals that have been given proportional, integral and differential calculation processing.

When there is normal operation, the required flow rate set value "a" from the plant is set so that it is smaller than the total value for the maximum allowable flow rate for the two pumps $2_{-1}$, $2_{-2}$, and in this case, the signals output from the PID calculation portion 8 are output as output signals from the flow rate adjuster 15*e* and via the signal converter portion 12. These output signals that are output from the flow rate adjuster 15*e* are converted into pneumatic signals at the electro-pneumatic converter 13 and are then input to the flow rate adjuster valve 4.

In this manner, the flow rate adjuster valve 4 performs open and close control by the pneumatic signals from the electro-pneumatic converter 13 so that the available flow rate of the process liquid to the plant is in agreement with the required flow rate set value "a" from the plant.

However, when there is this normal operation and either one (pump $2_{-2}$ for example) of the two pumps $2_{-1}$, $2_{-2}$ that are operating fails, the required flow rate set value "a" from the plant stays at that for two pumps and so the degree of opening of the flow rate adjuster valve 4 is maintained at the former degree of opening. Because of this, the delivery flow rate value of the pump that did not fail and stop (pump $2_{-1}$) increases to exceed the maximum allowable flow rate for that pump (pump $2_{-1}$) and generate trouble.

In addition, when the available flow rate value "b" to the plant, that is, the actual flow rate value for the pump (pump $2_{-1}$) does not become more than the required flow rate set value "a" from the plant (i.e. $a>b$), the flow rate adjuster valve 4 operates so that the degree of opening of the flow rate adjuster valve 4 is further increased and there is the further likelihood of the occurrence of the trouble described above.

Also, depending upon the plant, when one of two operating pumps has failed and stopped, the method generally used to prevent the above described problems such as the generation of cavitation, the lowering of the pump delivery pressure and the like from occurring is to output a fixed value from the adjustment valve degree of opening setting portion 11 by the signal converter portion 12 and to monitor the required flow rate set value "a" from the plant so that the flow rate adjuster valve 4 is closed to a fixed, rated degree of opening that has been set before so that the delivery flow rate of the pump is brought to within the maximum allowable flow rate.

Furthermore, with this conventional technology, when one of two pumps that are operating fails and stops, the degree of opening of the flow rate adjuster valve 4 provided on the delivery side of the two pumps $2_{-1}$, $2_{-2}$ is decreased to a rated degree of opening set beforehand but another known method involves controlling the speed of one of the pumps that is operating (pump $2_{-1}$) so that the pump delivery flow rate is controlled. In this case, the degree of opening of the flow rate adjuster valve 4 is not necessarily decreased but a flow rate adjuster 15*e* (the same as described earlier for the conventional technology) is used so that it is possible to change the speed of the pump that did not fail (pump $2_{-1}$ for example), to a rated speed that has been set beforehand.

In addition, the description for this conventional technology has been for when the objective value for the speed of the pump or the objective value for the degree of opening of the flow rate adjuster valve 4 when one of the pumps has failed and stopped is a fixed value and for when there is immediately changed to this value when one of the pumps fails and stops. However, in certain cases, the general practice is to gradually change the value in steps so that it is ultimately made the predetermined fixed objective value for the speed of the pump or the objective value for the degree of opening of the flow rate adjuster valve 4.

Also, the above description for the conventional technology was for when there are two pumps disposed in parallel but when there are three or N number of pumps disposed in parallel, the number of operating pumps is detected and there is switching to the objective value for the speed of the pump or the objective value for the degree of opening of the flow rate adjuster valve and that is predetermined in accordance with that number (N-1, N-1 ,,, 2, 1) of pumps.

However, in this conventional case, even if a pump flow rate control apparatus is used as described above, it is not always possible to prevent the generation of trouble such as cavitation and in cases such as this, the general practice to prevent cavitation and the like is as described below.

More specifically, when the generation of cavitation commences, the suction pressure or the delivery pressure of the pump that is operating normally drops, and this is used to calculate beforehand the total delivery pressure or the total suction pressure (but the delivery pressure will be used for the description of the conventional technology) of the pumps $2_{-1}$, $2_{-2}$ in the status immediately prior to the status for which there is the possibility of the generation of trouble such as cavitation, and this value is the set value (fixed value) of a pump delivery pressure switch 9 provided to the side of the two pumps $2_{-1}$, $2_{-2}$ as shown in FIG. 36.

Then, in the unlikely event that the total delivery pressure for the pumps $2_{-1}$, $2_{-2}$ drops below this set value, this pressure drop is detected by the pump delivery pressure switch 9 and the signal S that expresses that the total delivery pressure of the pumps $2_{-1}$, $2_{-2}$ has dropped below the set value is output. Then, this signal S that is output from the pump delivery pressure switch 9 forcedly stops one of the pumps (pump $2_{-2}$ that is operating) that has continued operating without being stopped by failure, and prevents the occurrence of cavitation and other trouble due to the continued operation of the pump (pump $2_{-1}$) that continues operating.

However, when there is the pump delivery flow rate control apparatus of the conventional technology and there is control for either the degree of opening of the flow rate adjuster valve 4 or for the speed of the pump, the ultimate objective value for the degree of opening of the flow rate adjuster valve 4 or the ultimate objective value for the pump speed so that a delivery flow rate greater than the maximum allowable flow rate does not flow in the pump (pump $2_{-1}$) that did not fail when the pump (pump $2_{-2}$ for example) has failed, is a predetermined fixed value. Here, the determination of this fixed value beforehand must be performed by this so that for all operating statuses of the pump that did not fail and stop (pump $2_{-1}$), trouble such as destruction due to cavitation and rapid lowering of the delivery head (delivery pressure) of this pump due to cavitation do not occur. Because of this, the objective value for the degree of opening and the objective value for the speed must be determined to allow a sufficient surplus in consideration of the many conditions involved.

However, having such a surplus brings on problems of lowering of the operating efficiency of the pump (pump $2_{-1}$) by that amount.

More specifically, for the two pumps $2_{-1}$, $2_{-2}$ shown in FIG. 36, the normal status of the process liquid and the normal operating status for the case where one of the pumps (pump $2_{-2}$, for example) has stopped, the delivery flow rate value for the other pump (pump $2_{-1}$) obtained from the objective value (the fixed value of the adjustment valve degree of opening setting portion 11) for the degree of opening of the flow rate adjuster valve 4 becomes a value that is much lower than the maximum allowable flow rate for that pump (pump $2_{-1}$) and there is therefore the disadvantage that the difference between these two values cannot be effectively utilized.

Furthermore, this also means that the facility capacity that can be effectively used for each one pump (pump $2_{-1}$) is reduced by that amount. Therefore, when the pump (pump $2_{-2}$) has failed and stopped, the flow rate that can be sent by the pump (pump $2_{-1}$) that did not fail and stop and which is continuing operating is far less than is required for the amount of process liquid that is required by plant for power generation or for chemical processing.

Accordingly, in order to eliminate this problem, the facility capacity of the pump can be further increased or the number of pumps in the facility can be increased, thereby causing further problems.

In addition, problems such as the generation of cavitation in a pump occur not only when one pump that has been operating fails and stops so as to increase the delivery flow rate of the pump that did not fail and stop to greater than the maximum allowable flow rate, but also in the following cases.

(1) When there is a valve along the process piping on the suction side of the pump and when, due to some reason, the degree of opening of this valve is greater than the maximum degree of opening so that the pumping resistance becomes large when the process liquid flows through this process piping so that the suction pressure of the pump falls below the rated value.

(2) When the temperature of the process liquid on the suction side of the pump rises to above the rated value while the pump is operating.

However, in each of these cases (1) and (2), even when a pump flow rate control apparatus according to the previously described conventional example is used, this does not mean that the pump will not fail and stop, and so suitable pump flow rate control is not performed, and it is not possible to prevent trouble such as the generation of cavitation. This is the current situation.

Moreover, when there is a pump delivery pressure switch 9 (or a suction pressure switch) installed on the delivery side (or the suction side of the pump $2_{-1}$, $2_{-2}$, in the case (1) described above, the total delivery pressure (or the suction pressure) of the pumps $2_{-1}$, $2_{-2}$ falls below the set value and so this can be detected so that prior to the generation of cavitation, it is possible to forcedly stop a pump that is operating and therefore protect it. However, in the case (2) described above, the temperature of the process liquid on the suction side of the pump rises beforehand but the suction pressure (or the delivery pressure) does not always drop to below the set value and so even if this is done, it is not possible to prevent the generation of cavitation.

However, the judgment for whether or not trouble such as pump cavitation or the like is occurring can be performed by determining whether or not the flowing equation (1) is established for the process liquid on the suction side of the pump.

$$Ha - hr > 0 \quad (1)$$

Where,

Ha: pump available net suction head hr: pump required net suction head

Moreover, the pump available net suction head Ha described above is a value that is determined by the process piping system and the pump required net suction head hr is a value determined by the structural design of the pump and the operating conditions and the like.

The pump available net suction head Ha described above is determined by the following equation.

$$Ha = D/\gamma + ys - Zs - Pu/\gamma \quad (2)$$

Where,

D: absolute pressure applied to the liquid surface of the process liquid on the suction side of the pump;

ys: height from the liquid surface of the process liquid on the suction side of the pump to the pump suction portion (a positive value when the pump suction portion is lower than the liquid portion);

Zs: loss head inside pump suction piping;

Pv: saturation vapor pressure of the process liquid in pump suction portion; and $\gamma$: specific gravity of the process liquid on suction side of pump.

Moreover, the loss head inside pump suction piping Zs is a value that is determined by the flow rate of the process liquid that flows in the piping, and the diameter, curvature and length of the piping.

However, since there is no instrumentation to constantly and accurately measure in real time whether or not this pump available net suction head Ha can be withstood, the above equation (1) cannot be used to investigate the pump flow rate control apparatus, and so no such control apparatus exists. It is for this reason that the pump flow control apparatus that has been described above has been conventionally used.

When the pump available net suction head can be determined by equation (2) that describes the Ha and the right hand side of this equation can be thought of as follows.

$$Ha = H_1 - H_2$$

$$H_1 = D/\gamma + ys - Zs$$

$$H_2 Pv/\gamma$$

Where, $H_1$: pressure of the process liquid at the point of measurement; and $H_2$: saturation steam pressure with respect to the temperature of the process liquid at the point of measurement.

More specifically, the pressure difference between the saturation vapor pressure with respect to the temperature of the process liquid at the point of measurement, and the pressure of the process liquid at a point of measurement can be measured.

Conventionally, an apparatus as shown in FIG. 37 is known as an apparatus for measuring this pressure difference.

More specifically, in this figure, 50 is a pressure difference transmitter, and is installed at a position separate from the process piping 49 for the purpose of improving the maintainability of the pressure difference transmitter 50 and in order to protect it from thermal transmission and vibration from the process piping and the pump.

In addition, the pressure difference sensor portion 54 of the pressure difference transmitter 50 is separated by the high-pressure side pressure-receiving portion 56 and the low-pressure side pressure-receiving portion 57. Then, the pressure of the process liquid $\alpha$ (alpha) inside the process piping 49 installed on the suction side of the pump, is led to the high-pressure side pressure-receiving portion 56 of the pressure difference transmitter 50 via the pressure pipe 51. On the other hand, the pressure inside the valve 52 that is inserted in the process liquid $\alpha$ on the suction side of the pump is lead to the low-pressure side portion side pressure-receiving portion 57 of the pressure difference transmitter 50 via a capillary tube 53.

Moreover, the valve 52, the capillary tube 53 and the inside of the low-pressure side pressure-receiving portion 57 are maintained in a state of vacuum, and to the lower portion of the valve 52 is sealed the process liquid $\alpha$. More specifically, the inside of the valve 52 and the low-pressure side pressure-receiving portion 57 is made a vacuum when the pressure difference transmitter 50 is assembled, and the process liquid $\alpha$ is sealed inside the lower portion of the valve 52 so that the pressure of the liquid in the upper portion of the valve 52, the capillary tube 53 and the low-pressure side pressure-receiving portion 57 becomes the saturation vapor pressure at the temperature of the required flow rate set value "a", that is sealed in the bottom portion of the valve 52.

In addition, at the same time, electrical signals are also inserted to a force coil 63 and, because of this force coil 63, a force that applies a displacement of the same magnitude and the opposite direction to the previously described displacement is applied to a sensor diaphragm 55 and a force rod 60 via a mechanism 61, so that the sensor diaphragm 55 and the force rod 60 return once again to their original positions.

More specifically, by this series of actions, a differential pressure is applied to the high-pressure side pressure-receiving portion 56 and the low-pressure side pressure-receiving portion 57 and there is no displacement of the sensor diaphragm 55 but electrical signals proportional to this differential pressure are output from the amplifier 64.

Moreover, for the sake of reference, FIG. 38 shows the displacement of the saturation steam pressure with respect to each temperature for the case when the process liquid is water.

Here, the valve 52 is inserted in the process liquid $\alpha$ on the suction side of the pump and so thermal transmission via the wall of the valve 52 causes the temperature of the process liquid α sealed in the lower portion of the valve 52 and the temperature of the process liquid α on the suction side of the pump in a status of thermal equilibrium to become the same. In this status, the pressure of the top portion of the valve 52, the capillary tube 53 and the low-pressure side pressure-receiving portion 57 is the saturation vapor pressure at the temperature of the process liquid on the suction side of the pump.

On the other hand, the pressure of the process liquid on the suction side of the pump is led to the high-pressure side pressure-receiving portion 56 of the pressure difference transmitter 50 via the high-pressure side pressure-receiving portion 56 and the pressure difference (differential pressure) between this high-pressure side pressure-receiving portion 56 and the low-pressure side pressure-receiving portion 57 is equivalent to the pump available net suction head Ha.

However, this apparatus has the following disadvantages.

(1) The process liquid α, sealed in the lower portion of the valve 52, transmits the saturation vapor pressure caused by that temperature to the low-pressure side pressure receiving portion 57; but for reasons already explained, the pressure difference transmitter 50 is installed at a position remote from the process piping 49 where the peripheral temperature is close to room temperature. Not only this, the internal diameter and the external diameter of the capillary tube 53 between the valve 52 and the low-pressure side pressure-receiving portion 57 is normally small when compared to the internal diameter of the valve 52 so as to improve the workability when the capillary tube 53 is installed so as to improve the measurement accuracy in the temperature measuring instrument where the liquid is sealed in the valve 52. Also, in this apparatus, the medium that transmits the saturation vapor pressure of the upper portion of the valve 52 is the saturated vapor inside the capillary tube 53 and the low-pressure side pressure-receiving portion 57. However, when the peripheral temperature of the low-pressure side pressure-receiving portion 57 and the capillary tube 53 installed at a position close to it is close to room temperature, the temperature of the saturated vapor in the low-pressure side pressure-receiving portion 57 and the capillary tube 53 also becomes close to room temperature and so the saturation vapor pressure in this portion also becomes the saturation vapor pressure for room temperature of the process liquid α.

More specifically, there is a differential pressure in the saturation vapor which is the pressure medium in the upper portion of the valve 52, the capillary tube 53 and the low-pressure side pressure-receiving portion 57 and as a result, it is not possible to perform accurate measurements.

(2) In addition, a pressure change must be transmitted from the portion where the relative volume is small (the upper portion of the valve 52) via the restricting portion that is the capillary tube 53, to a portion where there is a large volume (the low-pressure side pressure-receiving portion 57), so the measurement error becomes even larger.

(3) As already described for (1), the process liquid α, sealed in the lower portion of the valve 52, is heated by the process liquid α inside the process piping 49 and is vaporized after becoming a saturation vapor, but the portion close to the low-pressure side pressure-receiving portion 57 is near room temperature and so one portion is cooled, liquified and becomes the process liquid α. In this manner, the pressure inside the low-pressure side pressure-receiving portion 57 becomes the saturation vapor pressure of the process liquid α at a temperature close to room temperature and the pressure inside the low-pressure side pressure-receiving portion 57 is lower than the pressure in the upper portion of the valve 52, and so the saturation vapor of the process liquid supplied from the side of the valve 52 to the side of the low-pressure side pressure-receiving portion 57 always condenses inside the low-pressure side pressure-receiving portion 57 to become process liquid α and collect here. It therefore becomes impossible to apply the saturation vapor pressure with respect to the process liquid at room temperature, to the low-pressure side pressure-receiving portion 57 and ultimately, it becomes impossible to measure whether or not there is no process liquid in the bottom portion of the valve 52.

(4) Also, when this apparatus is installed, then should the valve 52 be inadvertently turned upside down or inclined and installed, the process liquid inside the valve 52 enters into and collects inside the capillary tube 53 and flows into the low-pressure side pressure-receiving portion 57 so that measurement is again rendered impossible.

Because of these disadvantages, the current situation is such that it is not possible to constantly and accurately measure in real time the degree to which the pump available net suction head can be withstood.

With respect to this, there has been disclosed in Japanese Patent Application Laid-Open Publication No. 127993-1991 (Mitsubishi Electric Corporation), a pump facility that receives first water supply flow amount control signals corresponding to a negative load, that adjusts the supply flow rate to that negative load, that is provided with a pump suction flow rate meter provided on an intake side of a pump, a first function generator that receives these signals of the suction flow rate meter and calculates the required net pump suction head (N.P.S.H.), a second function generator that receives signals from the pressure meter and the water supply temperature meter and calculates the available N.P.S.H., a controller to which the signals of the first function generator are input and subtracted and to which the signals of the second function generator are input and added and which outputs second water supply flow rate control signals, and a low signal selector that receives the output of the controller and the first water supply flow rate control signals and that sends the weaker of the two signals to a means for adjusting the water supply flow rate, so that even if there is a change in the operating status, the adjustment of the water supply flow rate to the load enables the available N.P.S.H. to always be maintained at above the required N.P.S.H. so that it is possible to prevent cavitation of the pump.

However, in the apparatus disclosed in Japanese Patent Application Laid-Open Publication No. 127993-1991, the controller performs either proportional or proportional+integral calculation so that $$a-k_1b-k_2 \geqq 0$$

Where, $k_1$, $k_2$: positive constants a: first function generator signals b: second function generator signals However, when there is only a proportional calculation, there is a remaining offset, so that for example, when there is control of the water supply flow rate by signals from the controller, the required N.P.S.H. actually becomes greater than the available N.P.S.H. Furthermore, when there is proportional+integral calculation, and the values of the control signals to make agreement with the required flow rate value are slightly larger than the values of the signals from the controller, the signals from the controller are saturated by integration. In this status, then even if the required N.P.S.H. is greater than the available N.P.S.H., there is no corrected signal output until the controller output due to integration becomes zero and so the required N.P.S.H. continues to be greater than the available N.P.S.H. for a long time, and as a result, it is possible that cavitation may occur.

SUMMARY OF THE INVENTION

It is an object of the present invention to provide a pump delivery flow rate control apparatus which may control a delivery flow rate of a pump to a value either equal to or in the vicinity of a required flow rate of the pump, and may prevent trouble such as the occurrence of cavitation and the lowering of the delivery pressure of the pump.

According to one aspect of the present invention, there is provided the control apparatus for controlling a delivery flow rate of a pump pressure-feeding process liquid within a process pipe system comprising: detecting means for detecting available N.P.S.H. of a pump on the basis of a pressure and a temperature of the process liquid within the suction portion of the pump; calculating means for calculating an allowable maximum flow rate of the pump so as to hold the relationship available N.P.S.H. > required N.P.S.H.; and outputting means for outputting a control signal to control the delivery flow rate of the pump on the basis of the smaller value, the allowable maximum flow rate or a required flow rate of the pump.

According to another aspect of the present invention, there is provided the control apparatus for controlling a delivery flow rate of a pump pressure-feeding process liquid within a process pipe system comprising: detecting means for detecting available N.P.S.H. of a pump on the basis of a pressure and a temperature of the process liquid within the suction portion of the pump; liquid inserting means for inserting a low-temperature process liquid into the process liquid on the suction side of the pump; and outputting means for comparing the available N.P.S.H. determined by the detecting means and required N.P.S.H. of the pump and outputting a control signal to the liquid inserting means in order to control an inserting amount of the liquid inserting means so as to hold the relationship available N.P.S.H. > required N.P.S.H.

According to still another aspect of the present invention, there is provided the control apparatus for controlling a delivery flow rate of a pump pressure-feeding process liquid within a process pipe system comprising: detecting means for detecting available N.P.S.H. of a pump on the basis of a pressure and a temperature of the process liquid within the suction portion of the pump; vapor supply means for supplying high pressure process vapor to press the process liquid on the suction side of the pump; and outputting means for comparing the available N.P.S.H. from the detecting means and required N.P.S.H. of the pump and outputting a control signal to the vapor supply means in order to control a supplying amount of the vapor supply means so as to hold the relationship available N.P.S.H. > required N.P.S.H.

According to still another aspect of the present invention, there is provided the control apparatus for controlling a delivery flow rate of a pump pressure-feeding process liquid within a process pipe system comprising:

detecting means for detecting available N.P.S.H. of a pump on the basis of a pressure and a temperature of the process liquid within the suction portion of the pump; liquid supply means for supplying a cooling liquid to a tank which temporarily stores the process liquid on the suction side of the pump and into which process vapor flows; and outputting means for comparing the available N.P.S.H. determined by the detecting means and required N.P.S.H. of the pump and outputting a control signal to the liquid supply means in order to control a supplying amount of the liquid supply means so as to hold the relationship available N.P.S.H. > required N.P.S.H.

According to still another aspect of the present invention, there is provided the control apparatus for controlling a delivery flow rate of a pump pressure-feeding process liquid within a process pipe system having a plurality of pumps comprising: detecting means for detecting available N.P.S.H. of each pump on the basis of a pressure and a temperature of the process liquid within the suction portion of the pump; calculating means for calculating an allowable maximum flow rate of the pump so as to hold the relationship available N.P.S.H. > required N.P.S.H.; and outputting means for outputting a control signal to control the delivery flow rate of the pump on the basis of the smaller value, the allowable maximum flow rate or a required flow rate of the pump.

According to still another aspect of the present invention, there is provided the control apparatus for controlling a delivery flow rate of a pump pressure-feeding process liquid within a process pipe system having a plurality of pumps comprising:

detecting means for detecting available N.P.S.H. of each pump on the basis of a pressure and a temperature of the process liquid within the suction portion of the pump; adjusting means for adjusting a required flow rate of the pump so as to hold the relationship available N.P.S.H. > required N.P.S.H.; and outputting means for outputting a control signal to control the delivery flow rate of the pump on the basis of the adjusted required flow rate of the pump.

According to still another aspect of the present invention, there is provided the control apparatus for controlling a delivery flow rate of a pump pressure-feeding process liquid within a process pipe system comprising: detecting means for detecting available N.P.S.H. of a pump on the basis of a pressure and a temperature of the process liquid within the suction portion of the pump; calculating means for calculating an allowable maximum flow rate of the pump so as to hold the relationship available N.P.S.H. > required N.P.S.H.;

detecting means for detecting an abnormal sound of a pump by an acoustic detector portion disposed in the vicinity of a pump and a predetermined limit flow rate signal; and outputting means for outputting a control signal to control the delivery flow rate of the pump on the basis of the smallest value, the allowable maximum flow rate, a required flow rate of the pump, or the predetermined flow rate.

According to still another aspect of the present invention, there is provided the control apparatus for controlling a delivery flow rate of a pump pressure-feeding process liquid within a process pipe system having a speed control pump comprising: detecting means for detecting required N.P.S.H. of a pump on the basis of a pressure and a temperature of the process liquid within the suction portion of the pump; calculating means for calculating an allowable maximum flow rate of the pump so as to hold the relationship available N.P.S.H. > required N.P.S.H.; and flow rate judging means for outputting a flow rate restriction signal to a delivery valve of the pump when it is judged that it is not possible to perform emergency speed control according to the allowable maximum flow rate.

BRIEF DESCRIPTION OF THE DRAWINGS

FIG. 28 is a block diagram equivalent to FIG. 3, FIG. 29 is an enlarged block diagram of the flow rate restriction possible judgment portion and the set value calculation portion, and FIG. 30 is a block diagram of the conditional low value priority portion and the set value change ratio control portion;

FIG. 39 is a table showing maximum allowable delivery flow rate for pumps in the system.

DETAILED DESCRIPTION OF THE PREFERRED EMBODIMENTS

The following is a detailed description of the preferred embodiments of the present invention, with reference to the appended drawings.

Figure 1:
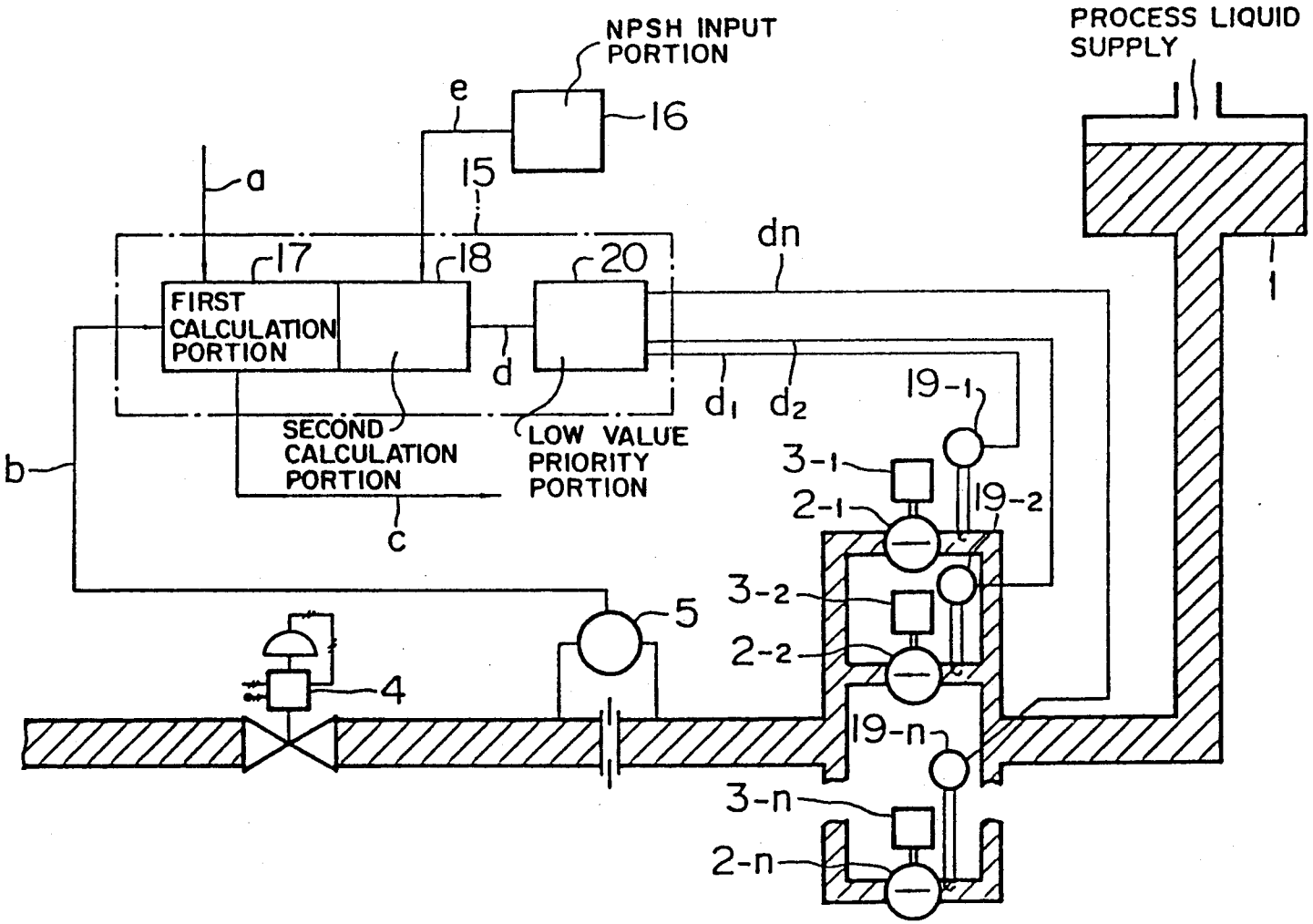
FIG. 1 through FIG. 3 are views of an embodiment of the present invention, with FIG. 1 being a system diagram, FIG. 2 being an outline view of an embodiment of an available N.P.S.H. measurement apparatus for a pump and FIG. 3 being an enlarged block diagram of a flow rate adjustment portion and a required N.P.S.H. input portion for a pump.

In FIG. 1, a plural number of pumps $\mathbf{2}_{-1}$ to $\mathbf{2}_{-n}$ are disposed in parallel along the process piping that is connected to a tank 1 in which a process liquid is temporarily collected, and these pumps $\mathbf{2}_{-1}$ to $\mathbf{2}_{-n}$ are configured so as to be separately driven by drive apparatus $\mathbf{3}_{-1}$ to $\mathbf{3}_{-n}$ for each pump, and to send a process liquid to a plant. In addition, to the delivery side of the pumps $\mathbf{2}_{-1}$ to $\mathbf{2}_{-n}$ are respectively disposed flow rate adjuster valves 4 for controlling the delivery flow rate of the process liquid from the pumps $\mathbf{2}_{-1}$ to $\mathbf{2}_{-n}$ to the plant, and flow rate meters 5 to measure the available flow rate to the plant.

Moreover, the available flow rate value b for the process liquid to the plant and which is the result of measurement of the flow rate meter 5 is input to the first calculation portion 17 of the flow rate adjustment portion 15. In addition, the required flow rate set value "a" from the plant is also input to this first calculation portion 17.

On the other hand, the available N.P.S.H. for each of the pumps $\mathbf{2}_{-1}$ to $\mathbf{2}_{-n}$ is calculated from both the saturation vapor pressure at the temperature of the process liquid as determined by the process temperature on the suction side of each of the pumps $\mathbf{2}_{-1}$ to $\mathbf{2}_{-n}$, and the pressure of the process liquid on the suction side of each of the pumps $\mathbf{2}_{-1}$ to $\mathbf{2}_{-n}$ but this measurement is performed by the available N.P.S.H. measurement apparatus $\mathbf{19}_{-1}$ to $\mathbf{19}_{-n}$. The available N.P.S.H. values $d_1$ to $d_n$ from these available N.P.S.H. measurement apparatus $\mathbf{19}_{-1}$ to $\mathbf{19}_{-n}$ are input to the low-value priority portion 20 and the minimum value d of these available N.P.S.H. values $d_1$ to $d_n$ and the required N.P.S.H. value e of the pumps $2_{-1}$ to $2_n$ and from the required N.P.S.H. input portion 16 for the pump is input to the second calculation portion 18 of the flow rate adjustment portion 15.

The following is a description of this operation.

The process liquid that is temporarily collected in the tank 1 has its pressure raised by the pumps $2_{-1}$ to $2_{-n}$ disposed in parallel, and is sent to the plant. When this is done, the control of the delivery flow amount of the pumps $2_{-1}$ to $2_{-n}$ and which is sent to the plant, controls the degree of opening of the flow rate adjuster valve 4 by the control signals c output from the flow rate adjustment portion 15, or controls the speed of the drive apparatus $3_{-1}$ to $3_{-n}$ and performs variable control of the speed of the pumps $2_{-1}$ to $2_{-n}$. In this manner, the process liquid has flow rate control performed while it is being sent to the plant.

Here, the available flow rate of the process liquid is measured by the flow rate meter 5. The available flow rate value b to the plant and which is the result of this measurement, is input to the first calculation portion 17 of the flow rate adjustment portion 15. On the other hand, the required flow rate set value "a" from the plant is input to the first calculation portion 17 of the flow rate adjustment portion 15 and in the first calculation portion 17, calculation for flow rate adjustment is performed so as to make the available flow rate value b to the plant agree with the required flow rate set value "a" and the control signals c' not shown in the figure are calculated.

To the second calculation portion 18 of the flow rate adjustment portion 15 is input the value that is obtained via the low-value priority portion 20 for those available N.P.S.H. $d_1$ to $d_n$ for each pump and which were measured by the available N.P.S.H. measurement apparatus $19_{-1}$ to $19_{-n}$ provided on the suction side of each of the pumps $2_{-1}$ to $2_{-n}$, that is, the minimum value d of the available N.P.S.H. $d_1$ to $d_n$ for each of the pumps $2_{-1}$ to $2_{-n}$. On the other hand, the information for the required N.P.S.H. e is input beforehand from the required N.P.S.H. input portion 16, and comparison calculation so that the relationship available N.P.S.H. > required N.P.S.H. is performed. By this, the correction value g (not indicated in the Figure) with respect to the previously described control signal c' is calculated so that trouble such as the occurrence of cavitation in the operating pumps $2_{-1}$ to $2_{-n}$ and the resultant rapid lowering of the delivery head (delivery pressure) of the pumps $2_{-1}$ to $2_{-n}$ do not occur. Then, the control signal c which is the result of calculating the correction value g with respect to the control signal c' is output from the flow rate adjustment portion 15.

Then, when there is control of the flow rate of the pump to the plant due to the flow rate adjuster valve 4, this control signal c is input to the flow rate adjuster valve 4 as the degree of opening control signal for the flow rate adjuster valve 4 and degree of opening control of the flow rate adjuster valve 4 is performed and the delivery flow rate of the pump to the plant is controlled. In addition, when flow rate control by variable speed control is performed for the pumps $2_{-1}$ to $2_{-n}$ these control signals are input to the drive apparatus $3_{-1}$ to $3_{-n}$ for the operating pumps as speed command signals, and variable speed control is performed for those pumps (of pumps $2_{-1}$ to $2_{-n}$) that are operating, and the delivery flow rate of the pumps $2_{-1}$ to $2_{-n}$ the plant is controlled.

Moreover, when there is a normal operating status, the required flow rate set value "a" from the plant < total of the maximum allowable flow rate values for each of the operating pumps, and when there is a sufficient surplus, the available N.P.S.H. is greater than the required N.P.S.H. Accordingly, in these cases, the control signals c from the flow rate adjustment portion 15 due to the calculation for flow rate control of the pump and performed in the first calculation portion 17 of the flow rate adjustment portion 15 becomes a value so that the available flow rate value b of the process liquid to the plant is in agreement with the required flow rate set value "a" from the plant.

However, for example, if as in the case when a pump that was operating has failed and stopped, the required flow rate set value "a" from the plant > total of the maximum allowable flow rate values for each of the pumps remaining operating, and if there is operation in this status, then available N.P.S.H. of said pump < required N.P.S.H. of said pump.

In this case, the calculation in the first calculation portion 17 of the flow rate adjustment portion 15 calculates the correction value g so that available N.P.S.H. of said pump > required N.P.S.H. of said pump, and the control signal c which is the result of adding this correction value g is output from the flow rate adjustment portion 15. More specifically, the delivery flow rate that the pump sends to the plant is controlled so that it normally becomes the required flow rate set value from the plant but should an abnormal situation occur where it may occur that required N.P.S.H. of said pump < available N.P.S.H. of said pump then available N.P.S.H. of said pump > required N.P.S.H. of said pump is satisfied and the delivery flow rate that is sent to the plant from the pump is controlled so that it is as close as is possible to the required flow rate set value from the plant.

As a result, there is always control so that cavitation does not occur in a pump that is operating and so that there is no resultant destruction of the pump and so that other trouble such as the rapid lowering of the delivery flow head (delivery pressure) of the pump does not occur, and at the same time, the delivery flow rate of the pump and which is sent to the plant can be controlled so that it is always a value which is in the vicinity of the required flow rate set value from the plant.

Figure 36:
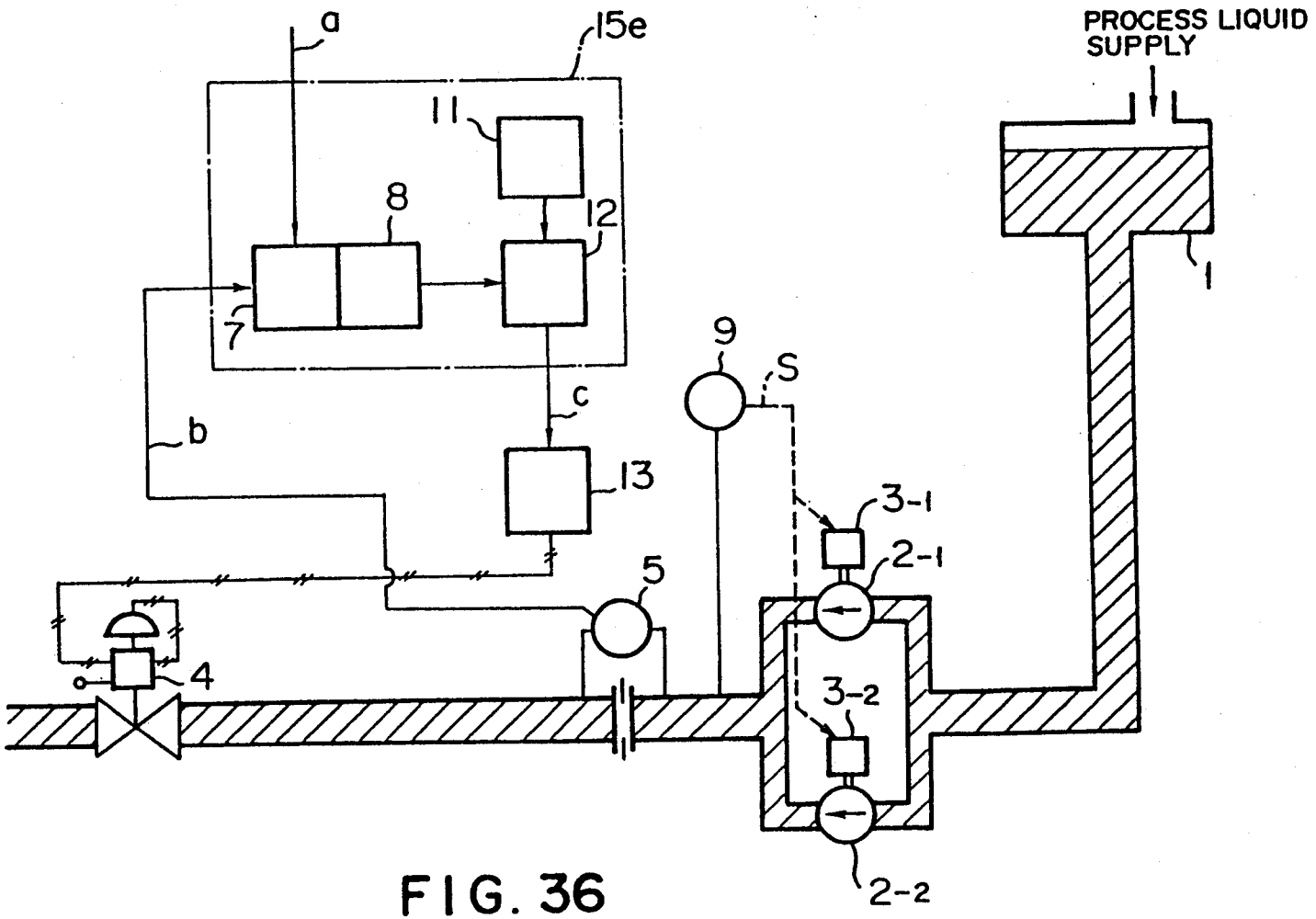
FIG. 36 PRIOR ART
FIG. 36 is a conventional system diagram.
Figure 37:
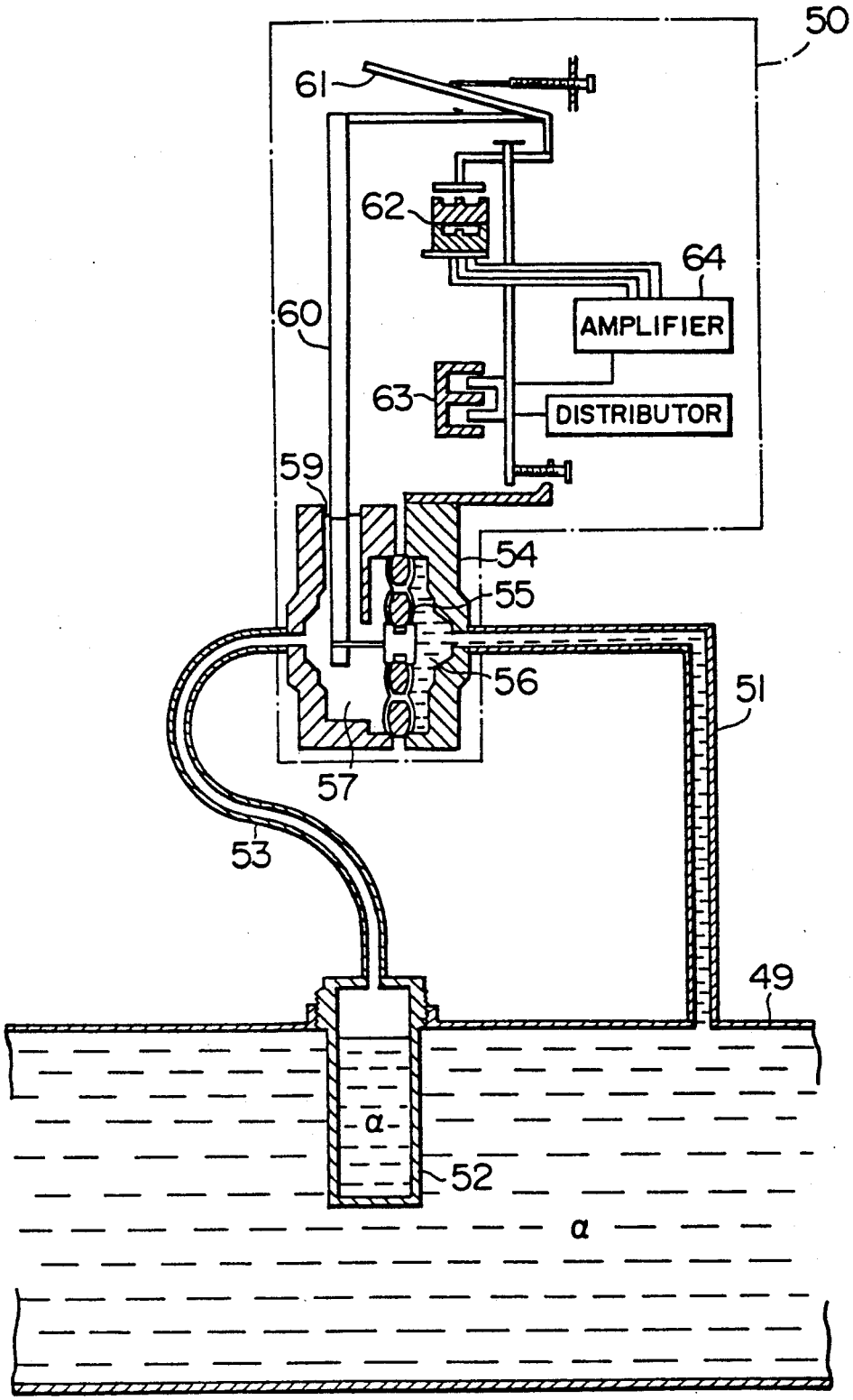
FIG. 37 PRIOR ART
FIG. 37 is an outline diagram showing one example of a pump available N.P.S.H. measurement apparatus of the same.

FIG. 2 through FIG. 5 show details of each portion of the configuration block diagram shown in FIG. 1. Moreover, those portions of these Figures that are similar or the same as corresponding portions of FIG. 36 and FIG. 37 are shown with corresponding numerals, and the corresponding descriptions of them have been omitted.

Figure 2:
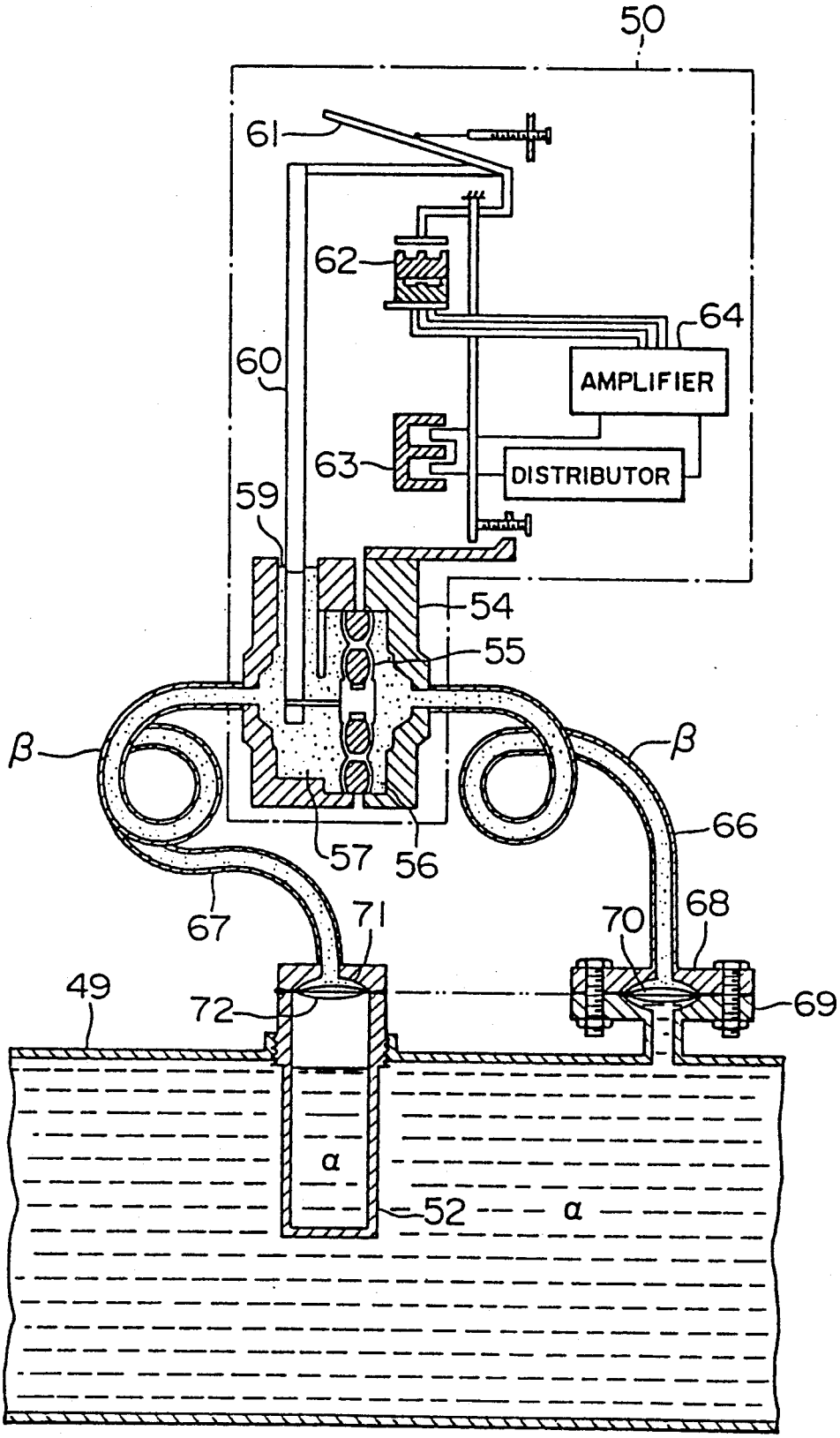

FIG. 2 is a detailed view of the available N.P.S.H. measurement apparatus $19_{-1}$ to $19_{-n}$, and the saturated vapor in the low-pressure side pressure receiving portion 57 of the pressure difference sensor portion 54 of the pressure difference transmitter 50 recondenses and collects as process liquid $\alpha$, and this process liquid $\alpha$ blocks the low-pressure side capillary tube 67, and furthermore, a differential pressure between the upper portion of the valve 52 and the low-pressure side pressure-receiving portion 57 occurs so that it is no longer possible to measure the available N.P.S.H. and even if it were possible to measure it, it would not be possible to do so accurately. In order to prevent this, the available N.P.S.H. measurement apparatus $19_{-1}$ to $19_{-n}$ has the configuration described below.

More specifically, to one end of the low-pressure side pressure-receiving portion 57 of the pressure difference sensor portion 54 of the pressure difference transmitter 50 is connected a low-pressure side capillary tube 67, and to the other end of this low-pressure side capillary tube 67 is connected a valve head portion 71, and furthermore, a valve 52 is mounted via a low-pressure side sealing diaphragm 72. Then, the sealing liquid $\beta$ (beta) is filled inside the low-pressure side pressure-receiving portion 57, the low-pressure side capillary tube 67 and the valve head portion 71, and the inner portion of the valve 52 is separated by the low-pressure side capillary tube 67 to form a structure where the sealing liquid $\beta$ is sealed within. Also, the pressure inside the valve 52 is transmitted to the side of the sealing liquid $\beta$.

Then, when the available N.P.S.H. measurement apparatus $19_{-1}$ to $19_{-n}$ are incorporated inside the valve 52, a vacuum is created by a vacuum pump and the process liquid $\alpha$ is sealed at a position at the bottom portion of the valve 52.

Moreover, when the process liquid $\alpha$ is sealed at a position at the bottom portion of the valve 52, a measurement error will occur due to this sealed liquid $\beta$ and so in order to cancel this, the side of the high-pressure side pressure-receiving portion 56 of the pressure difference sensor portion 54 has the configuration described below.

More specifically, to one end of the high-pressure side pressure-receiving portion 56 is connected a high-pressure side capillary tube 66 and to the other end of this high-pressure side capillary tube 66 is connected a pressure detection portion 68. Furthermore, the portion of the pressure detection portion 68 that detects the process pressure has mounted to it a high-pressure side sealing diaphragm 70. Then, the same sealing liquid $\beta$ as that which was sealed to the side of the low-pressure side pressure-receiving portion 57 described above is filled inside the high-pressure side pressure-receiving portion 56, the high-pressure side capillary tube 66 and the pressure detection portion 68 so that the high-pressure side sealing diaphragm 70 separates the process liquid $\alpha$ and the sealing liquid $\beta$ and seals the sealing liquid $\beta$ and so that the pressure of the process liquid $\alpha$ is transmitted to the side of the sealing liquid $\beta$.

Moreover, the high-pressure side capillary tube 66 and the low-pressure side capillary tube 67 are structured so as to have the same inner and outer diameters and as far as possible have the same internal volume as the sealing liquid $\beta$ of the portion of the valve head portion 71 and the pressure detection portion 68, and so as to have the same internal volume as the sealing liquid $\beta$ of the portion of the low-pressure side pressure-receiving portion 57 and the high-pressure side pressure-receiving portion 56.

Then, the pressure detection portion 68 of the available N.P.S.H. measurement apparatus $19_{-1}$ to $19_{-n}$ and having this structure are mounted to the pressure detector plate 69 so as to measure the pressure of the process liquid $\alpha$ in the process piping 49 of the pump. On the other hand, the valve 52 is mounted to the process piping 49 on the suction side of the pump so that the temperature of the process liquid $\alpha$ inside the process piping 49 on the suction side of the pump becomes the same due to thermal transmission by the wall surface of the valve 52, and is disposed so that the surface of the low-pressure side sealing diaphragm 72 and the high-pressure side sealing diaphragm 70 are at substantially the same level, while the high-pressure side capillary tube 66 and the low-pressure side capillary tube 67 are positioned so that their installation atmospheres are as close to each other as possible.

Figure 3:
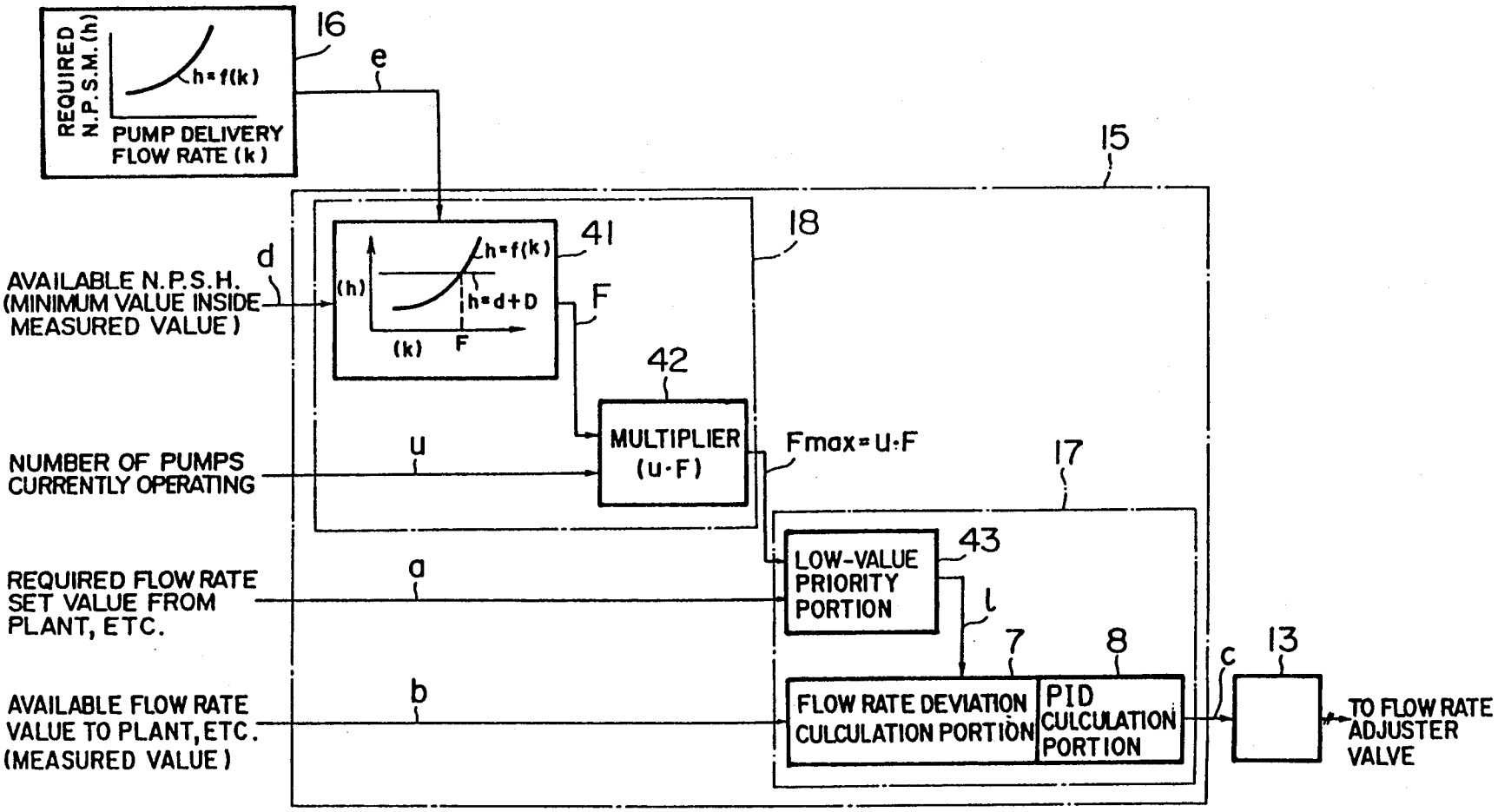

FIG. 3 is a detailed view of the flow rate adjustment portion 15 and the required N.P.S.H. input portion 16.

Figure 4:
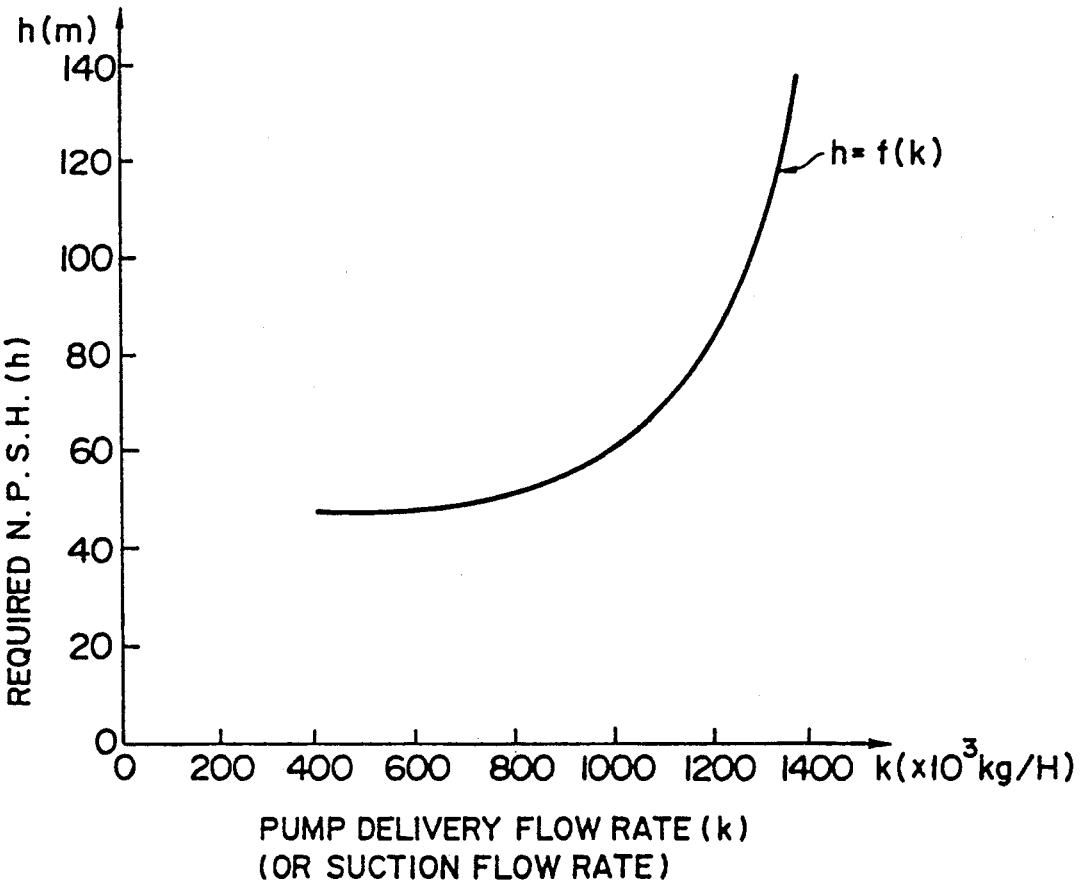
FIG. 4 is a graph showing one example of a "pump delivery flow rate pump required N.P.S.H." curve.

FIG. 4 shows one example where the required N.P.S.H. value e is input to the required N.P.S.H. input portion 16. The Figure shows the case for one of the pumps $2_{-1}$ to $2_{-n}$, with the horizontal axis showing the pump delivery flow rate (or suction flow rate), and the vertical axis showing the pump delivery flow rate with respect to the required N.P.S.H., and the curve $h=f(k)$ expresses the input for each "pump delivery flow rate for pump required N.P.S.H."

Here, the curve $h=f(k)$ shown in FIG. 4 is the curve that expresses that there is no generation of cavitation or other problems when the available N.P.S.H. on the suction side of a pump is greater than the required N.P.S.H. for that pump and calculated by $h=f(k)$ for that pump, and that expresses that the generation of cavitation or other problems will occur when the available N.P.S.H. is a value smaller than the required N.P.S.H.

The second calculation portion 18 is mainly configured from an allowable flow rate calculation portion 41 and a multiplier portion 42 and in addition to the curve $h=f(k)$ described above, the allowable flow rate calculation portion 41 first inputs the value obtained via the low-value priority portion 20 for the measurement results $d_1$ to $d_n$ by the available N.P.S.H. measurement apparatus $19_{-1}$ to $19_{-n}$ of the pump, that is, the minimum value d of the available N.P.S.H. for each pump. Then, the allowable maximum flow rate F for one of those pumps and which is the calculation result is output from the allowable flow rate calculation portion 41. In the multiplier portion 42, the number of currently operating pumps u and the allowable maximum flow rate F for one pump are input and the total allowable maximum flow rate value Fmax which is the result of multiplication is output.

The first calculation portion 17 is configured from a low-value priority portion 43, a flow rate deviation calculation portion 7 and a PID calculation portion 8, and the low-value priority portion 43 first inputs the total allowable maximum flow rate Fmax for the operating pumps, and the required flow rate set value "a"

from the plant, and outputs the lowest of these values as the low-priority portion output signal 1. To the flow rate deviation calculation portion 7 is input the available flow rate value b which is the result of measurement by the flow rate meter 5, and here the difference between the two, that is, the deviation, is calculated and the PID calculation portion 8 outputs the control signals c which are the result of PID calculation. Then, to the electro-pneumatic converter 13 are input these control signals c and pneumatic signals of a pressure proportional to these control signals c are output to the flow rate adjuster valve 4.

The following is a description of the operation.

As shown in FIG. 2, the available N.P.S.H. values $d_{-1}$ to $d_{-n}$ for each pump $2_{-1}$ to $2_{-n}$ are measured by the available N.P.S.H. measurement apparatus $19_{-1}$ to $19_{-n}$ provided on the process piping 49 on the suction side of the pump, but this will be described using FIG. 2.

The pressure of the process liquid inside the process piping 49 on the suction side of the pump is transmitted to the high-pressure side sealing diaphragm 70 of the pressure detection portion 68 mounted to the pressure detector plate 69. Then, this pressure is transmitted to the sensor diaphragm 55 via the sealing liquid $\beta$ sealed inside the high-pressure side pressure-receiving portion 56, the high-pressure side capillary tube 66 and the pressure detection portion 68. On the other hand, the temperature of the process liquid $\alpha$ inside the process piping 49 on the suction side of the pump is transmitted to the process liquid $\alpha$ sealed inside the low-pressure side sealing diaphragm 72 and the valve 52 via the bottom portion and the wall portion of the valve 52, and the temperature of the process liquid $\alpha$ inside the valve 52 and the temperature of the process liquid $\alpha$ inside the process piping 49 become the same temperature in the equilibrium status.

However, the inner portion surrounded by the valve 52 and the low-pressure side sealing diaphragm 72 is made a vacuum by the action of a vacuum pump or the like and the process liquid $\alpha$ is sealed inside the lower portion of the valve 52 and so as has been described earlier, in the status where the temperature of the process liquid $\alpha$ inside the valve 52 and the temperature of the process liquid $\alpha$ inside the process piping 49 have become the same temperature, the pressure in the space at the upper portion inside the valve 52 becomes the pressure of the saturation vapor of the process liquid $\alpha$ at that temperature. More specifically, the saturation vapor pressure with respect to the process liquid $\alpha$ inside the process piping 49 and at that temperature is transmitted to the low-pressure side sealing diaphragm 72. Then, this pressure is transmitted to the sensor diaphragm 55 via the sealing liquid $\beta$ which is sealed inside the valve head portion 71, the low-pressure side capillary tube 67 and the low-pressure side pressure-receiving portion 57.

The high-pressure side capillary tube 66 and the low-pressure side capillary tube 67 have the same lengths, inner and outer diameters and the inner volumes of the sealing liquid $\beta$ in the pressure detection portion 68 and the valve head portion 71 are made as close as possible to each other, and furthermore, the structure is such that the inner volumes of the sealing liquid $\beta$ in the portions of the high-pressure side pressure receiving portion 56 and the low-pressure side pressure-receiving portion 57 are made as close to each other as possible, so that the surface of the high-pressure side sealing diaphragm 70 and the surface of the low-pressure side sealing diaphragm 72 are positioned at the same level so that the influence due to the nature and density of the sealing liquid $\beta$ on the side of the high-pressure side pressure-receiving portion 56 and which is applied to the sensor diaphragm 55 and the influence due to this on the side of the low-pressure side pressure-receiving portion 57 mutually cancel each other as a differential pressure.

However, the high-pressure side capillary tube 66 and the low-pressure side capillary tube 67 are disposed at places where the installation atmosphere is as similar as possible, and furthermore, the high-pressure side capillary tube 66 and the low-pressure side capillary tube 67 are installed in the same place for as far as this is possible and so the influence to the sensor diaphragm 55 caused by thermal expansion of the sealing liquid $\beta$ inside both and caused by temperature of the atmosphere at the place of installation of the high-pressure side capillary tube 66 and the low-pressure side capillary tube 67 is also the same, thereby mutually canceling it as a pressure difference.

Accordingly, to the sensor diaphragm 55 is applied the differential pressure of the pressure of the process liquid $\alpha$ on the suction side of the pump and the saturation vapor pressure at that temperature for the process liquid $\alpha$ on the suction side of the pump, that is, the pressure equivalent to the available N.P.S.H. of the pump. Then, the action after this involves the output from the available N.P.S.H. measurement apparatus 19 of electrical signals equivalent to the pump available net suction head Ha in the same manner as was described with reference to FIG. 37.

Moreover, the cavity in the upper portion of the process liquid $\alpha$ in the valve 52 has an extremely simple structure wherein it is surrounded by the wall surfaces of the valve 52 and the low-pressure side sealing diaphragm 72 and so the temperature of the process liquid $\alpha$ in the valve 52 rises and when it has vaporized to become saturated vapor, that cavity can be filled or conversely, the temperature of the process liquid $\alpha$ can be lowered and one portion of the saturation vapor can be liquified so that it collects at the bottom portion of the valve 52.

In this manner, the available N.P.S.H. measurement apparatus $19_{-1}$ to $19_{-n}$ measures the available N.P.S.H. $d_1$ to $d_n$ for each of the pumps $2_{-1}$ to $2_{-n}$ but the available N.P.S.H. $d_1$ to $d_n$ output from the available N.P.S.H. measurement apparatus $19_{-1}$ to $19_{-n}$ is input to the low-value priority portion 20 and the value obtained by this, that is, the minimum value d of the available N.P.S.H. $d_1$ to $d_n$ for each of the pumps $2_{-1}$ to $2_{-n}$ is input to the allowable flow rate calculation portion 41 shown in FIG. 3. This minimum value d is the available N.P.S.H. value of a pump out of the pumps $2_{-1}$ to $2_{-n}$ that is in the status where cavitation and associated problems are likely to occur. On the other hand, the function curve $h=f(k)$ for the "delivery flow rate (or suction flow rate)" and the "required N.P.S.H. value" of a pump for one of the pumps is input from the required N.P.S.H. input portion 16 as shown in FIG. 4, and this information is input to the allowable flow rate calculation portion 41 as the required N.P.S.H. value e for the pump.

Then, the allowable flow rate calculation portion 41 determines and outputs the intersection with the straight line $h=d+D$ (where D is the surplus value and is a small, positive number, and in certain cases $D=0$) which is determined from the available N.P.S.H. for the pump, and the function curve $h=f(k)$. This intersection k=F is the point expressing the allowable maximum flow rate value F for one pump and calculated from the available N.P.S.H. value (measured value) for a currently operating pump. More specifically, if the delivery flow rate for one pump is larger than F, then required N.P.S.H.>available N.P.S.H.

and trouble due to cavitation and the like will occur, so that in this case it is necessary to make the delivery flow rate for one pump smaller than F as quickly as possible.

The allowable maximum flow rate value F for one pump is input to the multiplier portion 42 and the number of currently operating pumps u is also input and the total allowable maximum flow rate value Fmax (=u·F) for the currently operating pumps and which is the result of multiplication of both is output. This means that the total delivery flow rate value that can be sent to the plant from the currently operating pumps is judged from the available N.P.S.H. value for those pumps as being less than the total allowable maximum flow rate value Fmax.

Figure 5:
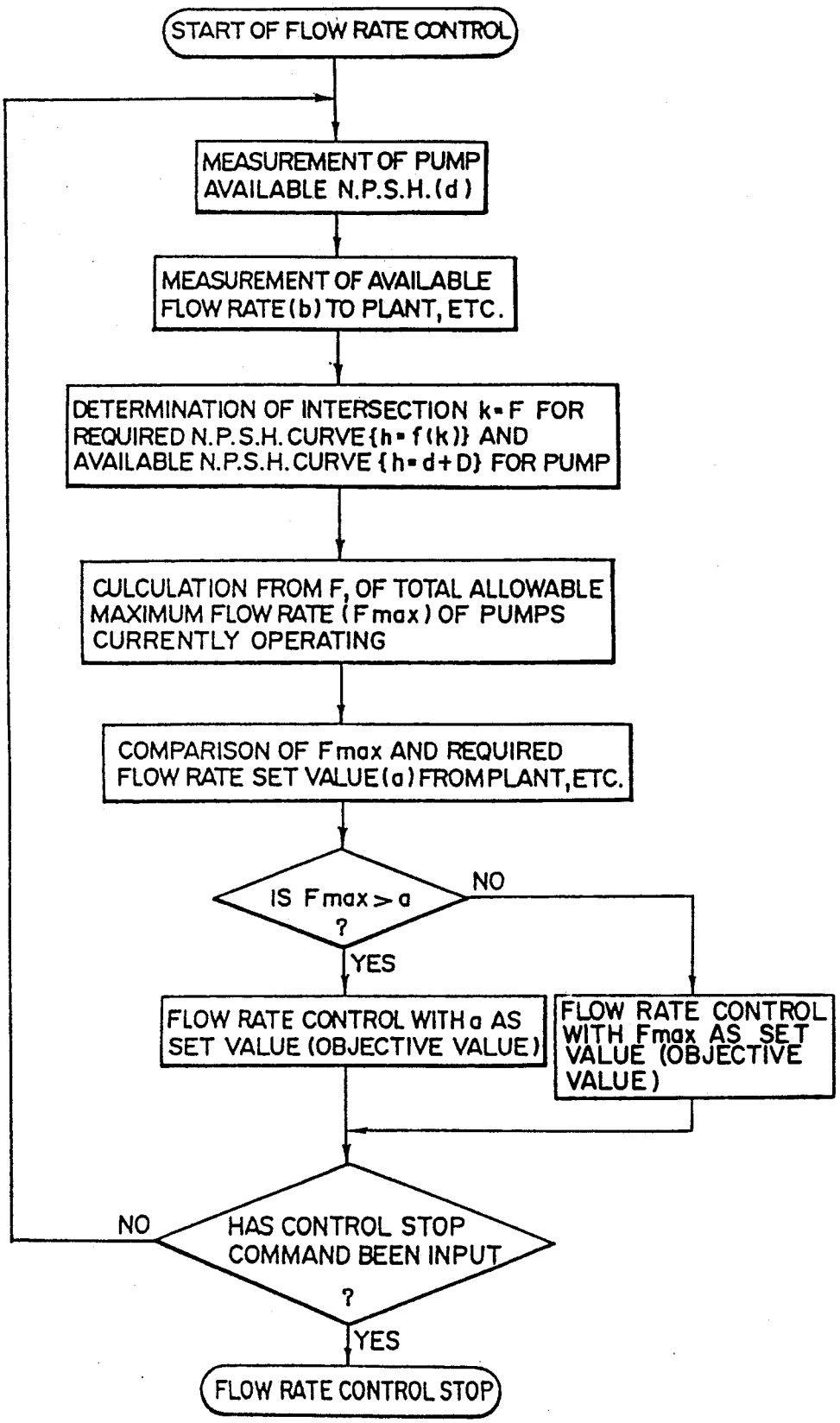
FIG. 5 is a flow chart of one example of the processing flow.

In addition to this total allowable maximum flow rate value Fmax for the currently operating pumps and which is the output signal from the multiplier portion 42, the required flow rate set value "a" from the plant is also input and the low-priority portion output signal 1 is output as the result of calculation. Then, the available flow rate value b (measured value) to the plant and this low-priority portion output signal 1 is input to the flow rate deviation calculation portion 7 and, after the difference between the two has been calculated, the low-priority portion output signal 1 is used as the control value for control calculation at the PID calculation portion 8 so that the available flow rate value b is made to agree with it, and the results are output as the control signal c. Then, this control signal c is input to the electropneumatic converter 13 where it is converted into electrical signals proportional to the input signals (electrical signals) and output as a degree of opening command signal with respect to the flow rate adjuster valve 4. FIG. 5 shows this processing flow.

Accordingly, with the present embodiment and the normal operating status, (the status where pumps of the rated number are normally operating), the total value of the maximum allowable flow rate for the currently operating pumps > required flow rate set value from the plant and available N.P.S.H. for said pumps > required N.P.S.H. for said pumps and so in this case, the low-priority portion output signal 1 becomes lower than the required N.P.S.H. for said pumps. Accordingly, the control signals c from the PID calculation portion 8 are signals that perform control to the required flow rate set value (objective value) from the plant.

On the other hand, should one of the pumps fail and stop so that required N.P.S.H. for said pumps > value for total of maximum allowable flow rate for pumps that did not fail and which are continuing operation -continued continued operation in this status will quickly start to cause available N.P.S.H. for said pumps<required N.P.S.H. for said pumps If this occurs, then the low-priority portion output signal 1 will change to the total allowable maximum flow rate value Fmax and as a result, the control signals c from the PID calculation portion 8 will change to signals to perform control so that available N.P.S.H. for said pumps<required N.P.S.H. for said pumps is satisfied, that is, so that there is the total allowable maximum flow rate value Fmax (=u·F).

Accordingly, if the present embodiment is used, then when a pump that has been operating fails and stops, so that required N.P.S.H. for said pumps > value for total of maximum allowable flow rate for pumps that did not fail and which are continuing operation, then it is possible to perform control so that available N.P.S.H. for said pumps>required N.P.S.H. for said pumps and at the same time so that the delivery flow rate of a pump sending to the plant is controlled to a value as close to the required N.P.S.H. from the plant as is possible.

In addition, in the case where a pump that is operating does not fail and stop, that is required N.P.S.H. for said pumps < value for total of maximum allowable flow rate for pumps that are continuing operating, then when there is a status where there is the possibility of the occurrence of cavitation, such as when there is a valve along the process piping on the suction side of the pump and when the degree of opening of this valve is less than the rated degree of opening for some reason, or when the temperature of the process liquid on the suction side of the pump rises abnormally while the pump is operating, so that the available N.P.S.H. becomes smaller to become less than the required N.P.S.H. and so that the low-priority portion output signal 1 changes to total allowable maximum flow rate value Fmax for the pumps that are currently operating, then as a result, available N.P.S.H. for said pumps>required N.P.S.H. for said pumps is satisfied and it is possible to perform control so that the pump delivery flow rate is made a value that is as close as possible to the required flow rate value from the plant.

More specifically, according to the present embodiment, if for some reason the status where required N.P.S.H. for said pumps > available N.P.S.H. for said pumps is likely to occur, then this status is avoided and the status where available N.P.S.H. for said pumps > required N.P.S.H. for said pumps is always established and control signals c are output so that there is control of the pump delivery flow rate to a value that is close to the required flow rate value from the plant so that it is possible to prevent the occurrence of trouble such as that due to cavitation.

Accordingly, according to the present embodiment, it is possible to perform positive control so as to prevent the occurrence of trouble such as that due to cavitation in cases when the degree of opening of a valve on the process piping on the suction side is not open to the rated degree of opening, or in cases when the temperature of the process liquid on the suction side rises to above a rated value, such as that which could not be conventionally controlled in a positive manner so as to prevent the occurrence of trouble such as cavitation in pumps.

By this, it is no longer necessary to provide suction pressure switches or delivery pressure switches to pumps so as to prevent the occurrence of trouble such as cavitation in pumps.

In addition, according to the conventional apparatus, the speed of the pump changes to an objective value (fixed value) or the degree of opening of an adjustment value is instantly made smaller to a degree of opening objective value (fixed value) the moment there is pump failure and irrespective of whether there has been normal operation control to a required flow rate set value from the plant. Because of this, the temporary disturbance of the delivery flow rate control for the pump easily occurred. In addition, the general method of preventing such disturbance was to perform gradual, stepped changes for the ultimate degree of opening objective value or the speed objective value but a complex flow rate adjustment meter is required in order to performed such stepped change.

However, according to the present embodiment, even if a pump fails and stops, and the status where available N.P.S.H. of pump < required N.P.S.H. of pump appears likely to occur, the objective value of the PID calculation portion 8 having an extremely simple configuration is gradually reduced from the required flow rate set value "a" from the plant and ultimately makes a smooth transition to the total allowable maximum flow rate value Fmax for the pumps that are operating, so that there is no disturbance of control. Accordingly, the configuration of the flow rate adjustment portion 15 can perform smooth delivery flow rate control for pumps despite its having a simple configuration.

In addition, if the available N.P.S.H. measurement apparatus 19$_{-1}$ to 19$_{-n}$ for the pump shown in FIG. 2 and the present embodiment are used, then on the side of the low-pressure side pressure-receiving portion 57 of the pressure difference transmitter 50, the portion which is filled with saturation vapor of the process liquid $\alpha$ that is sealed inside the valve 52 is limited to within the range surrounded by the low-pressure side sealing diaphragm 72 and the surface of the process liquid sealed inside the lower portion of the valve 52 and the wall surfaces of the valve 52 so that there is no influence of the saturation vapor pressure of the process liquid due to the atmospheric temperature or other conditions at the place where the pressure difference transmitter 50 or the low-pressure side capillary tube 67 have been installed, and it is possible to accurately transmit the saturation vapor pressure to the low-pressure side pressure-receiving portion 57.

In addition, since there is no restrictor portion such as a capillary tube along the portion that must be filled with saturation vapor, there is no measurement error due to this. Furthermore, when the saturation vapor is cooled and one portion of it liquifies, then it joins the process liquid $\alpha$ in the lower portion of the valve 52 and so the saturation vapor pressure inside the valve 52 can always be measured accurately and at a uniform pressure.

Not only this, it is also possible for the process liquid inside the valve 52 to move in the direction of the low-pressure side capillary tube 67 so that there is no trouble such as the process liquid $\alpha$ in the lower portion of the valve 52 moving to a place other than the inner portion of the valve 52 when there is usage for extended periods, and also trouble caused when the available N.P.S.H. measurement apparatus 19$_{-1}$ to 19$_{-n}$ is installed by inadvertently turning it upside down so that the process liquid inside the valve 52 enters into and collects inside the low-pressure side capillary tube 67 to prevent measurement.

Accordingly, if the available N.P.S.H. measurement apparatus 19$_{-1}$ to 19$_{-n}$ are used, then it is possible to accurately and constantly detect in real time the available N.P.S.H. values $d_1$ to $d_n$ that can be withstood.

In addition, in the case of the available N.P.S.H. measurement apparatus 19$_{-1}$ to 19$_{-n}$, transmitting the saturation vapor pressure at that temperature of the process liquid $\alpha$ on the side of the low-pressure side pressure-receiving portion 57 is not limited to the use of the sealing liquid $\beta$ but can be a sealing liquid $\beta$ for pressure transmission to the side of the high-pressure side pressure-receiving portion 56, and by having the structure of the high-pressure side capillary tube 66 and the low-pressure side capillary tube 67 the same as is possible, by having the high-pressure side capillary tube 66 and the low-pressure side capillary tube 67 installed at places having the same atmosphere and by having the surface of the high-pressure side sealing diaphragm 70 and the surface of the low-pressure side sealing diaphragm 72 at substantially the same level, it is possible to mutually cancel the influence of the sealing liquid $\beta$between the side of the high-pressure side pressure-receiving portion 56 and the side of the low-pressure side pressure receiving portion 57 so that it is possible to have the further effect of being able to measure the available N.P.S.H. of a pump without having to consider the use of the sealing liquid $\beta$.

Moreover, FIG. 2 shows an example when an electrical type of pressure difference transmitter 50 is used but one of the pneumatic type can also be used. Also, the pressure difference transmitter 50 is one method of conversion into electrical signals that are proportional to the differential pressure that is to be measured but other methods can be used, such as one that converts the magnitude of the differential pressure into electrical signals or pneumatic signals. Furthermore, the pressure difference sensor portion 54 is not limited to one of the diaphragm type, as a bellows type sensor, a piston type sensor or a Bourdon tube can be used as long as it is a sensor that can measure a differential pressure.

Figure 6:
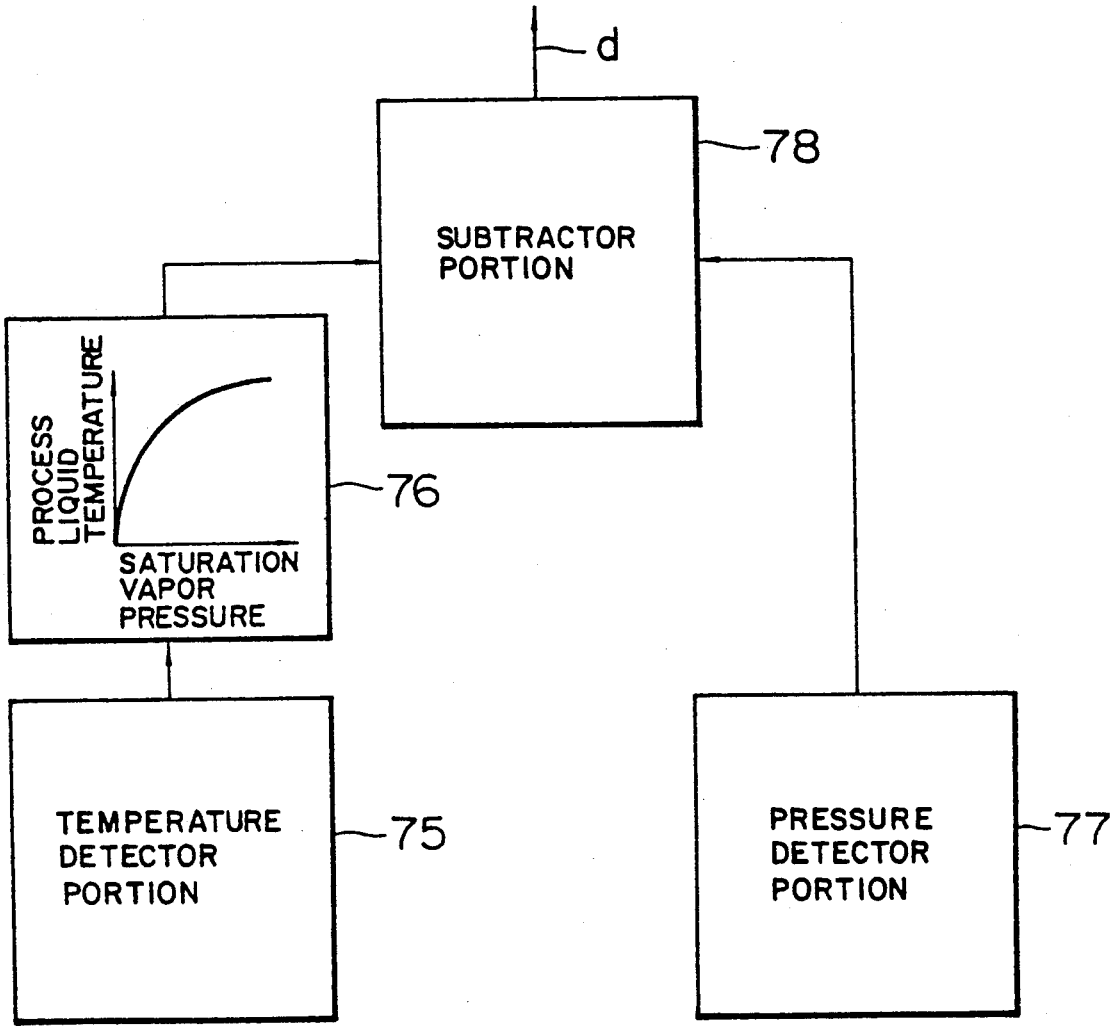
FIG. 6 and FIG. 7 are outline diagrams of other examples of required N.P.S.H. input portions for a pump.

FIG. 6 shows another example of an available N.P.S.H. measurement apparatus $19_{-1}$ to $19_{-n}$.

Figure 38:
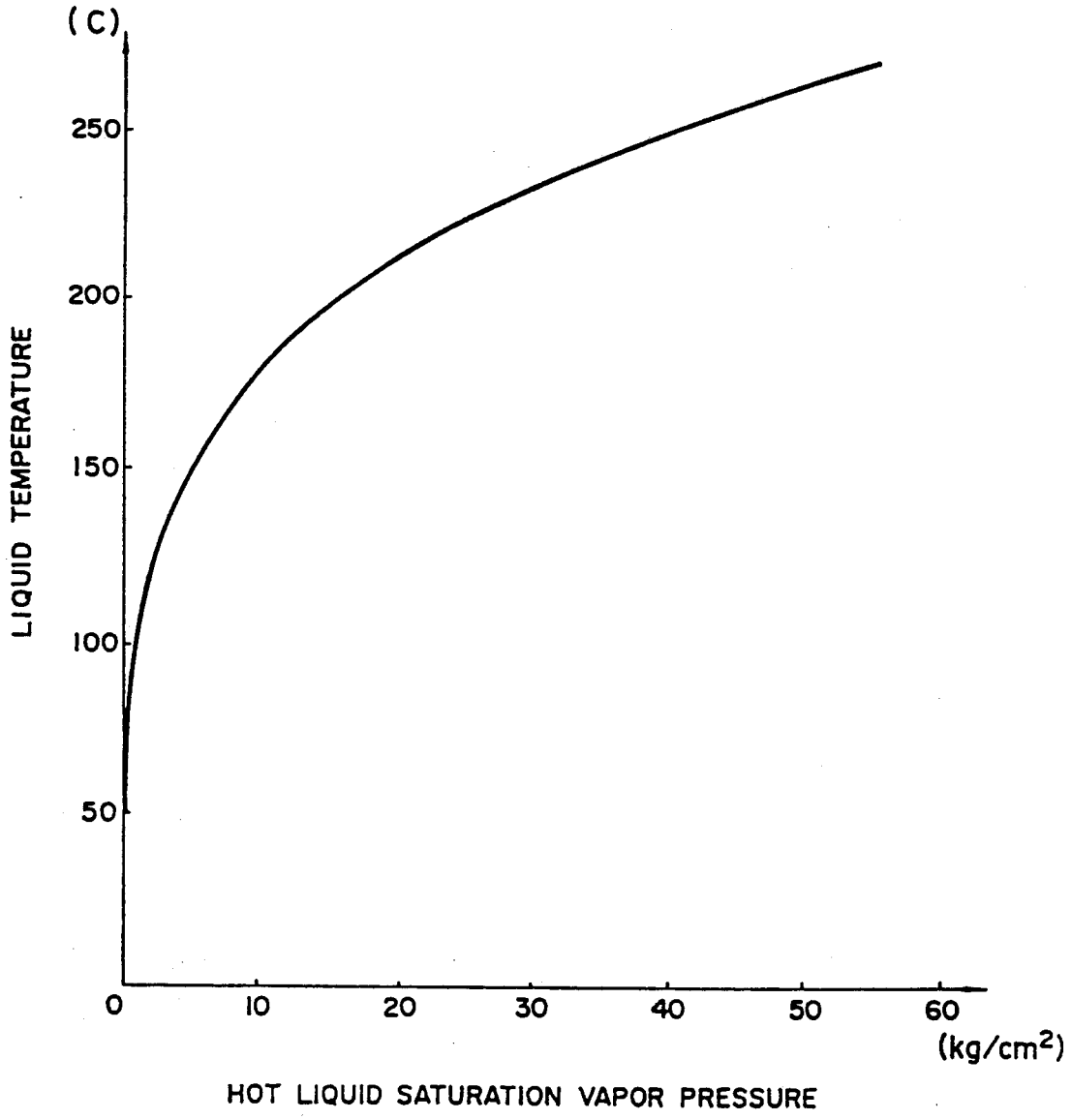
FIG. 38 is a graph showing the relationship between the water temperature and the water saturated steam pressure when the process liquid is water.

More specifically, the temperature of the process liquid is detected by the temperature detector portion 75 and the temperature/saturation pressure conversion portion 76 performs water temperature saturation vapor pressure calculation in accordance with FIG. 38, to obtain the saturation vapor pressure value for the process liquid. On the other hand, the pressure value of the process liquid is measured by the pressure detector portion 77 or the process liquid, and the pressure difference of both pressure values is calculated by the subtractor portion 78 so that the available N.P.S.H. $d_{-1}$ to $d_{-n}$ for the pumps $2_{-1}$ to $2_{-2}$ is obtained.

Moreover, the temperature detector portion 75 and the temperature/saturation pressure conversion portion 76 can be separated to have separate calculation functions, but both functions can be combined so that the results for the measurement of the temperature of the process liquid are used to directly output the saturation vapor pressure value for the process liquid.

Figure 7:
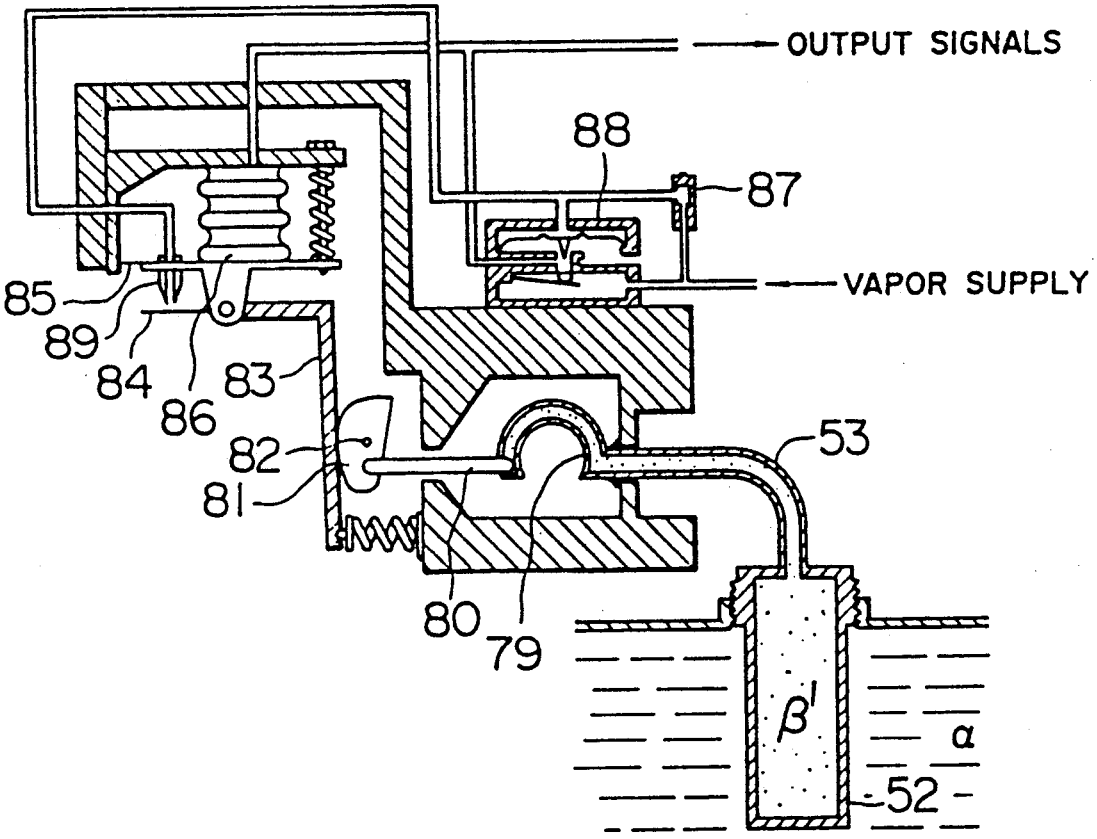

FIG. 7 shows an example of a configuration where the detector portions of the available N.P.S.H. measurement apparatus $19_{-1}$ to $19_{-n}$ are combined with the temperature detector portion 75 and the temperature/saturation pressure conversion portion 76 using a cam for the temperature/saturation pressure conversion of the process liquid so that the output signals equivalent to the saturation vapor pressure of the process liquid are output as electrical signals from a so-called pneumatic measuring apparatus.

In the same Figure, the thermo-sensitive sealing liquid $\beta'$ is sealed inside the valve 52, the capillary tube 53 and the piezo-sensitive Bourdon tube 79. Here, in accordance with the temperature of the process liquid $\alpha$ the thermo-sensitive sealing liquid $\beta'$ swells and the shape of the piezo-sensitive Bourdon tube 79 changes in accordance with the degree of swelling. The amount of this change is transmitted to the cam 81 by a first displacement transmission mechanism 80. The cam 81 rotates around the center of the cam pivot 82 and the shape of this cam 81 is made so as to be the function shown in FIG. 38, that is, so that the signals output with respect to the temperature of the process liquid which is the input, become the saturation vapor pressure with respect to the temperature of that process liquid. The movement of this is transmitted to the flapper 84 by a second displacement transmission mechanism 83. Then, a so-called transmitting mechanism of the displacement equilibrium type and which is configured from a nozzle 89, a plate spring 85, a feedback bellows 86, a restrictor mechanism 87 and a control lever 88 and the like, is used to obtain output signals in accordance with the amount of displacement of this flapper 84.

In this manner, it is possible to use electrical signals to obtain output signals that are equivalent to the saturation vapor pressure of the process liquid.

The use of an available N.P.S.H. measurement apparatus such as this can measure the value of the saturation vapor pressure of a process liquid of the value of the temperature of a process liquid using the value for the pressure of that process liquid and so it is not necessary to seal the process liquid $\alpha$ in the valve 52. Accordingly, the thermo-sensitive sealing liquid $\beta'$ can be some type of generally used liquid that expands and which is used for temperature measurement, such as mercury, a sealing liquid such as kerosene oil or the like, or a sealing substance of either the vapor pressure type or the gas pressure type.

When a swelling liquid is used as the sealing liquid, it is possible to use the same sealing liquid to fill inside the valve 52, the capillary tube 53 and the piezo-sensitive Bourdon tube 79 and there is no necessity to separate the sealing liquid from the low-pressure side capillary tube 67 and the low pressure side sealing diaphragm 72 inside the valve shown in FIG. 2, to result in an extremely simple and effective structure.

The available N.P.S.H. measuring apparatus shown in FIG. 7 is one example of a measurement apparatus of the pneumatic type that output electrical signals, but each of the mechanisms shown in the Figure can be realized by a measuring apparatus of the electrical type. In addition, when there is realization by an electrical type, it is possible to use a thermocouple or a temperature resistor or the like on the side of temperature measurement of the process liquid.

Figure 8:
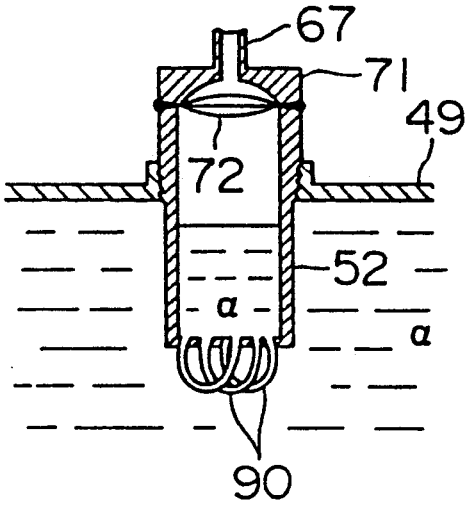
FIG. 8, FIG. 9*a* and FIG. 9*b* are views of modifications of a valve of a required N.P.S.H. input portion for a pump.
Figure 9A:
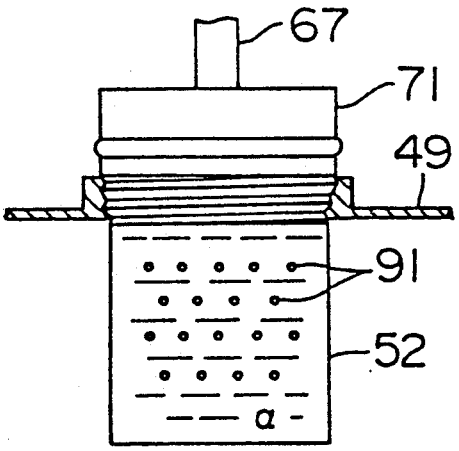
Figure 9B:
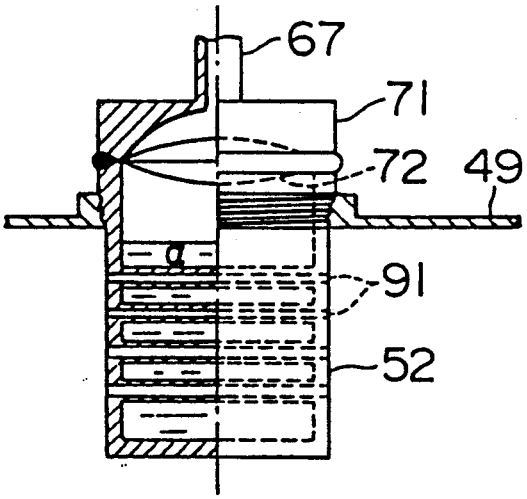

FIG. 8 and FIG. 9 show modifications of the valve 52 used in the available N.P.S.H. measurement apparatus and so the temperature of the process liquid $\alpha$ inside the process piping 49 can be transmitted to the process liquid $\alpha$, inside the valve 52 accurately and in an extremely short time.

More specifically, FIG. 8 shows when a heat exchange capillary type 90 has been mounted to the bottom surface of the valve 52. Moreover, such a heat exchange capillary type 90 can also be mounted to the side surface of the valve 52.

FIG. 9 shows when a heat exchange capillary type 92 pierces the inner portion of the valve 52 from one side surface through another side surface and so the process liquid $\alpha$ that flows in the process piping 49 flows in-side the capillary tube for heat exchange 91 transmits the heat to the process liquid $\alpha$ inside the valve 52 via the wall surface of the capillary tube for heat exchange 91.

Moreover, the heat exchange capillary type 90 or the heat exchange capillary type 91 can have their wall thicknesses made smaller so that the outer diameter is sufficiently small when compared to the valve 52 and so the thermal transmission ratio is extremely good when compared to the wall surface of the valve and so that possible for the temperature of the process liquid $\alpha$ inside the process piping 49 to be transmitted accurately and in a very short time to the process liquid $\alpha$ inside the valve 52. Accordingly, there is the effect that it is possible to accurately detect the saturation vapor pressure of the process liquid.

In the embodiment described above, after the delivery sides of the plural number of pumps $2_{-1}$ to $2_{-n}$ have been combined, one example is shown for the case where there is one flow rate meter 5, a flow rate adjustment portion 15 and a flow rate adjuster valve 4 but it is possible to perform control of the degree of opening of a flow rate adjuster valve provided for each delivery line of each pump $2_{-1}$ to $2_{-n}$ or to perform variable speed control of each of the pump drive apparatus, and perform speed control for each of the pumps $2_{-1}$ to $2_{-n}$. In this case, there is control so that $$\text{available N.P.S.H.} > \text{required N.P.S.H.}$$

for each pump so that it is possible to prevent the occurrence of trouble due to cavitation while at the same time performing fine control for each pump $2_{-1}$ to $2_{-n}$ so that the total delivery flow rate from the pumps is made the required flow rate control value from the plant.

Figure 10:
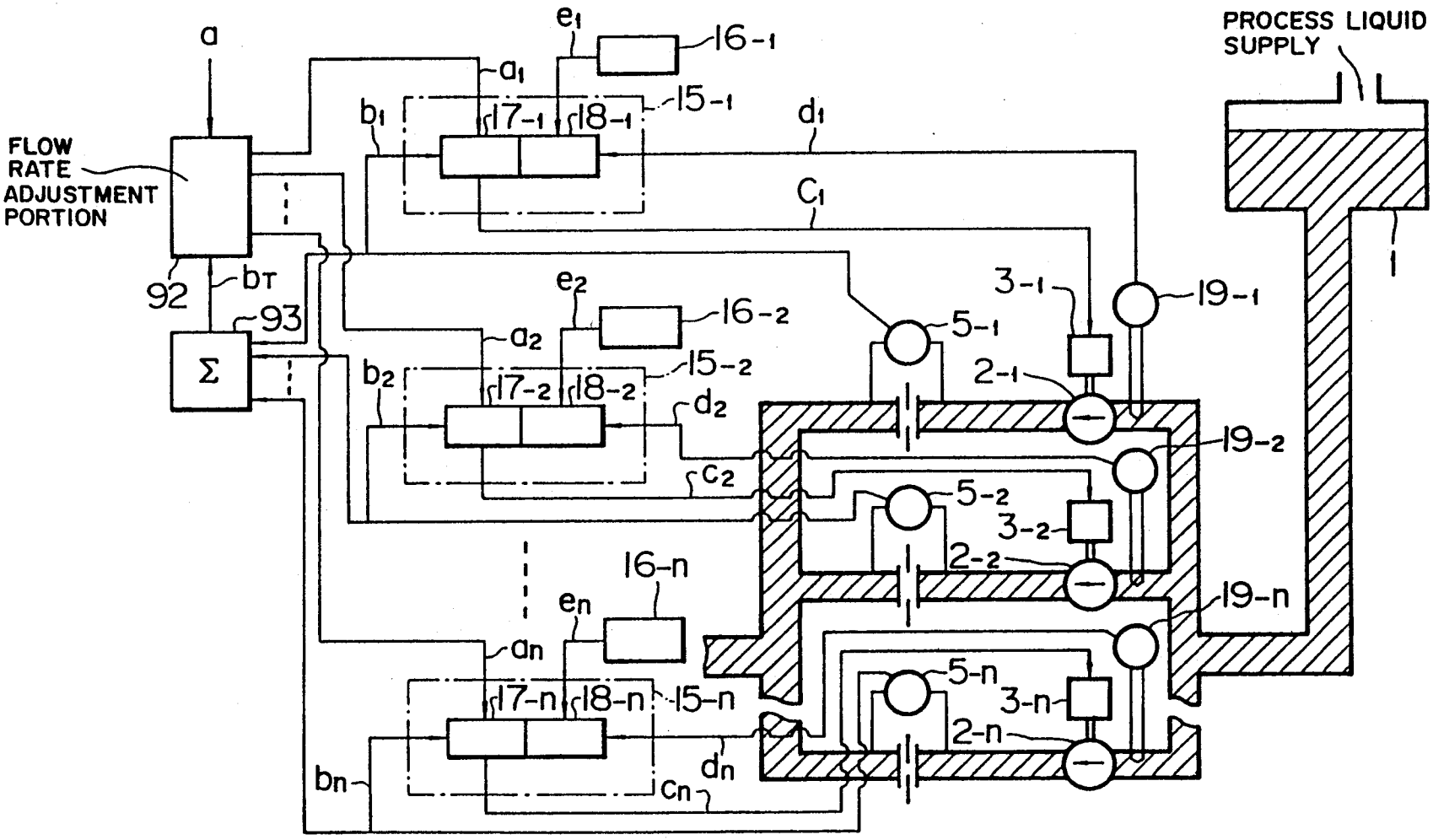
FIG. 10 through FIG. 12 are system diagrams showing other embodiments.

FIG. 10 shows one example of performing control for a plural number of pumps.

Flow rate adjustment portions 15$_{-1}$ to 15$_{-n}$ are provided for each of the pumps 2$_{-1}$ to 2$_{-n}$ and each of the flow rate adjustment portions 15$_{-1}$ to 15$_{-n}$ are configured from first calculation portions 17$_{-1}$ to 17$_{-n}$ and second calculation portions 18$_{-1}$ to 18$_{-n}$. Then, to the second calculation portions 18$_{-1}$ to 18$_{-n}$ are input the measurement results $d_{-1}$ to $d_{-n}$ from the available N.P.S.H. measurement apparatus 19$_{-1}$ to 19$_{-n}$ of the pumps 2$_{-1}$ to 2$_{-n}$.

In addition, the function curve h=f (k) (see FIG. 3) relating to the required N.P.S.H. calculated from prior check against the structural design for each of the pumps 2$_{-1}$ to 2$_{-n}$ and the original operation conditions, is input from the required N.P.S.H. input portion 16$_{-1}$ to 16$_{-n}$ for each of the pumps 2$_{-1}$ to 2$_{-n}$. On the other hand, to the first calculation portions 17$_{-1}$ to 17$_{-n}$ are input the measurement results $b_1$ to $b_n$ from the flow meters 5$_{-1}$ to 5$_{-n}$ provided to each of the pumps 2$_{-1}$ to 2$_{-n}$ and the total required flow rate set values $a_1$ to $a_n$ to the flow rate adjustment portions 15$_{-1}$ to 15$_{-n}$.

Then, the speed control signals $c_1$ to $c_n$ to each pumps 2$_{-1}$ to 2$_{-n}$ are output from the flow rate adjustment portions 15$_{-1}$ to 15$_{-n}$ as the flow rate control calculation results. In addition, the measurement results $b_1$ to $b_n$ from the flow meters 5$_{-1}$ to 5$_{-n}$ described above are also input to the adder 93 and those addition results are input to the total flow rate adjustment portion 92 as the total available flow rate value $b_T$ for the available flow rate delivered from each of the pumps 2$_{-1}$ to 2$_{-n}$. The required flow rate set value "a" from the plant is input to the total flow rate adjustment portion 92 and calculation performed for the flow rate control there, and in consideration of the maximum allowable flow rate ratio for each of the pumps 2$_{-1}$ to 2$_{-n}$, the required flow rate set values $a_1$ to $a_n$ to each of the flow rate adjustment portions is output to the first calculation portions 17$_{-1}$ to 17$_{-n}$ as the result of performing the calculation of the required flow rate set value with respect to each of the pumps 2$_{-1}$ to 2$_{-n}$.

The following is a description of this operation.

Details of the operation of the flow rate adjustment portions 15$_{-1}$ to 15$_{-n}$ provided to each of the pumps 2$_{-1}$ to 2$_{-n}$ are the same as for the example shown in FIG. 3. However, in this case, the number of currently operating pumps u in FIG. 3 is calculated as one. Through this operation, flow rate control is performed so that each of the pumps 2$_{-1}$ to 2$_{-n}$ is normally controlled to a value equal to the required flow rate set value $a_1$ to $a_n$ to each of the flow rate adjustment portions.

However, in cases where it appears that trouble due to cavitation or the like will occur for any of the pumps 2$_{-1}$ to 2$_{-n}$, there is control so that available N.P.S.H. for each pump > required N.P.S.H. for each pump is satisfied for the range where the trouble does not occur, and so that the flow amount is controlled to a value in the vicinity of the required flow rate set value to the flow rate adjustment portions 15$_{-1}$ to 15$_{-n}$ for as far as is possible. The measurement results $b_1$ to $b_n$ from the flow meters 5$_{-1}$ to 5$_{-n}$ in a status such as this are input to the adder 93 and that total flow rate value $b_T$ is input to the total flow rate adjustment portion 92. Then, should the total flow rate value $b_T$ be smaller than the required flow rate set value "a" from the plant, the total flow rate adjustment portion 92 calculates the flow rate control signal so that results of the flow rate control calculation increase the available flow rate value b to the set value "a" because of the available flow rate value b is smaller than the required flow rate set value "a".

However, when the maximum allowable flow rate performance is different for each of the pumps 2$_{-1}$ to 2$_{-n}$, such as when there is a performance ratio as shown in FIG. 39, and when pump 2$_{-2}$ is already in the status that available N.P.S.H. ≈ required N.P.S.H., then a flow rate restriction operates and as a result, the total flow rate value $b_T$ is 200T/H short with respect to the a=2800T/H for the required flow rate set value from the plant, and when x pumps of the 2$_{-1}$ to 2$_{-n}$ of the n number of pumps are operating, then the calculation results for the increase portion with respect to the required flow rate set values $a_1$ to $a_x$ sent to each of the flow rate adjustment portions from the total flow rate adjustment portion 92 is as shown in FIG. 39.

In this manner, the results calculated for the flow rate control in the total flow rate adjustment portion 92 are output as the required flow rate set values $a_1$ to $a_n$ to each of the flow rate adjustment portions 15$_{-1}$ to 15$_{-n}$. Then, each of the flow rate adjustment portions 15$_{-1}$ to 15$_{-n}$ operates in the same manner as has already been described so that speed control of each of the pumps 2$_{-1}$ to 2$_{-n}$ is performed and as a result, the total flow rate value $b_T$ has fine flow rate control performed so that it is in agreement with the required flow rate set value "a" from the plant.

According to this embodiment, the required flow rate set values $a_1$ to $a_n$ to each of the flow rate adjustment portions 15$_{-1}$ to 15$_{-n}$, that is the speed control with respect to each of the pumps 2$_{-1}$ to 2$_{-n}$, performs flow rate control that is suitable for the maximum allowable flow rate performance ratio of each of the pumps 2$_{-1}$ to 2$_{-n}$, and should available N.P.S.H. < required N.P.S.H.

be established for any of the pumps, and it appear that cavitation and associated trouble may occur, then the flow rate value for that pump is limited so that such trouble does not occur, and the total flow rate is made to agree with the required flow rate value from the plant and is therefore extremely effective.

Moreover, in the embodiment described above, the description was given for where the required flow rate set value "a" to each of the flow rate adjustment portions 15$_{-1}$ to 15$_{-n}$ from the plant is output so as to be suitable for the maximum allowable flow rate performance for each of the pumps 2$_{-1}$ to 2$_{-n}$ but this need not necessarily be done as for example, the $a_1=a_2=a_3=\ldots=a_n=a_o=k$ (constant value), that is, the required flow rate set value "a" to each of the flow rate adjustment portions 15$_{-1}$ to 15$_{-n}$ can be the same value $a_0$. In this case, for example, when the total flow rate value $b_T$ is smaller than the required flow rate set value "a" from the plant, the required flow rate set value $a_0$ is output so as to increase the flow amount to each of flow rate adjustment portions 15$_{-1}$ to 15$_{-n}$. Here, the flow rate control calculations for each of the flow rate adjustment portions 15$_{-1}$ to 15$_{-n}$ performs pump speed control so as to increase the flow rate of each of the pumps 2$_{-1}$ to 2$_{-n}$. Here, when the condition for each of the pumps, available N.P.S.H. < required N.P.S.H.

is not established for each of the pumps, delivery flow rate control for those pumps, that is, speed control, is performed so that there is the maximum flow rate so that the previously described trouble such as that due to cavitation does not occur. In addition, the maximum allowable flow rate of the pump becomes that of the original pump where available N.P.S.H. ≦ required N.P.S.H.

and is a value that is calculated from the delivery flow rate for which trouble such as that due to cavitation may occur, and so when it reaches the maximum allowable flow rate of that pump, then even if for example an $a_0$ that is greater than this value is input, the delivery flow rate, that is, the speed is restricted to this.

Then, the delivery available flow rate of each of the pumps $2_{-1}$ to $2_{-n}$ in this status is measured by the flow meters $5_{-1}$ to $5_{-n}$ and in the same manner as has been described above, the total flow rate value $b_T$ is calculated from the measurement results $b_1$ to $b_n$ and when this is smaller than the required flow rate set value "a" from the plant, the required flow rate set value $a_0$ is output to each of the flow rate adjustment portions $15_{-1}$ to $15_{-n}$ so as to increase the flow rate even further, and the delivery flow rate of pumps that have a surplus for increase of the delivery flow rate have their speed increased.

This flow rate control continues until total flow rate $b_T$ = required flow rate set value "a" from the plant.

Also, in the embodiment shown in FIG. 10, flow rate adjuster valves are respectively provided downstream or upstream of each of the flow rate adjustment portions $15_{-1}$ to $15_{-n}$ and produce the same effect even if the degrees of opening are controlled by $c_1$ to $c_n$.

In each of the embodiments described above, there are also instances where the pumps $2_{-1}$ to $2_{-n}$ that send the process liquid are a plural number provided in series so as to make the process liquid sent to the plant a high pressure.

Figure 11:
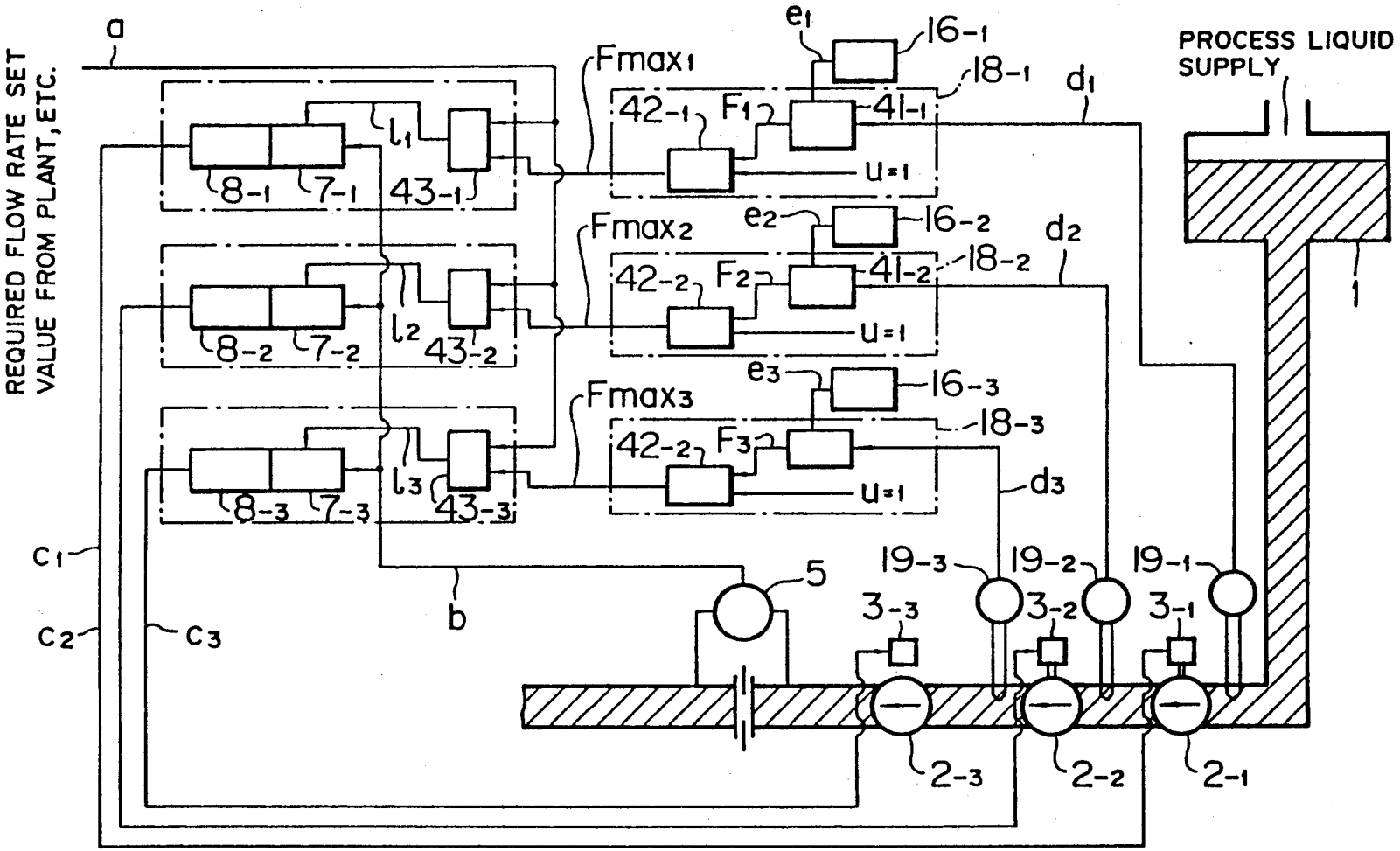

An example of such a delivery flow rate control apparatus for pumps in such a case will be described with reference to FIG. 11.

In the present embodiment, in a system where the process liquid is temporarily stored in the tank 1 is sent while successively making the delivery pressures into high pressures by passing it through the pumps $2_{-1}$, $2_{-2}$, $2_{-3}$ that are provided in series, and where the measurement results $d_1$, $d_2$, $d_3$ by the available N.P.S.H. measurement apparatus $19_{-1}$, $19_{-2}$, $19_{-3}$ provided on the suction side of each of the pumps $2_{-1}$, $2_{-2}$, $2_{-3}$ in a process piping system that sends the process liquid to the plant via a flow rate meter 5 and a flow rate adjuster valve 4, are input to the second calculation portions $18_{-1}$, $18_{-2}$, $18_{-3}$. On the other hand, to the required N.P.S.H. input portions $16_{-1}$, $16_{-2}$, 16 that are exactly the same as the required N.P.S.H. input portion 16 shown in FIG. 3, is input beforehand the function curve h f (k) that relates to the required N.P.S.H. value of each of the pumps $2_{-1}$, $2_{-2}$, $2_{-3}$.

Then, in the second calculation portions $18_{-1}$, $18_{-2}$, $18_{-3}$, there are provided the allowable flow rate calculation portions $41_{-1}$, $41_{-2}$' $41_{-3}$ that have exactly the same configuration as the allowable flow rate calculation portion 41 shown in FIG. 3, and multiplier portions $42_{-1}$, $42_{-2}$, $42_{-3}$ that have exactly the same configuration as the multiplier portion 42 shown in FIG. 3 (but where each of the pumps $2_{-1}$, $2_{-2}$, $2_{-3}$, are provided in series and so u = 1), and the action of these calculates the maximum allowable flow rate for each pump (which in this case is $F_i$ = Fmax). Then, the calculation results $Fmax_1$, $Fmax_2$, $Fmax_3$ and the required flow rate set value "a" from the plant are respectively input to low-value priority portions $43_1$, $43_2$, $43_3$ that have exactly the same configuration as the low-value priority portion 43 shown in FIG. 3, and the low-priority portion output signals $1_1$, $1_2$, $1_3$ are obtained from each of the low-value priority portions $43_1$, $42_2$, $43_3$ and these low-priority portion output signals $1_1$, $1_2$, $1_3$ are input to each of the flow rate deviation calculation portions $7_1$, $7_2$, $7_3$ that have exactly the same configuration as the flow rate deviation calculation portion 7 shown in FIG. 3.

On the other hand, the available flow rate value b to the plant and which is the result of measurement of the flow rate meter 5 is also input to each of the flow rate deviation calculation portions $7_1$, $7_2$, $7_3$ and this result is input to PID calculation portions $8_1$, $8_2$, $8_3$ that have exactly the same configuration as the PID calculation portion 8 shown in FIG. 3, and the control signals $c_1$, $c_2$, $c_3$ that is the result of the PID calculation, are output. Then, each of these control signals $c_1$, $c_2$, $c_3$ controls the speed of each of the pump drive apparatus $3_{-1}$, $3_{-2}$, $3_{-3}$ and the delivery flow rate of each of the pumps $2_{-1}$, $2_{-2}$, $2_{-3}$ is controlled.

If this is done, then for as long as the relationship available N.P.S.H. > required N.P.S.H.

is established for each of the pumps $2_{-1}$, $2_{-2}$, $2_{-3}$, the speed of each of the pumps $2_{-1}$, $2_{-2}$, $2_{-3}$ is controlled so that the delivery flow rate of the pumps $2_{-1}$, $2_{-2}$, $2_{-3}$ is in agreement with the required flow rate set value "a" from the plant but should the relationship available N.P.S.H. > required N.P.S.H.

not be established for any of the pumps, then the delivery flow rate of the pump is restricted, but that value is a value that establishes this relationship and the delivery flow rate of the pumps $2_{-1}$, $2_{-2}$, $2_{-3}$ is controlled to a value which is as close as is possible to the required flow rate set value "a" from the plant. Accordingly, even in the case of a process piping system where the pumps $2_{-1}$, $2_{-2}$, $2_{-3}$ are provided in series, there is a control so that the relationship available N.P.S.H. > required N.P.S.H.

is always satisfied while the delivery flow rate of the pumps $2_{-1}$, $2_{-2}$, $2_{-3}$ is controlled to be in agreement with the required flow rate set value from the plant, or if this is not possible, to a value as close to this as possible, so that it is possible to prevent the occurrence of trouble due to cavitation.

Moreover, in the present embodiment, the description was given in terms of the method where there is control of the speed of the pump in order to perform delivery flow rate control of the pump but the same effect can be obtained by providing a flow rate adjuster valve to the delivery side of each pump and degree of opening control performed for this.

In this embodiment, the description was given for one example of flow rate control for a pump but the present embodiment can also be applied to the case where there is control of the liquid level of a tank.

Figure 12:
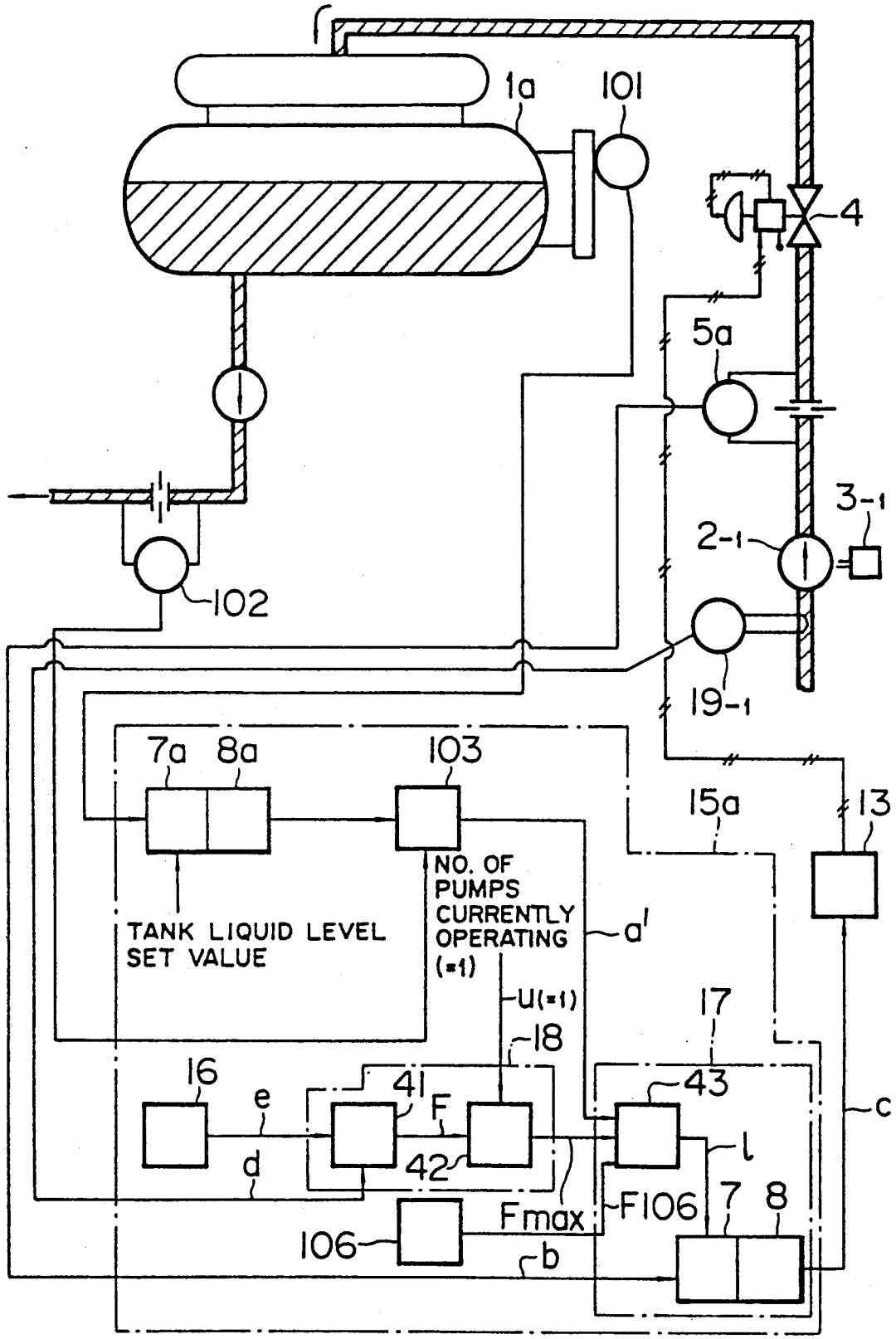

FIG. 12 shows one example of this, and the process liquid is supplied to the tank 1a for temporary storage of the process liquid, after passing through the flow rate meter 5a and the flow rate adjuster valve 4 by the pump $2_{-1}$. On the other hand, the process liquid that is stored in the tank 1a flows from the tank 1a via the delivery flow rate meter 102.

Moreover, the process liquid is heated in the tank 1a and may flow as vapor, but in this embodiment, it flows out as a process liquid.

Then, in a process such as this, when there is control of the degree of opening of the flow rate adjuster valve 4 while there is control of the liquid level of the tank 1a, the flow rate signals from the flow rate meter 5a to the tank 1a and the delivery flow rate meter 102 from the tank 1a are also used as control parameters in addition to the liquid level signals from the liquid level meter 101 of the tank 1a, so that there is so-called three-element control but should the relationship available N.P.S.H. < required N.P.S.H.

not appear likely to be established when there is control of the liquid level of this tank 1a, it is possible to prevent this state from occurring.

The following is a description of this, with reference to the same Figure.

The pump $2_{-1}$ sends the process liquid to the tank 1a where it is temporarily stored. Then, the process liquid passes through the flow rate meter 5a and the flow rate adjuster valve 4 to the tank 1a and flows into the tank 1a. On the other hand, the process liquid that is already temporarily stored in the tank 1a is sent by the pump to pass through the delivery flow rate meter 102 from the tank 1a and be sent to the process.

In such a process piping system, the N.P.S.H. value d for the pump $2_{-1}$ is measured by the available N.P.S.H. measurement apparatus $19_{-1}$ and is input to the allowable flow rate calculation portion 41 of the second calculation portion 18 of the liquid level adjustment portion 15a that adjusts the process liquid level. In addition, the liquid level of the tank 1a in which the process liquid is temporarily stored is measured by the liquid level meter 101 and the liquid level is input to the liquid level deviation calculation portion 7a of the liquid level adjustment portion 15a and the deviation with the liquid level set value of the tank 1a is calculated, and input to the PID calculation portion for liquid level 8a and the PID calculation results are output.

Then, the calculation results of this PID calculation portion for liquid level 8a and the measurement results by the delivery flow rate meter 102 from the tank 1a are added at the adder 103, and that result is output to the low-value priority portion 43 as the required flow rate set value a' from the plant, with respect to the first calculation portion 17. In addition, to the required N.P.S.H. input portion 16 is input beforehand data for the required N.P.S.H. relating to the pump $2_{-1}$, that is, the function curve h=f (k) for the "delivery flow rate (or suction flow rate)" and the "required N.P.S.H. value" for that pump.

The data that becomes the required N.P.S.H. value e and that is input to the required N.P.S.H. input portion 6, and the available N.P.S.H. d for the pump $2_{-1}$ and that has been described beforehand, are input to the allowable flow rate calculation portion 41 and the same action as that described beforehand with reference to FIG. 3 calculates the allowable maximum flow rate value F for one pump. Then, since the number of pumps that is currently operating is one, u=1 and the total allowable maximum flow rate value Fmax (=F) for the currently operating pumps is output to the low-value priority portion 43. On the other hand, the flow rate limit signal F106 is output to the low-value priority portion 3 from the flow limit portion 106.

Then, in the flow rate adjuster valve 4, the previously described required flow rate set value a' and the smaller of the allowable maximum flow rate value F flow rate limit signal $F_{106}$ is output as the low-priority portion output signal 1. Then, this output signal 1 is used as the set value (objective value) for the flow rate control with respect to the flow rate deviation calculation portion 7. On the other hand, the available flow rate value (objective value) b due to the flow rate meter 5a to the tank la is also input to the flow rate deviation calculation portion 7 where the set value (objective value) for flow rate control, that is, the deviation between the low-priority portion output signal 1 and the available flow rate value b to tank 1a is calculated. Then, this result is input to the PID calculation portion 8a where the control signal c which is the result of PID calculation is output to the electro-pneumatic converter 13 and converted into pneumatic signals, and input to the flow rate adjuster valve 4. By this, a degree of opening control for the flow rate adjuster valve 4 is performed.

Here, if the flow rate limit signal $F_{106}$ of the flow limit portion 106 is set beforehand to a value that is sufficiently larger than the maximum allowable flow rate of the pump $2_{-1}$, then what is actually compared in the low-value priority portion 43 are the required flow rate set value a' that is equivalent to the required flow rate set value "a" from the plant and which was described with reference to FIG. 3, and the total allowable maximum flow rate value Fmax for the pumps that are operating, and the function becomes the same as that of the embodiment described with reference to FIG. 3, and the same effect is obtained with respect to the pump and the effect of being able to favorably control the liquid level of the tank 1a is obtained.

In addition to the flow limit portion 106 is set beforehand the flow rate limit signal $F_{106}$ there is flow rate control so that at some timing, the fixed or plant load changes according to the internal pressure of the tank that temporarily stores the process liquid.

Figure 13:
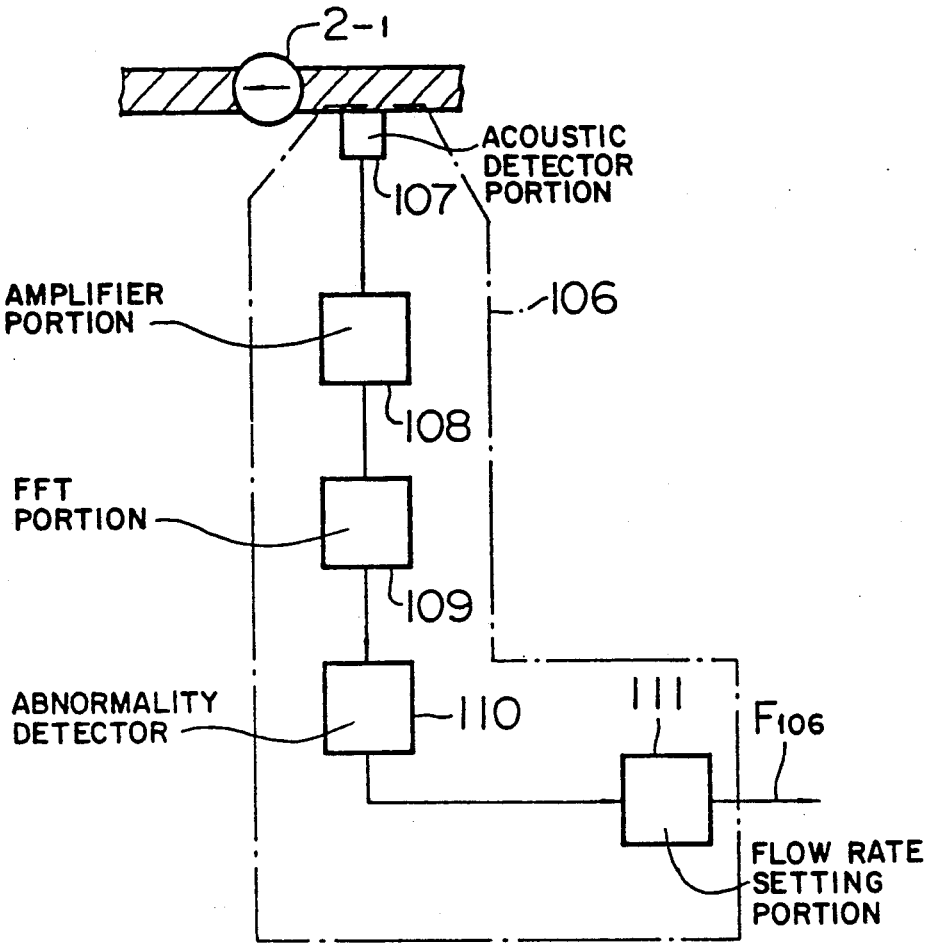
FIG. 13 is an enlarged block diagram of the flow rate control portion of FIG. 12.

The following is a description of this, with reference to FIG. 13.

In this Figure, the portion that is shown as surrounded by a dotted line is equivalent to the flow limit portion 106 of FIG. 12, and the acoustic detector portion 107 is mounted in the vicinity of the pump $2_{-1}$, so that the sound of rotation in the vicinity of the pump $2_{-1}$, and the sound of the process liquid flowing in the pump portion can be monitored. The output signals of this acoustic detector portion 107 are amplified by the amplifier portion 108 and are then input to the FFT portion 109 where frequency analysis of the monitored sounds is performed. The results are input to the abnormality detector 110. Then, at the abnormality detector 110, these frequency analysis results are compared with the frequency analysis results of the sound of a pump $2_{-1}$ which is operating normally and should there be an abnormality in the sound in the vicinity of the pump, then a signal indicating this is sent from the abnormality detector 110 to the abnormality flow rate setting portion 111. Then, as the result of this, the flow rate limiter signal F106 that has been set beforehand is output from the abnormality flow rate setting portion 111.

Figure 14A:
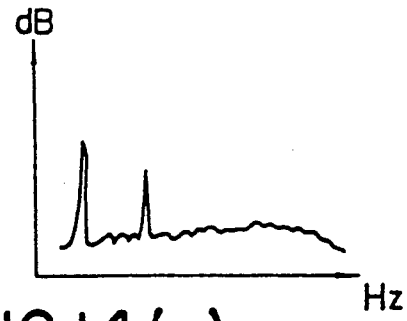
FIGS. 14(*a*) and 14(*b*) are graphs showing one example of frequency analysis of sound in the vicinity of a pump.
Figure 14B:
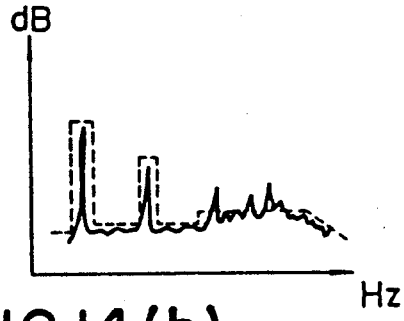

FIG. 14 shows one example of the frequency analysis results due to the FFT portion 109, and (a) of this figure shows one example of the sound in the vicinity of a pump that is in the normal operating status, while (b) of this figure shows one example of the sound in the vicinity of a pump $2_{-1}$ that is in an abnormal operating status and for which cavitation is occurring, and shows the sound in the vicinity of a pump when the degree to which this is occurring is greater than a rated value.

Also, shown by the broken line in (b) of the same Figure is the rated value for the detection of a sound when there is an abnormality, as compared to the sound of normal operation, and is a value predetermined using the sound of the pump in the normal operating status as the origin.

More specifically, when there is the sound when the pump $2_{-1}$ is in the normal operating status, the frequency analysis results of this sound are beneath the broken line, and signals that indicate an abnormality are not output from the abnormality detector 110. However, for example, when cavitation of greater than the rated value is occurring and a sound in the vicinity of the pump is detected to show that pump is in an abnormal running status, the frequency analysis results are above the broken line, and as a result, a signal indicating an abnormality is output from the abnormality detector 110. In such a case, then even if for example, the flow rate deviation calculation portion 7*a* and the PID calculation portion 8*a* perform flow rate control with the set value (objective value) being larger than that of the flow rate limit signal $F_{106}$, then the signal indicating an abnormality is input to the abnormality flow rate setting portion 111 and at the same time, the set value (objective value) is switched to the flow rate limit signal $F_{106}$ and flow rate control continues.

When the flow limit portion 106 shown in FIG. 3 is used, the operation is the same as that shown in FIG. 3, and when it appears that available N.P.S.H. < required N.P.S.H.

there is gradual switching of the set value (objective value) for flow rate control from the required flow rate set value "a" from the plant to the total allowable maximum flow rate value for the pumps that are currently operating so that this status described above does not occur and so the control not only proceeds smoothly, but despite the fact that available N.P.S.H. > required N.P.S.H.

when air or some other liquid or foreign body flows to the suction side of the pump, or when the pressure of the process liquid in the suction side of the pump drops extremely rapidly or when the temperature of the process liquid on the suction side rises extremely fast, there is a temporary detection delay of the available N.P.S.H. measurement apparatus $19_{-1}$ so that as a result there is the generation of an abnormal sound such as cavitation or the like in the pump, then the immediate changing of the set value (objective value) for flow rate control to the flow rate limit signal $F_{106}$ can quickly enable the safe restriction of the flow as far as the pump is concerned and so the control becomes more effective.

In the embodiment described above, the description was based on the processing flow shown in FIG. 5, but it is also possible to be in accordance with the processing flow shown in FIG. 14. In addition, this processing can of course be realized by a computer to achieve the same control.

In the embodiment described above, the description was given for the case when there is delivery flow rate control for a pump and it appears likely that available N.P.S.H. < required N.P.S.H., and for when there was control of the delivery flow rate of the pump so that this situation did not occur but this need not necessarily be performed as the pump delivery flow rate can be performed by a method the same as the conventional method, and on the other hand, process liquid of a low temperature can be inserted to the suction side of the pump so that the available N.P.S.H. of at least that pump becomes greater than the required N.P.S.H. value. More specifically, as has already been described, the pump available net suction head Ha can be expressed by the equation (2)

$$Ha = D/\gamma + ys - Zs - P_v/\gamma \quad (2)$$

and $P_v$, that is, the saturation vapor pressure of the process liquid in the intake portion of the pump, can be made smaller in order to make Ha as large a value as possible.

Reducing the saturation vapor pressure can be achieved by lowering the temperature of the process liquid, as is clear from the graph shown in FIG. 36.

The process liquid is sent by the pump $2_{-1}$ from the tank 1 where it is temporarily stored, so that it passes through the flow rate meter 5 and the flow rate adjuster valve 4 and is sent to the side of the plant. On the other hand, a pump 118 is provided so as to insert low-temperature process liquid in the piping on the suction side of the pump $2_{-1}$ and the low-temperature process liquid that is sent by this pump passes the flow rate adjuster valve 117 and is inserted into the process liquid on the suction side of the pump $2_{-1}$ so that available N.P.S.H. > required N.P.S.H.

and the process liquid on the suction side of the pump $2_{-1}$ is adjusted to a suitable temperature.

In a plant piping system such as this, the available flow rate value b to the plant and that is the result measured by the flow rate meter 5, is input to the flow rate deviation calculation portion 7 of the flow rate adjustment portion 15*b* and the required N.P.S.H. calculation portion 114 of the required N.P.S.H. deviation adjustment portion 113. The required flow rate set value "a" from the plant is also input to the flow rate deviation calculation portion 7 where the deviation between the available flow rate value b and the required flow rate set value "a" is calculated, and these results are input to the PID calculation portion 8 where the results of PID control calculation are input via the electro-pneumatic converter 13 to the flow rate adjuster valve 4 as control signals.

In addition, the available N.P.S.H. value d for the pump $2_{-1}$ and which is the result of measurement by the available N.P.S.H. measurement apparatus 19-1 for the pump $2_{-1}$ is input to the suction head deviation calculation portion 115 of the required N.P.S.H. deviation adjustment portion 113. On the other hand, input beforehand to the required N.P.S.H. calculation portion 114 are the data for the required N.P.S.H. relating to the pump $2_{-1}$, that is, the function curve h=f (k) for the "pump delivery flow rate (or the suction flow rate)" and the "required N.P.S.H. value."

Then, the available flow rate value b to the plant is input to the required N.P.S.H. calculation portion 114 as has been described, and this available value b agrees with the delivery flow rate of the pump $2_{-1}$ and so this flow rate and the function described above are used to calculate the required N.P.S.H. value h=f (k) for the pump $2_{-1}$. Then, as the result, f (b)+H (where H is a small positive number representing the surplus value, and on occasion H=0) is input to the suction head deviation calculation portion 115 as the set value (objective value) for the required N.P.S.H. deviation adjustment portion 113. Then, in the suction head deviation calculation portion 115, the deviation between the set value (=f (b)+H) and the available N.P.S.H. value d that is the actually measured value described above is calculated, and this is input to the suction head PID calculation portion 116 and PID calculation is performed and the results of this are input as control signals from via the required N.P.S.H. deviation adjustment portion 113 and via the electro-pneumatic converter 13 to the flow rate adjuster valve 117 for the low temperature process liquid and degree of opening control for the flow rate adjuster valve 117 is performed.

The following is a description of this operation.

Delivery flow rate control of the pump $2_{-1}$ is realized by performing degree of opening control for the flow rate adjuster valve 4 by the flow rate adjustment portion 15*b*. On the other hand, the required N.P.S.H. calculation portion 114 uses the intermittent values for the delivery flow rate of the pump $2_{-1}$ to calculate the required N.P.S.H. (=f (b)+H) and when it appears that the operation of the required N.P.S.H. deviation adjustment portion 113 will cause available N.P.S.H. of pump $2_{-1}$<(f (b)+H)

then degree of opening control of the flow rate adjuster valve 117 for the low temperature process liquid is performed so that at least the relationship available N.P.S.H. of pump $2_{-1}$<(f (b)+H)

is not established. Moreover, if available N.P.S.H. of pump $2_{-1}$>(f (b)+H)

then the flow rate adjuster valve 117 for the low-temperature process liquid is closed.

Figure 16:
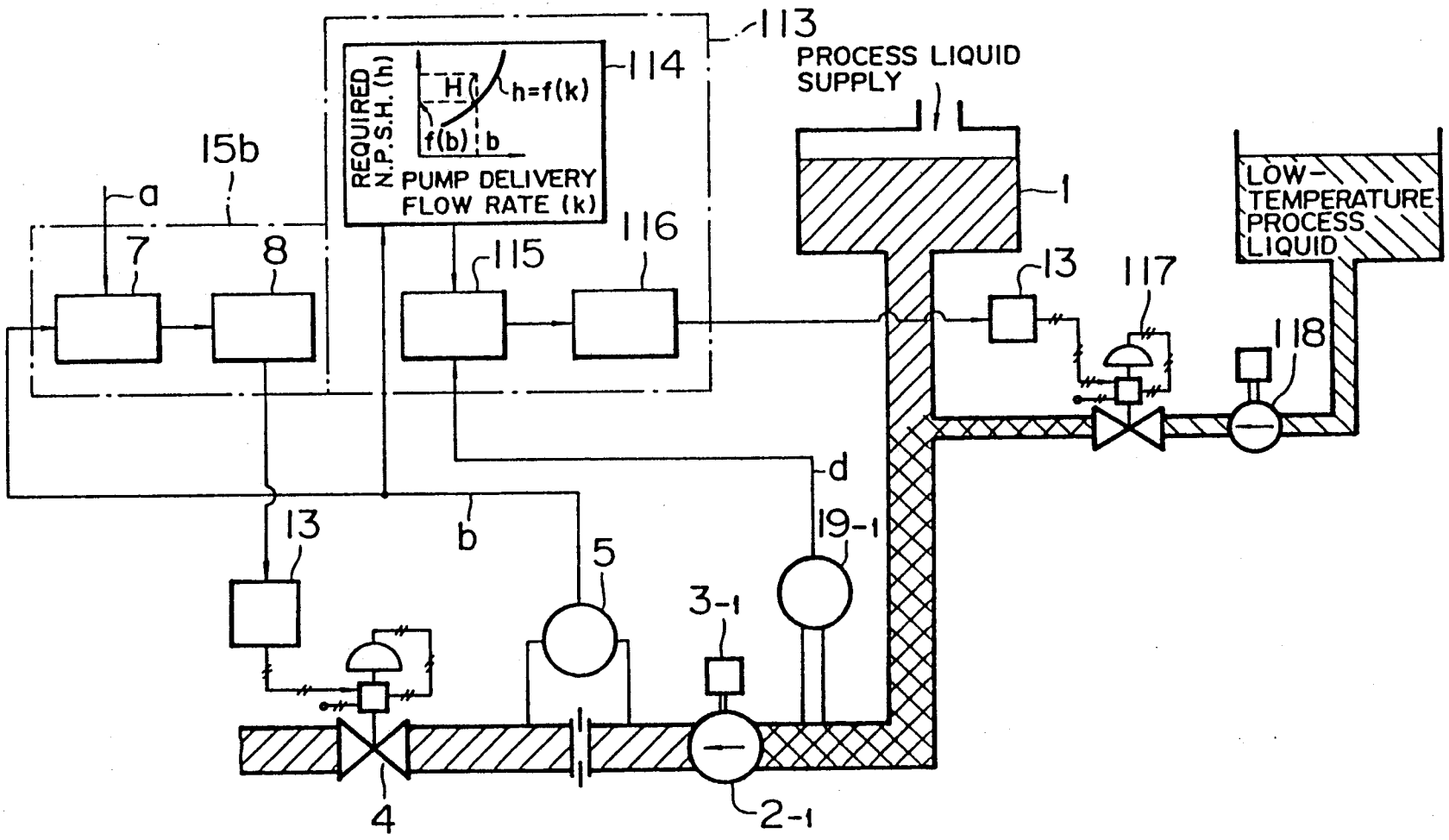
FIG. 16 through FIG. 21 is a system diagram showing another embodiment.

Using the embodiment shown in FIG. 16, flow control can be performed so that the delivery flow rate of the pump is made to agree with the required flow rate set value from the plant while at the same time establishing available N.P.S.H.>required N.P.S.H.

and there is not only the effect described above, but in process piping systems such as that shown in FIG. 16 where there is only one pump $2_{-1}$, then should the relationship available N.P.S.H.<required N.P.S.H.

appear likely to be established, there is the greater effect of restricting the degree of opening of the flow rate adjuster valve 4 so as to prevent the establishment of this relationship and of restricting the available flow rate value b to the plant to lower than the required flow rate set value from the plant.

In the embodiment shown in FIG. 16, where it appears likely that available N.P.S.H.<required N.P.S.H., process liquid of low temperature is inserted into the suction side of the pump but instead of this, the supply of high-temperature vapor of the process liquid inside the tank 1 that temporarily stores the process liquid causes the pressure D applied to the liquid surface of the process liquid on the suction side of the pump of $$Ha=D/\gamma+ys-Zs-Pu/\gamma \quad (2)$$

to rise so that exactly the same effect is obtained even if available N.P.S.H.>required N.P.S.H.

is established.

Figure 17:
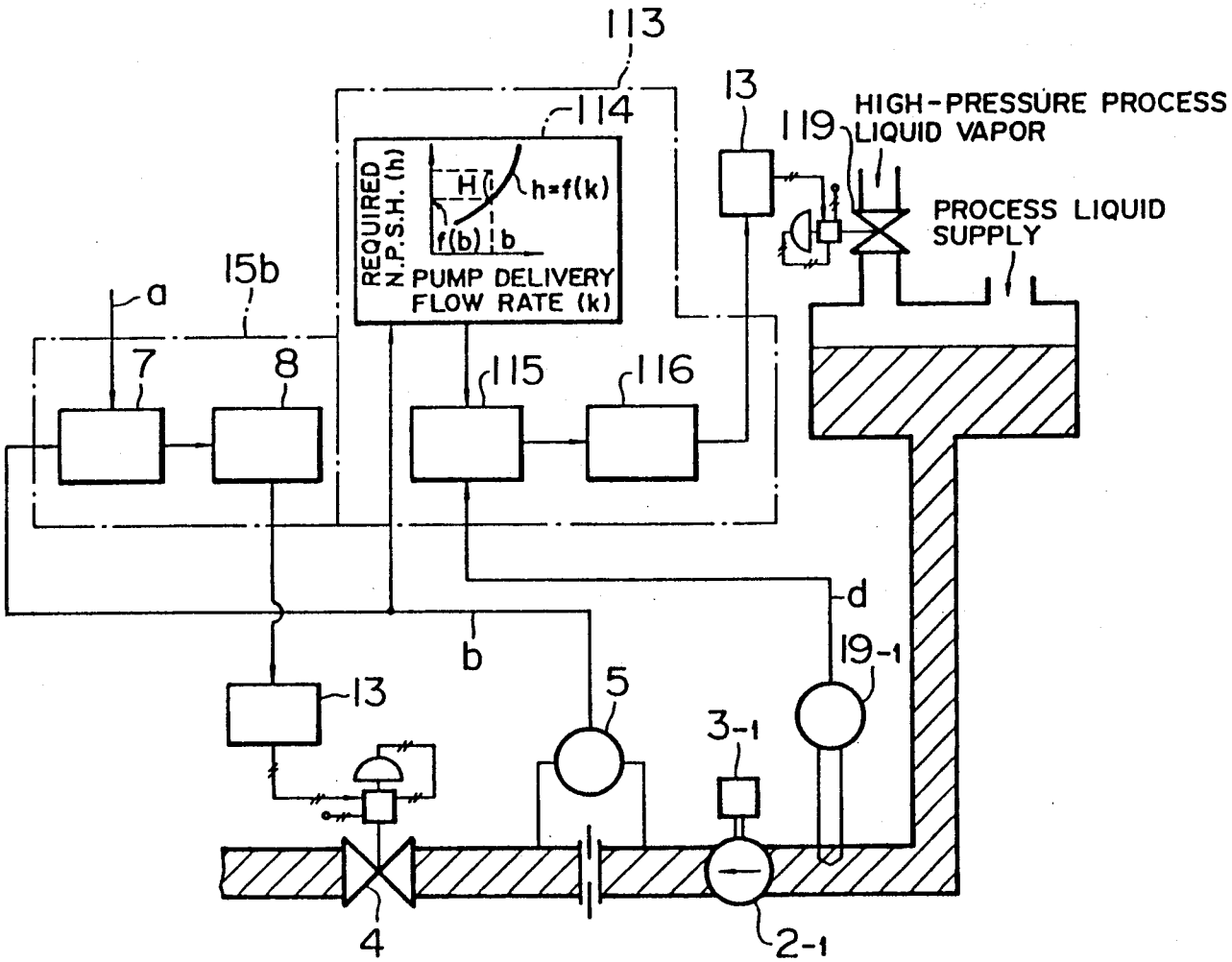

FIG. 17 shows one example of this, and the following is a description of only the portion of this that differs from FIG. 16.

More specifically, when available N.P.S.H. of pump $2_{-1}$>(f (b)+H)

the high-pressure vapor supply valve 119 for the process liquid is closed but should available N.P.S.H. of pump $2_{-1}$<(f (b)+H)

the action of the required N.P.S.H. adjustment portion 113 performs a degree of opening control for the high-pressure vapor supply valve 119 and controls the supply of high pressure vapor of the process liquid so that the relationship available N.P.S.H. of pump $2_{-1}$<(f (b)+H)

is not established.

The delivery flow rate of the pump and the value for the required N.P.S.H. have the relationship as shown in FIG. 4.

More specifically, when the delivery flow rate of the pump reduces, the required N.P.S.H. improves to become small and the pumps to send the process liquid are disposed in a plural number and in parallel and a certain number of them are operating and in a process piping system where another pump is made the standby status, the use of the above relationship means that the relationship available N.P.S.H.>required N.P.S.H.

is established while it is possible to have control of the pump delivery flow rate amount.

Figure 18:
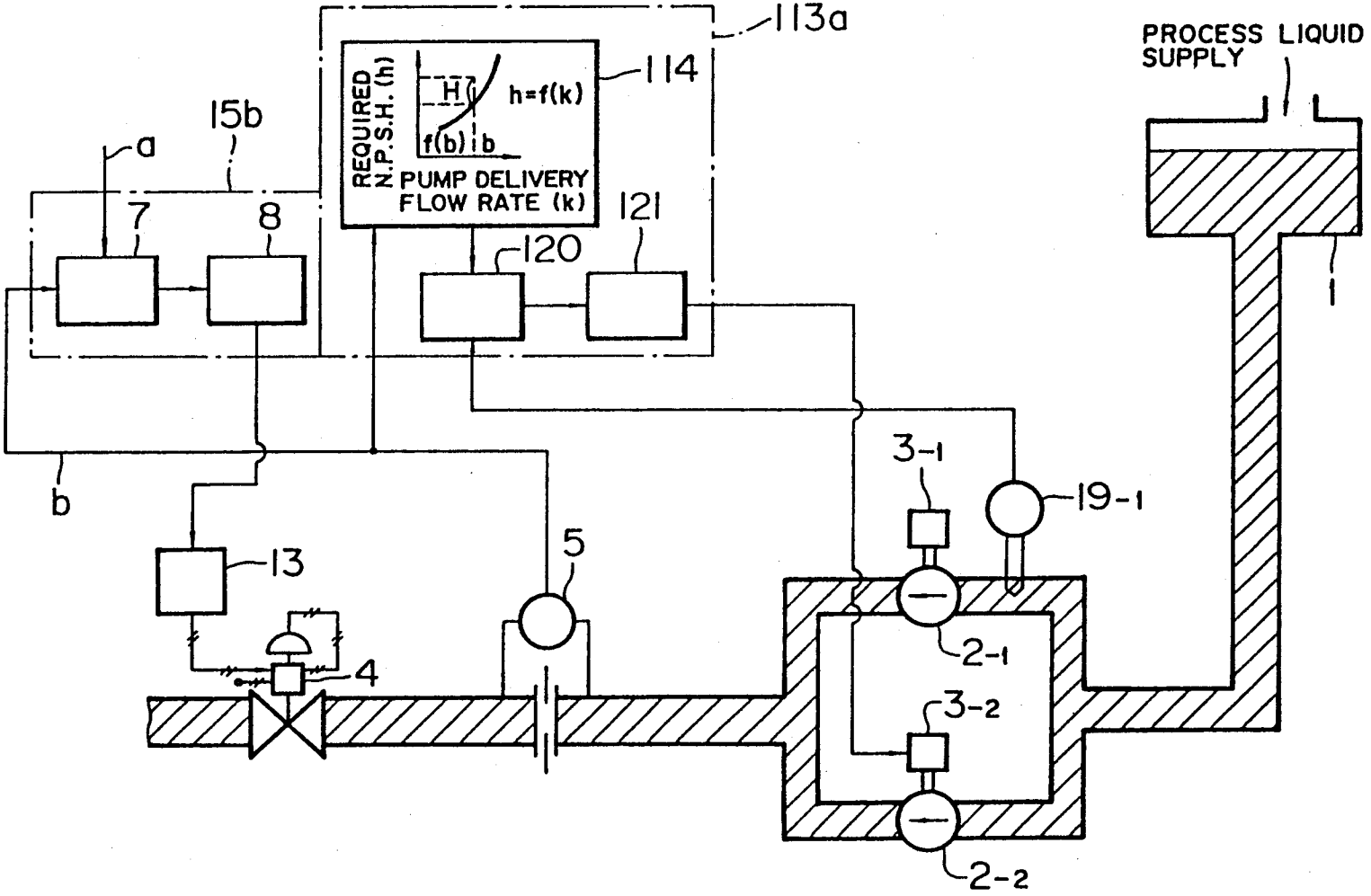

The following is a description of the process piping system where the two pumps $2_{-1}$ and $2_{-2}$ are disposed in parallel, with reference to FIG. 18.

Figure 15:
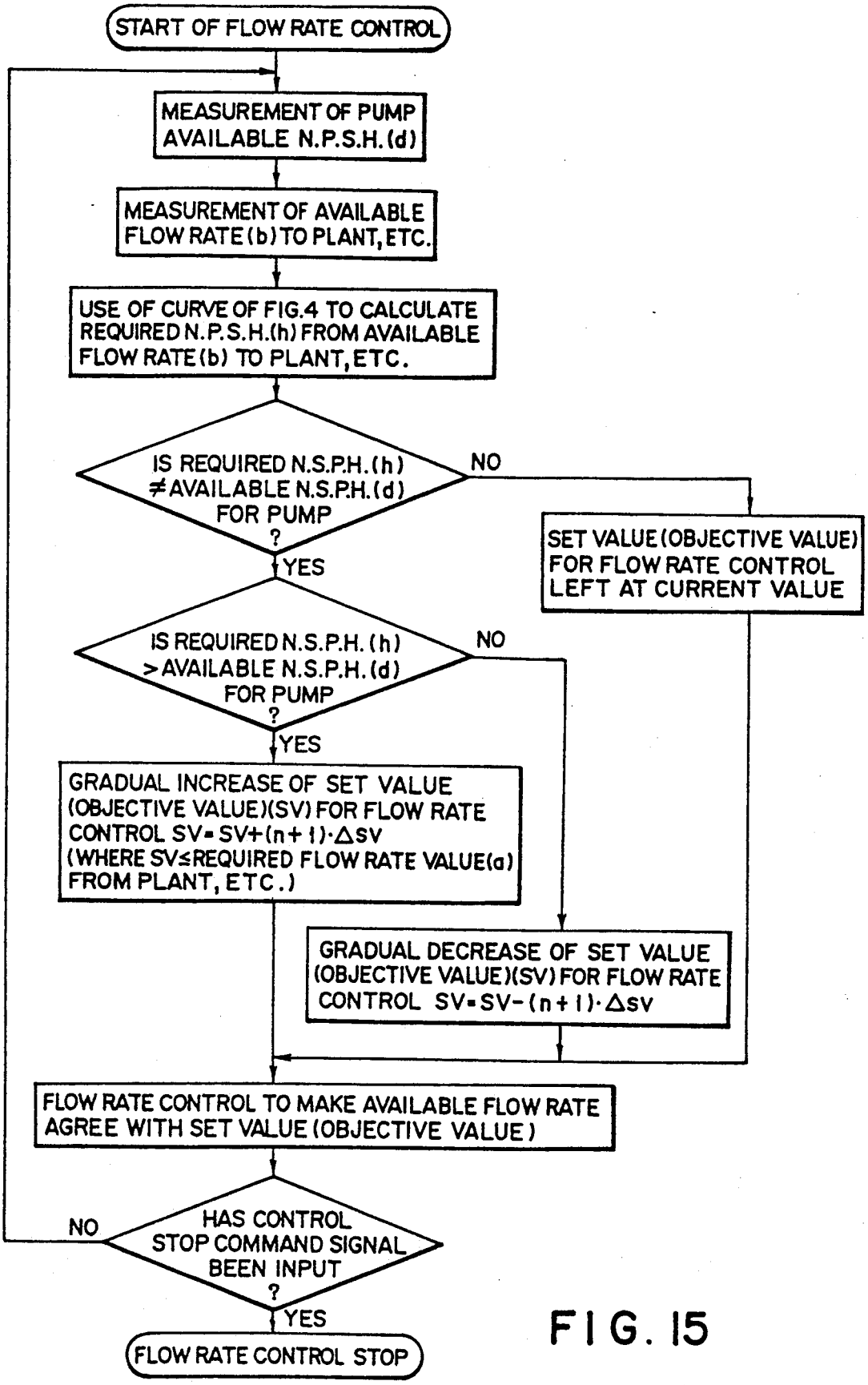
FIG. 15 is a flow chart showing another example of the processing flow.

Here, the process liquid is sent by the pump $2_{-1}$ and the other pump $2_{-2}$ is in the standby status. The flow rate adjustment portion 15*b* is the same as that of FIG. 16 and so its description will be omitted here. In addition, the required N.P.S.H. calculation portion 114 of the required N.P.S.H. adjustment portion 113*a* has the same action as that shown in FIG. 15 and so the required N.P.S.H. value with respect to the delivery flow rate of the pump is calculated and input to the subtractor portion 120. On the other hand, the measurement results d of the available N.P.S.H. measurement apparatus 19$_1$ of the pump are also input to the subtractor portion 120 where the calculation $$d-(f(b)+H)$$

is performed and the result is input to the start Command portion 121.

In the start command portion 121, when this input value d−(f (b)+H) is smaller than a predetermined value, the start command signal is output to the pump drive apparatus 3$_2$ and the pump 2$_2$ is started.

As a result, the process liquid that has up until now been sent to the process side by only the pump 2$_1$, is sent under pressure by the pumps 2$_1$ and 2$_2$ and so the delivery flow rate of each pump is halved, so that the relationship available N.P.S.H. > required N.P.S.H.

is always established.

Figure 19:
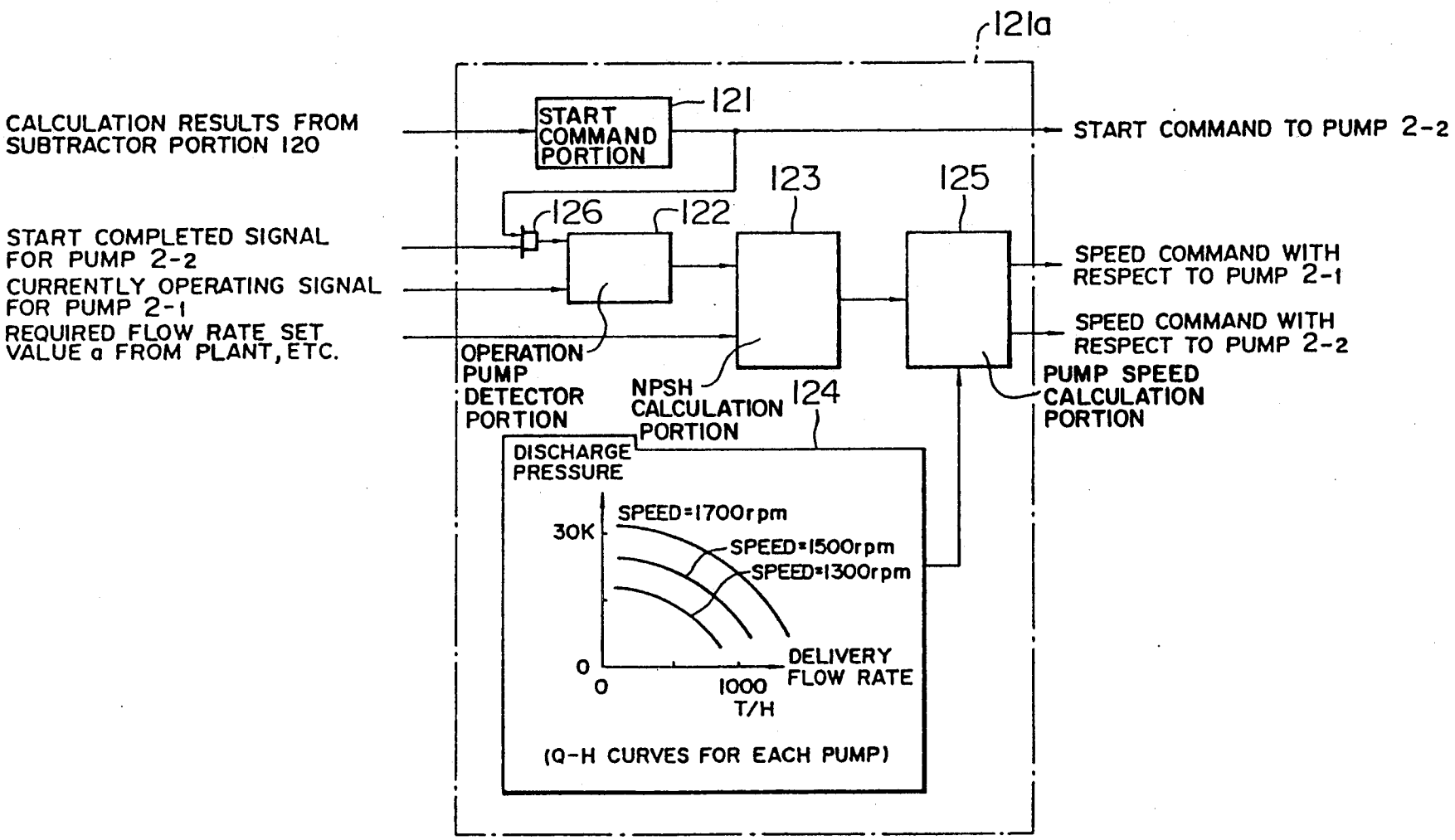

In addition, instead of the start command portion 121 of FIG. 18, the use of the start and speed command portion 121*a* shown in FIG. 19 can lower the speed of two pumps when two pumps begin operating so that it is possible to reduce the necessary power of the pump and so that it is also possible to even further reduce the required N.P.S.H. of the pump so that there is a greater effect obtained when compared to that of FIG. 18.

More specifically, the start command portion 121 of the start and speed command portion 121*a* shown in FIG. 19 are the same as those shown in FIG. 17 and when the relationship available N.P.S.H. < required N.P.S.H.

is established, the start command is output to the pump 2$_2$. On the other hand, the output of the AND circuit 126 for this signal and the pump 2$_2$ start completed signal is input to the operating pump detector portion 122. The AND circuit 126 described above is cleared when the pump 2$_2$ has been started manually, and detects only when the pump 2$_2$ has been started so that the relationship available N.P.S.H. > required N.P.S.H.

can be established, but instead of the AND circuit 126, it is possible to use operating signals for the pump 2$_2$.

On the other hand, the operating pump detector portion 122 also inputs signals for whether or not the pump 2$_1$ is operating, and detects which of the pumps is currently operating. Then, these detection results and the required flow rate set value "a" from the plant are input to each of the required N.P.S.H. calculation portions 123 where the required N.P.S.H. value for each of the operating pumps is determined. Then, these results are input to the speed calculation portion 125 for each pump.

On the other hand, the Q-H curve storage portion 124 inputs and stores each of the predetermined Q-H curves and the data relating to these Q-H curves is also input to each of the speed calculation portions 125 where the speed with respect to each of the pumps is calculated, and these speed command signals are output to each of the pump drive apparatus 3$_1$ and 3$_2$.

The following is a description of the embodiment shown in the same Figure, while using one example of the Q-H curves for each pump shown in the Q-H curve storage portion 124 in the same figure.

The Q-H curve of a pump is a curve that indicates the relationship between the delivery flow rate of a pump and the delivery pressure, and the Q-H curve of a variable speed pump that can control the speed is shown in FIG. 19.

Here, when the speed of only one pump 2$_1$ − 17OO rpm and the process liquid is being sent at a rate of 1000T/H, the relationship available N.P.S.H. of pump 2$_1$ < required N.P.S.H. of pump 2$_1$ appears that it will be established and 2$_2$ is also started. When it is, the same delivery pressure as when there was only one pump is to be obtained, there must be the performance that can send approximately 1000T/H (of one pump) × 2 = 2000T/H but in the case of the embodiment shown in FIG. 18, the action of the flow rate adjustment portion 15*b* restricts the flow rate adjuster valve 4 in the direction of closing so as to increase the piping loss (pressure drop) and to send process liquid corresponding to the required flow rate set value "a" from the plant so that the portion of the increase of the piping loss (pressure drop) represents an energy loss.

In the case of the embodiment shown in FIG. 19, for example, when the two pumps have the same performance, the approximately 500T/H of process liquid that is sent with only one pump when two pumps are operating is favorable and in order to obtain the same delivery pressure when one pump is operating, the speed of rotation of the pump can be made 1500 rpm. Here, when the speed calculation portion 125 for each pump calculates this, the speed of rotation of each pump is lowered to 1500 rpm and slight flow rate correction is performed by the flow rate adjustment portion 15*b* so that process liquid is sent in accordance with the required flow rate set value "a" from the plant.

When this is done, the lowering of the pump speed makes it no longer necessary for the flow rate adjuster valve 4 to be closed when compared to the case shown in FIG. 18, and there is the result that the energy loss is reduced.

Figure 20:
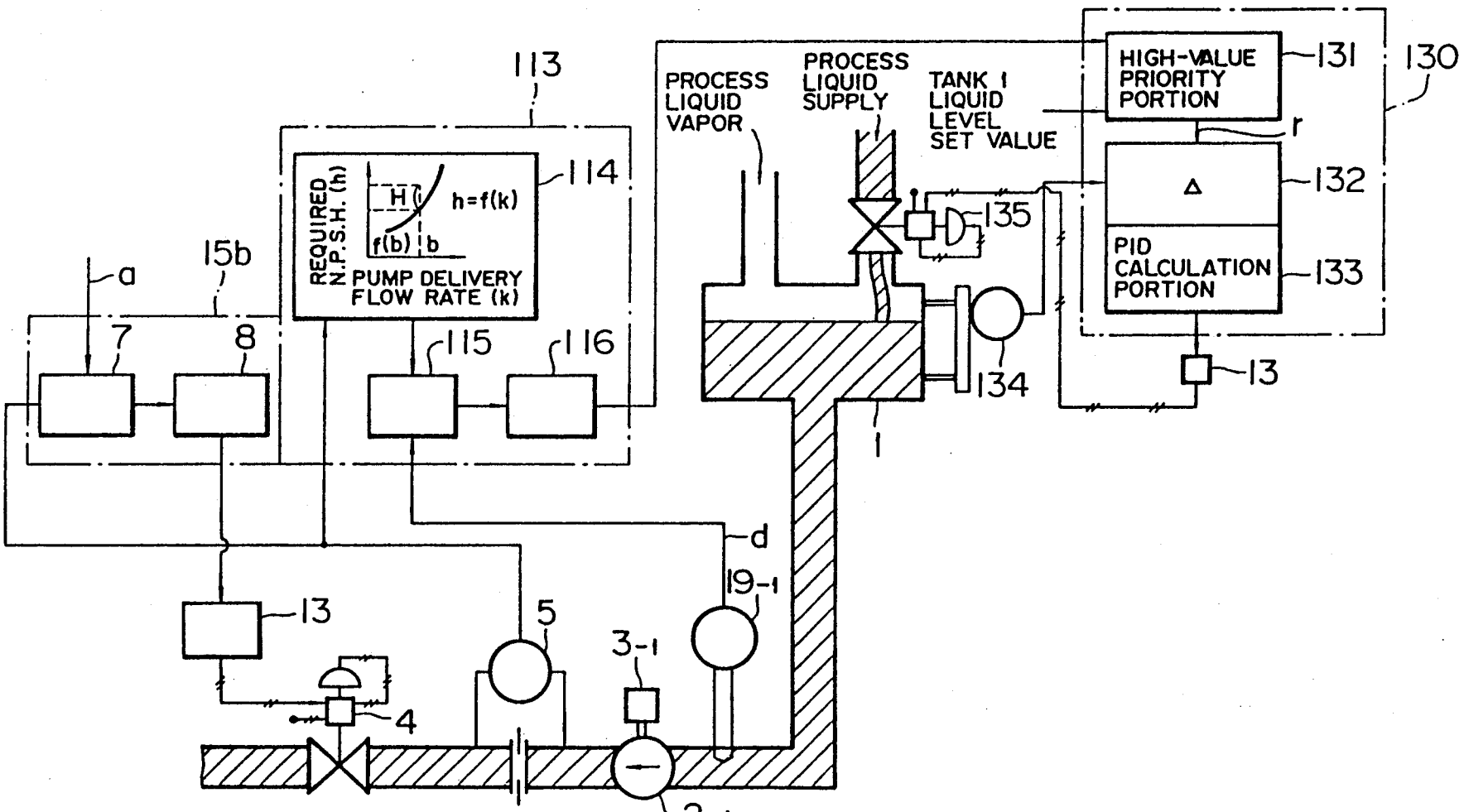

In a power generation plant, as shown in FIG. 20, the vapor of the process liquid in the tank that temporarily stores the process liquid and process liquid are resupplied so that the low-temperature process liquid cools the process liquid vapor so that it condenses to become process liquid in a piping system whereby the pump 2$_1$ sends this process liquid to the plant. In such a case, the ratio between the process liquid resupply amount and the amount of vapor of the process liquid to the tank 1 is normally a suitable degree but for example, there may also be instances where the amount of process liquid vapor has to be suddenly reduced due to the plant operating conditions. In such cases, the reduction of the amount of process liquid vapor not only reduces the pressure that is applied to the liquid surface of the process liquid in the tank 1, but also greatly increases the ratio of cooled process liquid when compared to the amount of cooled vapor so that the container pressure of the tank 1 drops even further so that it becomes more easy for the relationship available N.P.S.H. of pump $2_{-1}$ < required N.P.S.H. of pump $2_{-1}$ to be satisfied.

In such cases, the liquid level adjuster valve 135 is closed and the vapor amount to the tank 1 is made to have a suitable ratio with the process liquid so that the relationship available N.P.S.H. of pump $2_{-1}$ > required N.P.S.H. of pump $2_{-1}$ can always be satisfied.

The following is a description of this with reference to FIG. 20.

The flow rate adjustment portion 15*b* and the required N.P.S.H. deviation adjustment portion 113 are exactly the same as those of FIG. 16 and so the descriptions of them will be omitted here. The output of the suction head PID calculation portion 116 is input to the high-level priority portion 131 of the liquid level adjustment portion 130 of tank 1. On the other hand, the liquid level set value of tank 1 is also input to the and high-level priority portion 131 and the value r which is the larger of the two is output to the deviation calculation portion 132 as the calculation result. On the other hand, the measurement results for the liquid level meter 134 of tank 1 are also input to the deviation calculation portion 132 where the result of deviation calculation is input to the liquid level PID calculation portion 133, and the result of PID calculation is input to the liquid level adjuster valve 135 via the electro-pneumatic converter 13, so that the degree of opening of this liquid level adjuster valve 135 is controlled.

The following is a description of this operation. In the delivery flow rate of the currently operating pump $2_{-1}$, should the relationship available N.P.S.H. > required N.P.S.H.

appear that it will no longer be established, then the output signals from the suction head PID calculation portion 116 of the required N.P.S.H. deviation adjustment portion 113 are increased so accordingly. The value r which is the higher of these signals and the tank 1 liquid level set value is then output from the high-level priority portion 131. Then, this is used as the final set value (objective value) for the liquid level adjuster of tank 1 and control of the liquid level adjuster valve 135 is performed by the liquid level adjustment portion 130. Even if this method is used, the adjustment of the process liquid vapor amount and the process liquid resupply amount so that there is a suitable ratio between them can be performed so that the relationship available N.P.S.H. > required N.P.S.H.

can be always established while there is control of the delivery flow rate of the pump, and thereby producing the same effect as has been described above.

Moreover, in the embodiment shown in FIG. 20, the vapor of the process liquid in tank 1 is cooled by direct contact with the process liquid that is resupplied via the liquid level adjuster valve 135 and the vapor is liquified so that both are mixed. However, the two need not necessarily be mixed since, for example, the vapor of the process liquid or the process liquid that is resupplied can have heat exchange performed through the pipe walls of a heat exchanger or the like so that as a result, the process liquid vapor condenses and collects in the tank 1, or the process liquid that is supplied via the liquid level adjuster valve 135 can be heated and collected in the tank 1.

The control parameters and their objective value, time-integral values and the like are input to the flow rate adjustment portion 15 so that when the plant is being operated by an operator, it is possible to introduce the control rules as they are input to a suitable controller.

Figure 21:
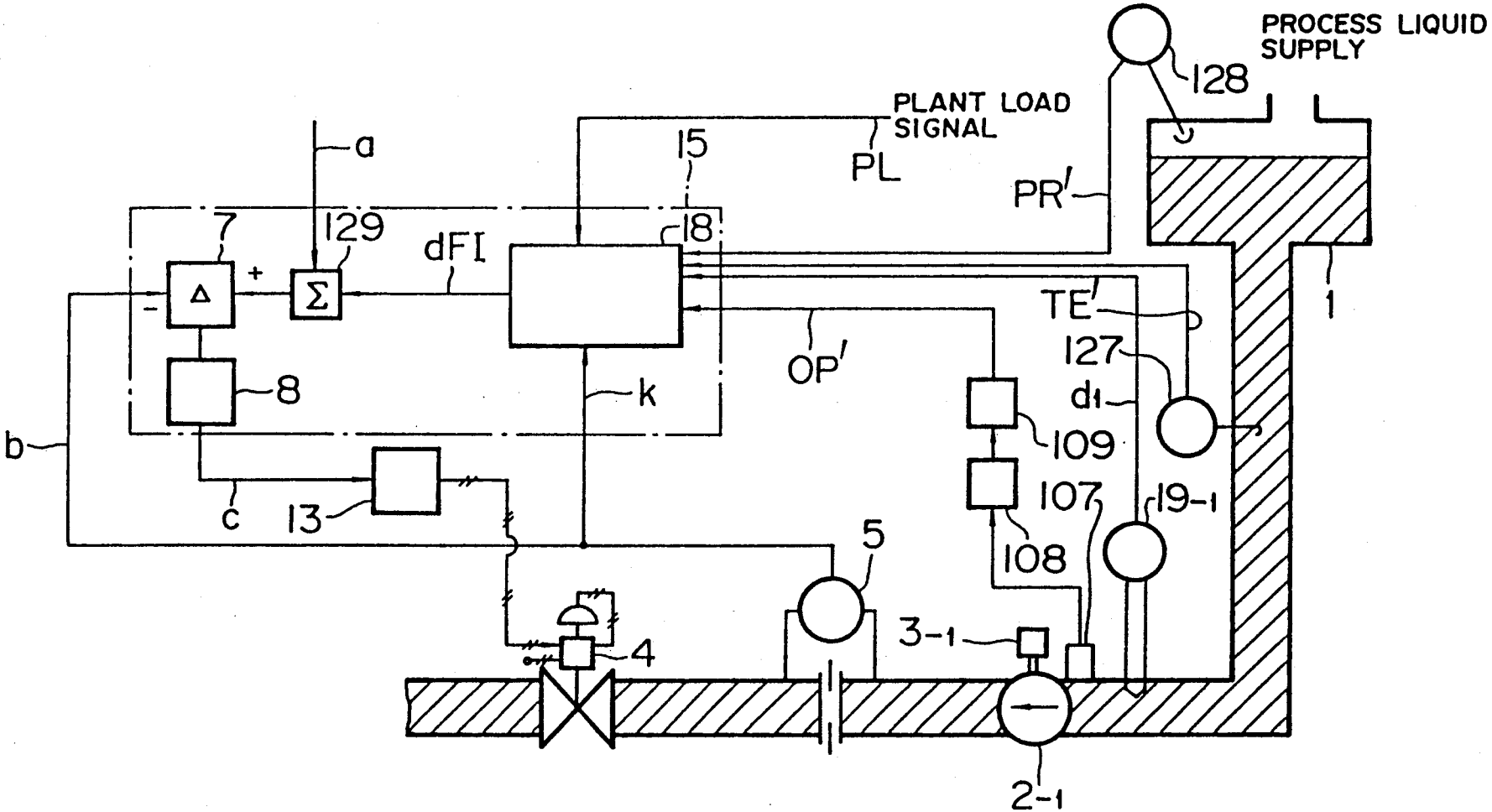
Figure 22:
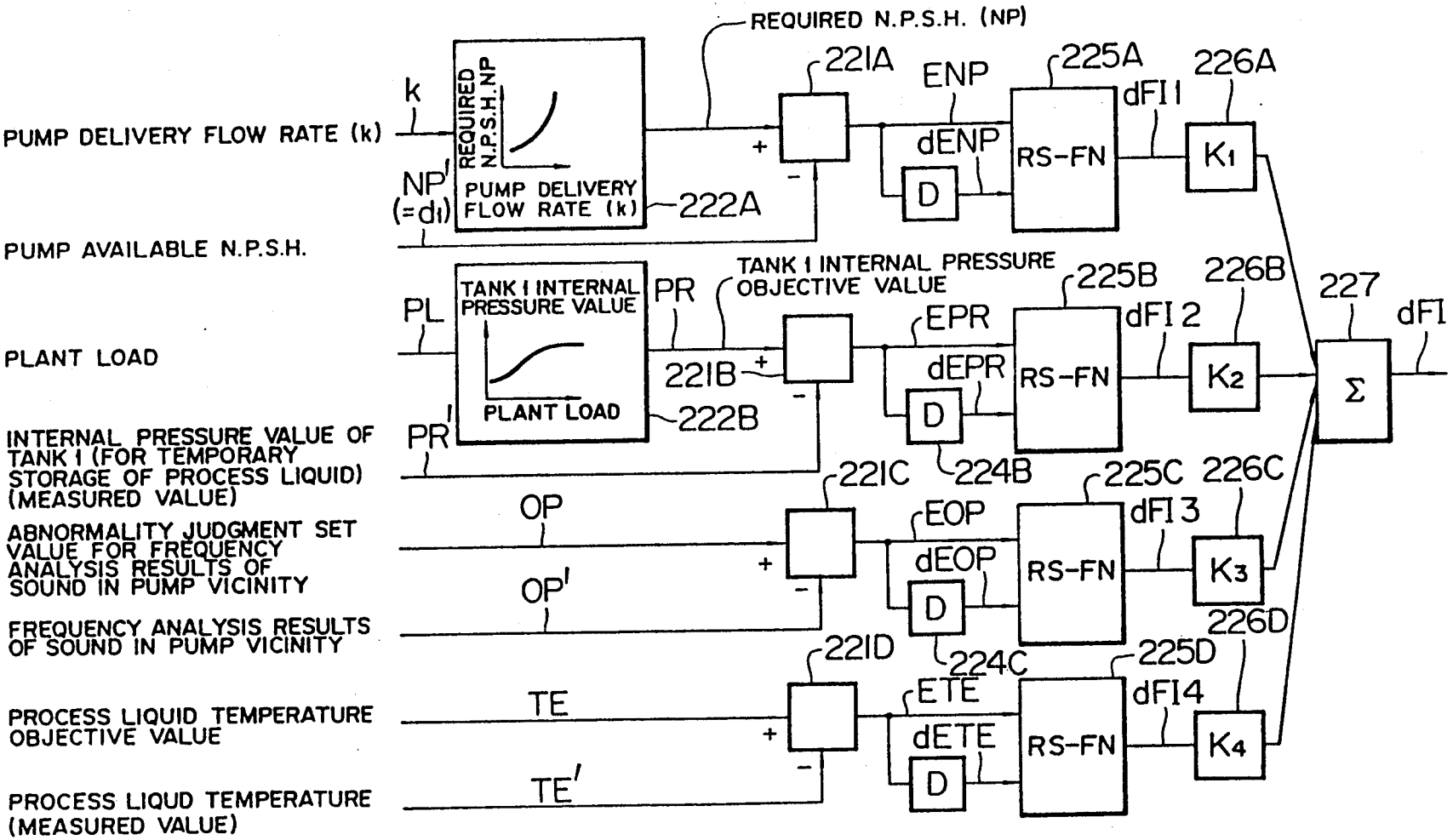
FIG. 22 is an enlarged block diagram of the second calculation portion of FIG. 21.
Figure 23:
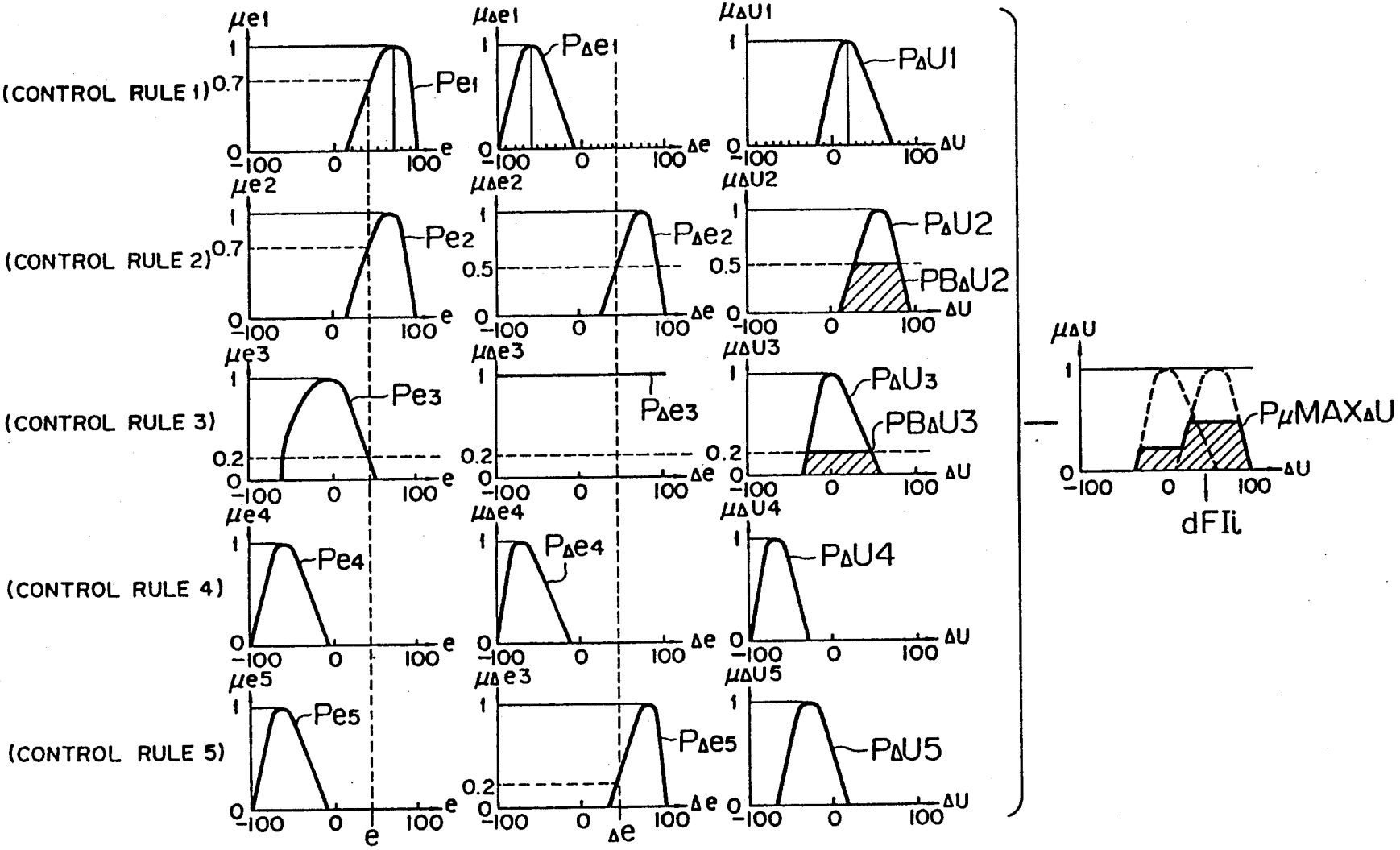
FIG. 23 describes a specific method of calculation of the controller of FIG. 21.

FIG. 21 through FIG. 23 show one example of this.

FIG. 21 is an example of a process piping system for a power generation plant, and in this piping system, the container pressure of the tank 1 that temporarily stores the process liquid rises along with an increase in the load of the plant, and it is normal for the process liquid temperature inside the tank 1 to also rise. In addition, there are also occasions where the temperature of the process liquid rises irrespective of the load. Also, the process liquid in the tank 1 is sent to the plant side by the pump $2_{-1}$ after it has passed through the flow rate meter 5 and the flow rate adjuster valve 4.

In such a process piping system, when a pump delivery flow rate control apparatus such as that shown in FIG. 1 is used and the available N.P.S.H. and the required N.P.S.H. are compared while delivery flow rate control is performed, the effect of preventing trouble such as that due to cavitation is obtained as has been described above but for example, should the plant load change quickly from a status near the rated status, to a status that is the low status (such as when, for example, the status is close to 0%), the container pressure inside the tank 1 drops accordingly. In addition, the temperature of the process liquid in the tank 1 drops after a further delay. Then, when the plant load is suddenly reduced such as this, or when the temperature of the process liquid on the suction side of the pump rises sharply, it is most easy for the relationship available N.P.S.H. < required N.P.S.H.

to occur. In order to prevent this, this embodiment has provided, in addition to the embodiment shown in FIG. 1, a container pressure meter for tank 1 or a plant load meter, and a process liquid temperature gauge on the suction side of the pump, so that those measurement values or their change ratios are measured so that for example, in the case where the change ratio is greater than a value that has been set beforehand, then even if there is still a surplus until the relationship available N.P.S.H. < required N.P.S.H.

is satisfied, the flow rate adjuster valve 4 is restricted beforehand so as to prevent the situation where available N.P.S.H. < required N.P.S.H.

from occurring at once.

In addition, when an operator is operating the process piping system while observing the meter values for the container pressure meter of the tank 1, and the pressure value is either very small or the drop ratio is very large, or when the measured value of the process liquid temperature gauge on the suction side of the pump is very high or when the temperature rise ratio is very high, then the flow rate adjuster valve can be slightly closed through experience even if there is still no change in the available N.P.S.H. of the pump $2_{-1}$, for example, or otherwise, the speed of the pump can be slowed so that the pump delivery flow rate is reduced so that the relationship available N.P.S.H. > required N.P.S.H.

can still be established but it is general for this reduced value for the pump delivery flow rate to be changed by the plant load. In addition, when there is a loud abnormal sound such as cavitation or the like in the vicinity of the pump, then the pump delivery flow rate can be slightly reduced so that the abnormal sound is made smaller. The control rules for such manually performed plant operation are incorporated into the second calculation portion 18 shown in FIG. 21 where the correction amounts with respect to the required flow rate set value "a" from the plant are calculated.

Moreover, an acoustic detector portion 107 is provided in order to detect sounds in the vicinity of the pump in the same manner as the embodiment shown in FIG. 13, and the output of this is input to the FFT portion 109 via the 1OPID calculation portion 8 where it is subjected to frequency analysis so that a judgment can be made for whether or not abnormal sounds such as those of cavitation are occurring, and this signal OP' is input to the second calculation portion 18. In addition, the measurement value $d_1$ (=NP') of the available N.P.S.H. measurement apparatus $19_{-1}$, the measurement value TE' due to the temperature gauge 127 for the process liquid on the pump suction side, and the measurement value PR' for the container pressure meter 128 of the tank 1 are input to the second calculation portion 18. Furthermore, the container pressure of the tank 1 and the delivery flow rate k in order to calculate the required N.P.S.H. change in accordance with the plant load and so the plant load signal PL is also input to the second calculation portion 18 in order to calculate the container pressure set value PR of the tank and which will be used as a reference value. Then, the corrected value dFI that has been calculated by the second calculation portion 18 and the required flow rate set value "a" from the plant are added at the adder 129 and this result is used as the set value (objective value) for flow rate control and delivery flow rate control for the pump is performed.

The following is a detailed description of one example of the second calculation portion 18, with reference to FIG. 22.

The pump delivery flow rate k is input to the function memory 222A for the pump delivery flow rate -required N.P.S.H. and this output is input to the adder 221A as the required N.P.S.H. value NP. On the other hand, the available N.P.S.H. value (measurement value $d_1$ NP' is also input to the adder 221A.

In addition, the plant load PL is input to the function memory 222B for the plant load tank container pressure curve, and that output is input to the adder 221B as the tank 1 container pressure objective value PR. On the other hand, the container pressure value (measured value) PR' for the tank 1 is also input to the adder 221B. In addition, the abnormality judgment set value OP that is the frequency analysis result for the sound in the vicinity of the pump is input to the adder 221C, and the frequency analysis result OP' is also input to the adder 221C. The temperature objective value TE for the process liquid is input to the adder 221D and on the other hand, the temperature (objective value) TE' for the process liquid is also input to this adder 221D.

Then, the deviations between the actually measured values and each of the set values (objective values) that are input to each of the adders 221A through 221D, that is $$ENP = Np - Np'$$

$$EPR = PR - PR'$$

$$EOP = OP - OP'$$

$$ETE = TE - TE'$$

are all calculated. (In the following, ENP, EPR, EOP and ETE are generically termed e.) Then, these calculation results are input to each of the controllers 225A through 225D and at the same time are also input to each of the differentiators 224A through 224D where the time differentials $$dENP = dENP/dt$$

$$dEPR = dEPR/dt$$

$$dEOP = dEOP/dt$$

$$dETE = dETE/dt$$

of these deviations e are calculated. (In the following, $\Delta e$ will be used when these dENP, dEPR, dEOP and dETE are generically referred to.) Then, the results of this calculation are input to each of the controllers 225A through 225D.

In each of these controllers 225A through 225D, the deviations e and the differential values $\Delta e$ of each of the status amounts are input, and each of the control outputs $\Delta u$ are calculated on the basis of the following control rules 1 through 5.

Control rule 1: When the deviation e is large in the positive direction and the differential value $\Delta e$ of the deviation is large in the negative direction, the control output $\Delta u$ is made smaller in the positive direction.

Control rule 2: When the deviation e is close to zero and the differential value $\Delta e$ is any value, the control output $\Delta u$ is made close to zero.

Control rule 3: When the deviation e is large in the negative direction and the differential value $\Delta e$ is large in the negative direction, the control output $\Delta u$ is made close to zero.

Control rule 4: When the deviation e is large in the negative direction and the differential value $\Delta e$ is large in the negative direction, the control output $\Delta u$ is made larger in the negative direction.

Control rule 5: When the deviation e is large in the negative direction and the differential value $\Delta e$ is large in the positive direction, the control output $\Delta u$ is made smaller in the negative direction.

FIG. 23 is a view describing the specific method of calculation of the controllers 225A through 225D. In this Figure, each of the graphs has the horizontal axis as the deviation e, and the differential value $\Delta e$ of the deviation and the control output $\Delta u$ are from $-100$ to $+100\%$, and the vertical axis shows the measurements $\mu$ equivalent to each of the concepts described above for "large in the positive direction," "small in the positive direction," "zero," "small in the negative direction" and "large in the negative direction" and when these are expressed together. The measurement $\mu$ is from 0 to 1, and expresses each of the control rules described above.

More specifically, in "Control rule 1" of this Figure, the measurement $\mu e$ is calculated from the deviation e at this time and so the deviation e is defined as large for the range from 10% to 100% in the positive direction, and that measurement $\mu e$ is gradually increased in accordance with the increase of the deviation e when a deviation e of 10% is made zero, and when the deviation is 70%, the measurement $\mu e$ is made the maximum of 1, while after that, it is reduced again to set the pattern $Pe_1$ when a deviation of 100% is made zero. Here, the reason for the reduction of the measurement after a deviation of 70% has been made the measurement maximum is because the vicinity of 70% is maximum for the deviation e and deviations above that would rarely occur with a normal control status.

Following this, in order to calculate the measurement $\mu\Delta e$ from the differential value $\Delta e$ of the deviation, the differential value $\Delta e$ of the deviation is defined as small for from $-10\%$ to 100% and sets the pattern $P\Delta e_1$, so that the measurement $\mu\Delta e$ has a maximum of 1 for $-60\%$.

Furthermore, the control output $\Delta u$ is defined as small for from 20% to $+70\%$, and at $+20\%$, sets the pattern $P\Delta U_1$ so that the measurement $\mu\Delta u$ becomes a maximum of 1.

As can be seen from these patterns, $Pe_1$, $P\Delta e_1$, $P\Delta U_1$, the control rule 1 makes the control deviation e large in the positive direction but when the differential value $\Delta e$ of that deviation is large in the negative direction, that is, when the deviation moves quickly in the direction of recovery, the control output $\Delta u$ is made small and correction operation is minimized so that the performance of too much control in the opposite direction is prevented. In addition, the size of the control output $\Delta u$ at this time is determined in accordance with the size of the deviation e and the differential value $\Delta e$ of the deviation.

Then, the patterns $Pe_2$ through $Pe_5$, $P\Delta e$: through $P\Delta e_5$, $P\Delta U_2$ through $P\Delta U_5$ are provided to the control rules 2 through 5 in the same manner.

Each of the controllers 225A through 225D is provided with the control rules 1 through 5 described above, and the deviations e input to them and the differential values $\Delta e$ of the deviations are used to determine on the basis of their control rules, the measurements $\mu e$ and $\mu\Delta e$ obtained from each of the patterns for e and $\Delta e$, and the smaller of the two truncates the upper portion of the pattern of the control output $\Delta u$ by $\mu MIN$, and the remaining portion $PB\Delta U$ is determined for each of the control rules, and the average value of the pattern $P\mu MAX\Delta U$ obtained by calculating that maximum value $\mu MAX$, is made the output dFIi (where i=1 through 4) of each of the controllers 225A through 225D.

For example, to describe for the case when values where e=40%, and $\Delta e=30\%$ are input, For control rule 1: $\mu MIN_1=0$ when $\mu e_1=0.7$, $\mu\Delta e_1=0$ For control rule 2: $\mu MIN_2=0.5$ when $\mu e_2=0.7$, $\mu\Delta e_2=0.5$ For control rule 3: $\mu MIN_3=0.2$ when $\mu e_3=0.2$, $\mu\Delta e_3=0.2$ For control rule 4: $\mu MIN_4=0$ when $\mu e_4=0$, $\mu\Delta e_4=0$ For control rule 5: $\mu MIN_5=0$ when $\mu e_5=0.2$, $\mu\Delta e_5=0$ and consequently, only control rule 2 and control rule 3 are suitable. With respect to these control rules, the $PB\Delta U$ taken are the $PB\Delta U_2$ and $PB\Delta U_3$ for the diagonally hatched portion of FIG. 23. The maximum value $\mu MAX$ calculated for these $PB\Delta I_2$ and $PB\Delta U_3$, is the $P\mu MAX\Delta U$ which is the diagonally hatched portion of FIG. 23 and the output dFIi of the controllers 225A through 225D from this average value is calculated.

The controllers 226A through 226D of FIG. 22 are variable gain proportional controllers and change the gain according to the plant load.

Figure 24:
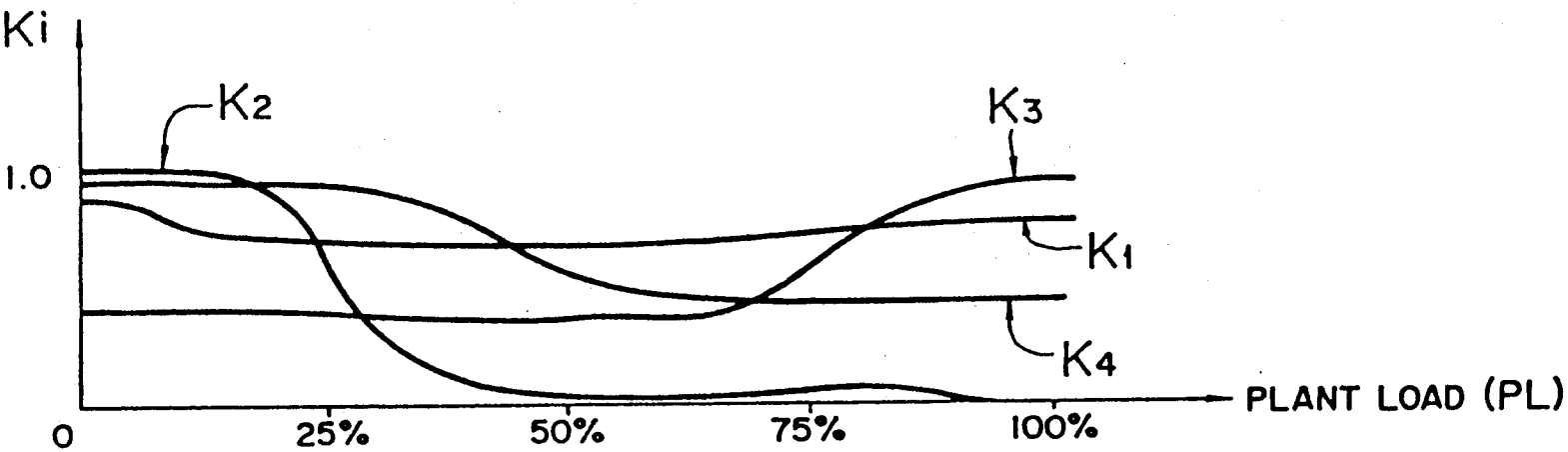
FIG. 24 is a graph showing the status of gain change.

FIG. 24 shows one example, and the available N.P.S.H. value $K_1$ of the pump is roughly constant across the full load band, and the gains $K_2$ and $K_4$ with respect to the container pressure of the tank 1 and the temperature of the process liquid, respectively, are large for low negative loads, while the gain $K_3$ with respect to the frequency analysis results for the sound in the vicinity of the pump is large for high negative loads.

In FIG. 22, the number 227 is an adder that adds each of the control outputs relating to the pump's available N.P.S.H., the container pressure of the tank the frequency analysis results for the sound in the vicinity of the pump, and the temperature of the process liquid, and this output is used as the output signal dFI of the second calculation portion 18 of FIG. 21.

The pump available N.P.S.H. NP from the current pump delivery flow rate value k for a pump having the configuration as described above, and container pressure objective value PR for the tank 1 and from the plant load PL, are calculated as set values (objective values). In addition, the abnormal sound judgment set value OP for the frequency analysis results of the sound in the vicinity of the pump, and the temperature objective value TE for the process liquid are also input as set values (objective values). In the adders 221A through 221D, each of these set values (objective values) are compared with the pump available N.P.S.H. value NP' which is the value of the current status of the process piping system, the container pressure value PR' for tank 1, the frequency analysis results of the sound in the vicinity of the pump, and the temperature objective value TE for the process liquid, and the feedback deviations $$ENP=NP-NP'$$

$$EPR=PR-PR'$$

$$EOP=OP-OP'$$

$$ETE=TE-TE'$$

are all calculated. Then, these calculation results are input to each of the controllers 224A through 224D where the time differentials $$dENP=dENP/dt$$

$$dEPR=dEPR/dt$$

$$dEOP=dEOP/dt$$

$$dETE=dETE/dt$$

of these deviations are calculated.

Then, these deviations and the differential values of these deviations are input as e=ENP, $\Delta e=dENP$ to the controller 225A, as e=EPR, $\Delta E=dEPR$ to the controller 225B, as e=EOP, Δe=ETE, Δe=dEOP to the controller 225C, as e=ETE, Δe=dETE to the controller 225D so that each of the control outputs dFI1, dFI2, dFI3, dFI4 are obtained.

More specifically, with respect to the available N.P.S.H. of the pump, as has already been described, e=ENP, Δe=dENP is input so that each of the patterns $Pe_1$ through $Pe_5$, $P\Delta e_1$ through $P\Delta e_5$ shown in FIG. 23 can be used to calculate the respective measurements $\mu e1$ through $\mu e_5$, $\mu\Delta e_1$ through $\mu\Delta e_5$. Furthermore, each of the smaller of the values $\mu MIN_1$ through $\mu MIN_5$ can be determined so that the base patterns $PB\Delta U_1$ through $PB\Delta U_5$ of those control output patterns $P\Delta U_1$ through $P\Delta U_5$ are obtained.

Furthermore, the maximum value pattern $P\mu MAX\text{-}\Delta U_1$ obtained from combining those base patterns $PB\Delta U$ through $PB\Delta U_5$ is calculated, and the average value of this pattern, that is the weighted average value of the control output ΔU which spreads over a certain range is calculated to obtain the final control output $dFI_1$.

The control outputs $dFI_1$ through $dFI_4$ from each of the controllers 225A through 225D and obtained in this manner, are input to the variable gain proportional controllers 226A through 226D and the weighted average value dFI through the adder 227 is calculated as $$dFI = K_1 \times dFI_1 + K_2 \times dFI_2 + K_3 \times dFI_3 + K_4 \times dFI_4$$

Accordingly, this dFI is added to the required flow rate set value "a" from the plant as the output signal of the second calculation portion 18 shown in FIG. 2, and by performing delivery flow rate control as the set value (objective value) for the delivery flow rate control of the pump, the relationship available N.P.S.H. > required N.P.S.H.

is established for the full range of the load of the plant while there is also the effect of being able to favorably and automatically perform delivery flow rate control.

Figure 25:
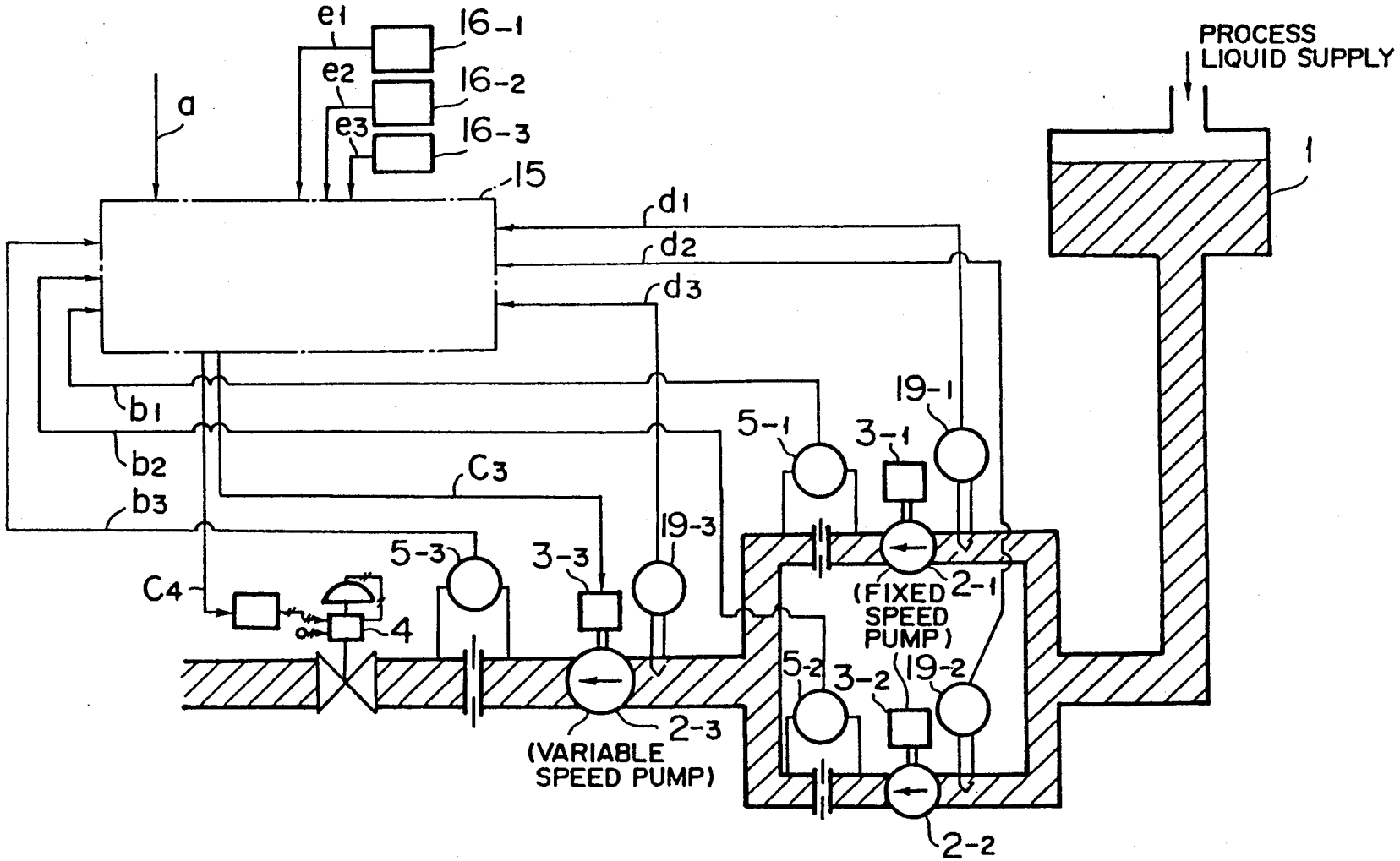
FIG. 25 is a s diagram of another embodiment.

In addition, depending on the power generation plant, as shown in FIG. 25, the process liquid that is temporarily stored in the tank 1 has its pressure raised by the plural number of pumps $2_{-1}$ and $2_{-2}$ that are disposed in parallel and then the delivery pressure is further raised by the variable speed pump $2_{-3}$ in a piping system where the process liquid is sent to the plant after passing through the flow rate adjuster valve 4. In a case such as this, when one of the pumps $2_{-1}$ and $2_{-2}$ that are disposed in parallel fails and stops, such as for example, when the pump $2_{-1}$ has failed and stopped, the pump $2_{-2}$ that is still operating from amongst the plural number of pumps that are disposed in parallel has an excessive flow rate and not only is the relationship available N.P.S.H. for pump $2_{-2}$ > required N.P.S.H. for pump $2_{-2}$ no longer established, but the relationship available N.P.S.H. for pump $2_{-3}$ > required N.P.S.H. for pump $2_{-3}$ is also no longer established because the suction pressure of the variable speed pump $2_{-3}$ has dropped.

Accordingly, in a case such as this, it is necessary that the speed of the variable speed pump $2_{-3}$ be either quickly lowered or the degree of opening of the flow rate adjuster valve 4 be restricted so that the delivery flow rate is lowered so that the relationships available N.P.S.H. for the pump > required N.P.S.H. for the pump are always established for the pumps $2_{-1}$ through $2_{-3}$ and so that the occurrence of cavitation and related problems for each of the pumps $2_{-1}$ through $2_{-3}$ can be prevented.

On the other hand, when there is normal operation, the variable speed pump $2_{-3}$ has the maximum allowable speed for which operation is possible and so in the case where there must be a pump delivery flow rate that is equal to or less than the required flow rate set value "a" from the plant, then control is performed so that the variable speed pump $2_{-3}$ is made the maximum allowable speed for which operation is possible and so that the flow rate adjuster valve 4 is restricted. However, when the required flow rate set value "a" from the plant is greater than the maximum allowable speed for which operation of the variable speed pump $2_{-3}$ is possible either or both of speed control of the variable speed pump $2_{-3}$ or the degree of opening control of the flow rate adjuster valve 4 can be thought of, but, in order to have operation while minimizing the energy loss due to the drive power of the pump, the flow rate adjuster valve 4 is made as fully open as is possible and control of the speed of the variable speed pump $2_{-3}$ is performed so that there is the effect of performing delivery flow rate control for the pump.

However, in the conventional technology, it is not possible to perform delivery flow rate control for the pump while the available N.P.S.H. and the required N.P.S.H. are being compared and so when the pump $2_{-1}$ has failed and stopped, the degree of opening of the flow rate adjuster valve 4 or the speed of the variable speed pump $2_{-3}$ is forcedly restricted to a predetermined sequence so that the actual flow rate value to the plant becomes a predetermined constant value. After this, the pump $2_{-1}$ is started again, the only available choice for control was the pump delivery flow rate control method whereby, when the required flow rate set value "a" from the plant is increased once more, the degree of opening of the flow rate adjuster valve 4 is also accordingly opened in the direction of fully open and the speed of the variable speed pump $2_{-3}$ is increased.

Accordingly, not only was it not possible to perform delivery flow rate control for the pump while the available N.P.S.H. and the required N.P.S.H. were being compared, there was also the problem that during the cycle of the required flow rate set value "a" from the plant so that the flow rate adjuster valve 4 is not fully open, there is operation at an intermediate degree of opening for the flow rate adjuster valve 4 and so there is a flow path loss portion, that is to say, a loss portion for the pump drive power.

The following is a description of one embodiment of a pump delivery flow rate control apparatus that does not have this problem, with reference to FIG. 25.

More specifically, the available N.P.S.H. values (measured values) of the available N.P.S.H. measurement apparatus $19_{-1}$, $19_{-2}$, $19_{-3}$, for each of the pumps $2_{-1}$, $2_{-2}$, $2_{-3}$ are input to the flow rate adjustment portion 15c. In addition, to the required N.P.S.H. input portion $16_{-1}$, $16_{-2}$, $16_{-3}$ of each of the pumps $2_{-1}$, $2_{-2}$, $2_{-3}$ are input beforehand the function curve h=f (k) "delivery flow rate -required N.P.S.H." for each of the pumps $2_{-1}$, $2_{-2}$, $2_{-3}$. On the other hand, the delivery flow rate for each of the pumps $2_{-1}$, $2_{-2}$, $2_{-3}$ is measured by the flow rate meters $5_{-1}$, $5_{-2}$, $5_{-3}$ and those actually measured values (measured values) $b_1$, $b_2$, $b_3$ and the required flow rate set value "a" are input to the flow rate adjustment portion 15c. Then, the flow rate adjustment portion 15c outputs to the variable speed pump $2_{-3}$ the speed control signal $c_3$ and outputs to the flow rate adjuster valve 4 the degree of opening control signal $c_4$ which are the results of this control calculation.

Figure 26A:
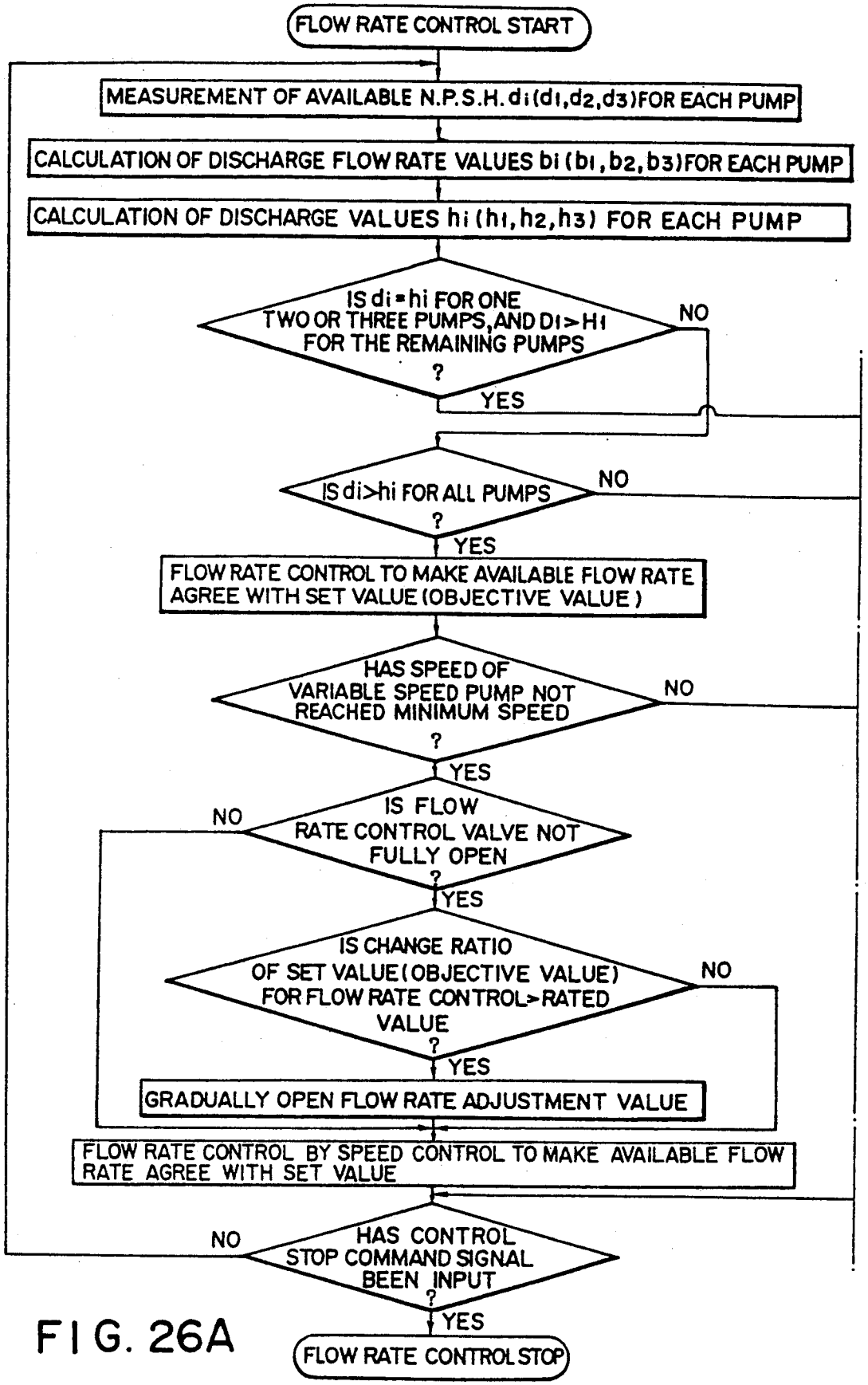
FIG. 26 (26A and 26B) is flow chart showing one example of the processing flow.
Figure 26:
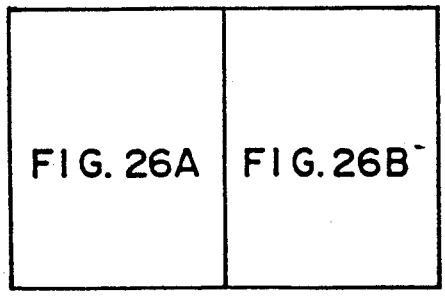
Figure 26B:
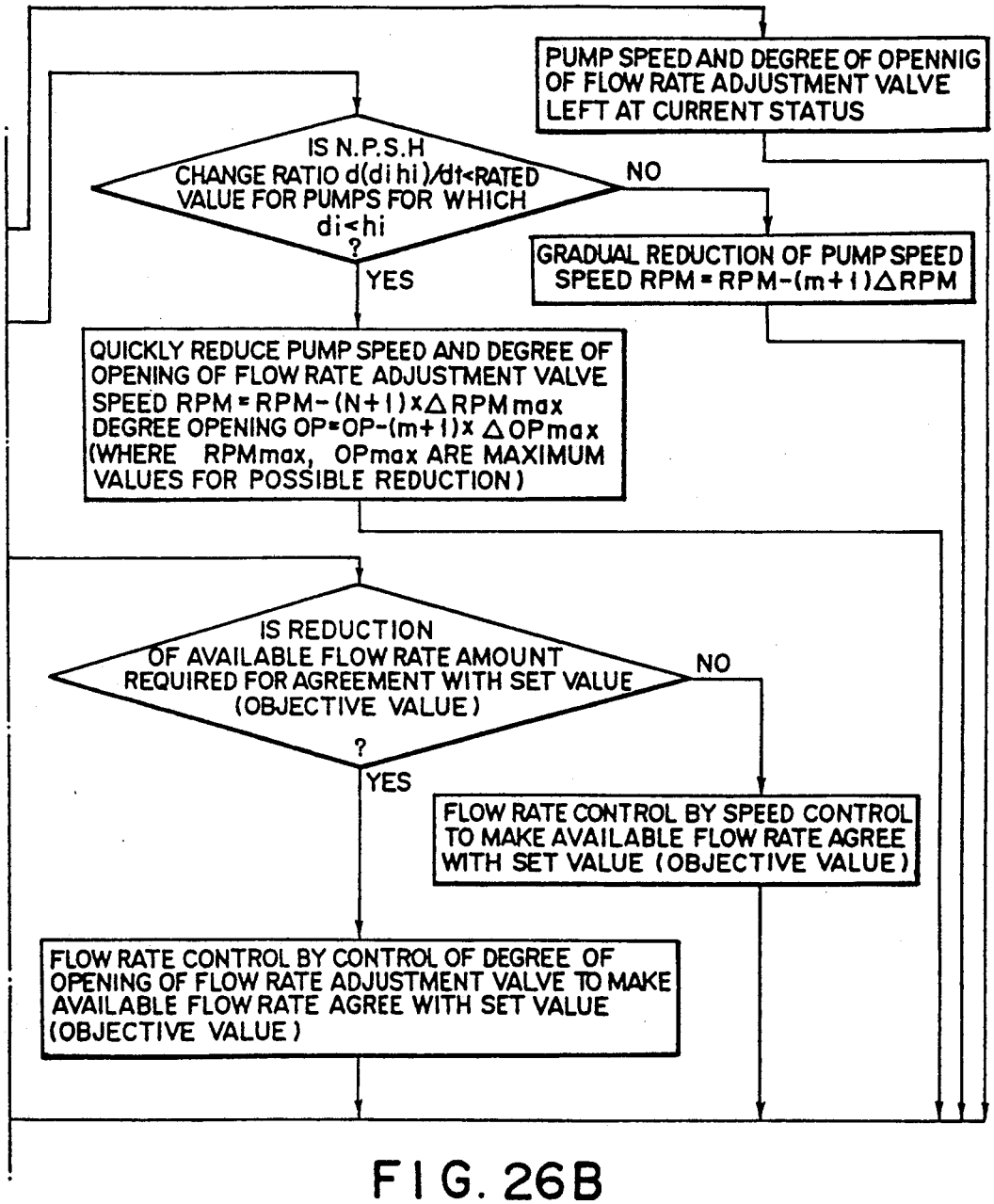

FIG. 26 shows one example of the details of this processing flow in the flow rate adjustment portion 15c of the configuration described above. The method of calculating the required N.P.S.H. value $h_i$ of each of the pumps $2_{-1}$, $2_{-2}$, $2_{-3}$ from the actual flow rate value $b_i$ of each of the pumps $2_{-1}$, $2_{-2}$, $2_{-3}$ is the same as the method used for FIG. 14, described above. In addition, the processing flow of FIG. 26 can be programmed into a computer, for example, so that it is possible to realize the flow rate adjustment portion 15c.

If such a pump delivery flow rate control apparatus is used, then for example should the pump $2_{-1}$ or the pump $2_{-2}$ fail and stop and it is necessary to quickly change the difference between the available N.P.S.H. value $d_i$ and the required N.P.S.H. value $h_i$, this is an emergency situation as far as the pump is concerned, and so the speed of the variable speed pump $2_{-3}$ and the degree of opening of the flow rate adjuster valve 4 are quickly restricted so that it is possible to always establish the relationship available N.P.S.H. for each pump > required N.P.S.H. for each pump In addition, for example, should the container pressure of the tank 1 drop or should the temperature of the process liquid on the suction side of the pump rise so that there be a case where the relationship available N.P.S.H. for a pump > required N.P.S.H. for a pump gradually become not possible to be established, then only the speed of the pump $2_{-3}$ is restricted so that it is possible to perform control of the delivery flow rate while establishing the relationship described above. In addition, in the situation where the relationship available N.P.S.H. for a pump > required N.P.S.H. for a pump has been established for each pump, then the change ratio for the set value (objective value) for flow rate control, that is the change ratio for the required flow rate set value "a" from the plant > a rated value, that is the required flow rate set value "a" does not fall and is above a predetermined drop ratio, then for example even if the required flow rate set value "a" is a constant value, then the relationship available N.P.S.H. > required N.P.S.H.

is established and the delivery flow rate $b_3$ of a pump is made to agree with the required flow rate set value "a" while the degree of opening of the flow rate adjuster valve 4 is gradually brought to fully open while the speed of the variable speed pump $2_{-3}$ is restricted.

Moreover, the case where the required flow rate set value "a" has not fallen below predetermined drop ratio is so as to prevent disturbance in the control should the required flow rate set value "a" does not fall and is above a predetermined drop ratio so that when the degree of opening of the flow rate adjuster valve 4 is increased, the amount of restriction of the speed of the variable speed pump $2_{-3}$ becomes even greater.

Accordingly, the use of such a delivery flow rate control apparatus enables the performance of delivery flow rate control by opening the flow rate adjuster valve 4 to as wide as is possible even in the case where the required flow rate set value "a" is a constant value for example, and reduces the loss of the pump drive power. In addition, it is possible to send the process liquid to the plant under maximum pressure while establishing the relationship available N.P.S.H. > required N.P.S.H.

and so the effect becomes greater.

Moreover, in the embodiment shown in FIG. 25, there are used the flow meters $5_{-1}$, $5_{-2}$, $5_{-3}$ provided to each of the pumps $2_{-1}$, $2_{-2}$, $2_{-3}$ but instead of this, it is possible to omit $5_{-3}$ and to use only the flow meters $5_{-1}$, $5_{-2}$. In this case, the measurement results due to the flow meter $5_{-3}$ (the actual flow amount to the plant) are equal to the addition of the measurement results of the flow meters $5_{-1}$ and $5_{-2}$ and so this can be used instead. In addition, conversely, when the flow rate characteristics of the pumps $2_{-1}$ and $2_{-2}$ are the same, the flow rate meters $2_{-1}$ and $2_{-2}$ can be omitted, and instead, the measurement results of the flow rate meter $2_{-3}$ divided by 2, and used instead.

In the required N.P.S.H. value for the pump, the curve for the delivery flow rate (or the suction flow rate) of the pump required N.P.S.H. of the pump as shown in FIG. 4 and described with reference to drive apparatus $3_{-1}$, $3_{-n}$, was used, and the pump delivery flow rate measurement results used to calculate the required N.P.S.H. but this need not necessarily be performed, since, for example, it is possible to simply use a pump delivery flow rate control apparatus that has a fixed value for the required N.P.S.H. of the pump.

Figure 27:
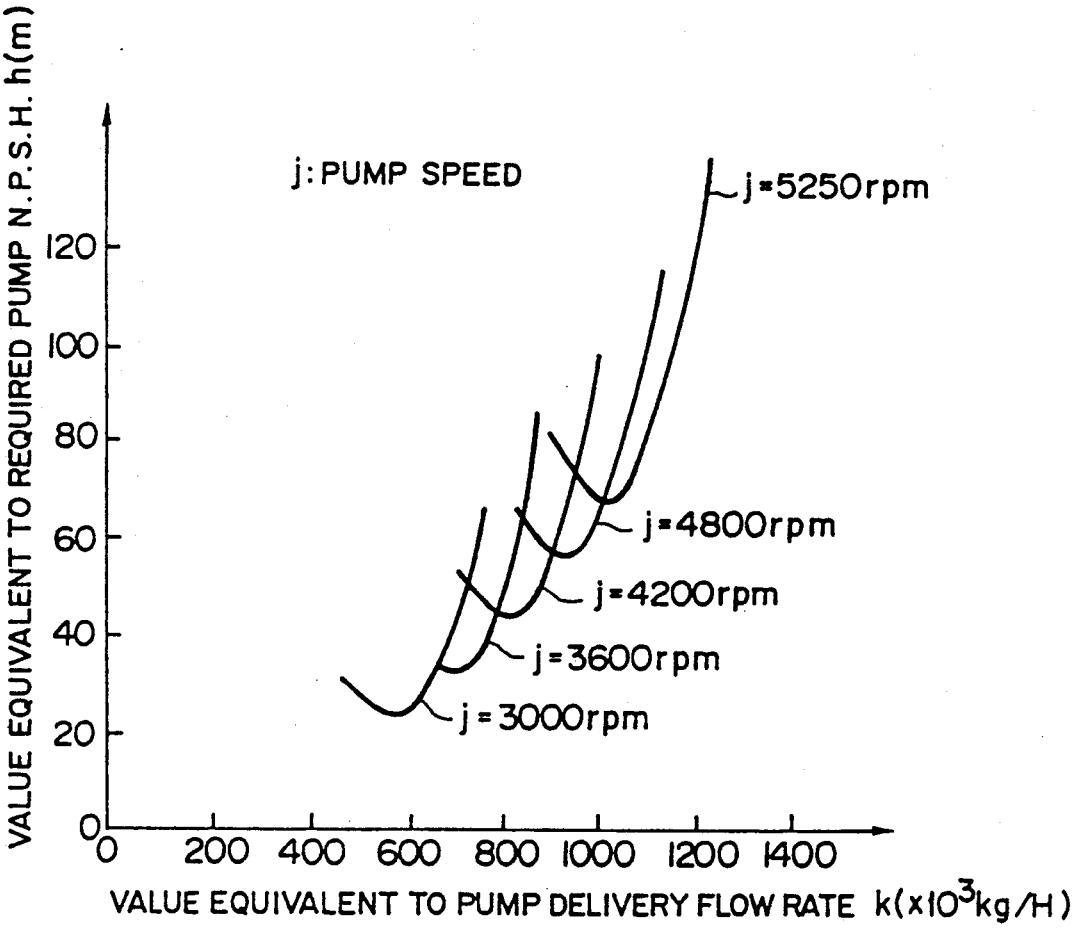
FIG. 27 is a graph showing the relationship between the pump delivery flow rate amount and the required N.P.S.H. value accompanying changes in the pump speed.

Furthermore, when a variable speed pump is used and delivery flow rate control of the pump is performed by speed control of the pump, the calculation of the required N.P.S.H. value for the pump can be performed according to FIG. 27 instead of according to that shown in FIG. 4. The curve for the delivery flow rate (or the suction flow rate) of the pump required N.P.S.H. of the pump is a function of the speed of the pump, as shown in FIG. 27. Accordingly, when the curve shown in FIG. 27 is used, then for example, the curve shown in FIG. 27 is input to the required N.P.S.H. input portion 16 shown in FIG. 3, and the measurement results for the speed of the pump are also input so that speed curve is selected from amongst a plural number of curves shown in FIG. 27 for the current speed, and the operation after this is the same as that described with reference to FIG. 3.

The D in $h=d+D$ described by the allowable flow rate calculation portion 41 of FIG. 3, the D in $h=d+D$ in FIG. 5, or the H in f (b) +H described for the graph for the required N.P.S.H. calculation portion 114 of the pumps in FIG. 16, FIG. 17, FIG. 18 and FIG. 20 are small numbers representing the surplus value. Accordingly, for example, when there is extremely good controllability of the control apparatus, the surplus values D or H can be made zero.

Furthermore, in the embodiments described above, the actual flow rate of the process liquid to the plant was described as being measured by a flow rate meter disposed on the upstream side of the flow rate adjuster valve but it is also possible to obtain the same effect if the flow rate meter is disposed on the downstream side of the flow rate adjuster valve, or on the suction side of the pump. In addition, there need not necessarily be a differential pressure type of flow rate meter, as for example, an electromagnetic type of flow rate meter, an ultrasonic type of flow rate meter or a flow rate meter that operates by some other principle of operation can alternatively be used.

However, in the case of the embodiment in the process piping system shown in FIG. 16, FIG. 17, FIG. 18 and FIG. 20, in order to establish the relationship available N.P.S.H. > required N.P.S.H.

there is no control of the delivery flow rate of the pump and so the actual flow rate value to the plant does not fall below the available N.P.S.H. (objective value) from the plant.

However, in the embodiment for the process piping system shown in flow rate limit signal FIG. 11, FIG. 12, FIG. 21 and FIG. 25, the case for when there is a plural number of pumps disposed in series, and even for the case for when there is one or a plural plural number of pumps disposed in parallel, if there is a flow rate adjuster valve 4 disposed after the confluence of the pumps, then in order to establish the relationship available N.P.S.H. > required N.P.S.H.

the only choice in certain cases is to make the actual flow rate value from the plant less than the required flow rate set value (objective value) from the plant.

On the other hand, in the embodiment shown in FIG. 1 and FIG. 10, when there is a plural number of pumps $2_{-1}$ to $2_{-n}$ disposed in parallel, when control for the degree of opening of a flow rate adjuster valve 4 disposed on the delivery side of the pump, or speed control for the pump is performed, then for as long as there is surplus so that maximum allowable flow rate > required flow rate set value (objective value)

for each of the pumps, it is possible to satisfy the relationship available N.P.S.H. > required N.P.S.H.

while making the actual flow rate value to the plant in agreement with the required flow rate set value (objective value) from the plant. However, if there is no surplus in the relationship maximum allowable flow rate > required flow rate set value (objective value) for all of the pumps, then establishing the relationship available N.P.S.H. > required N.P.S.H.

requires that there be control so that the actually measured value to the plant becomes less than the required flow rate set value (objective value) from the plant.

However, depending on the plant, there must be control so that the actually measured flow rate value to the plant becomes less than the required flow rate set value (objective value) from the plant even if there is temporary cavitation for example for certain plants.

Figure 28:
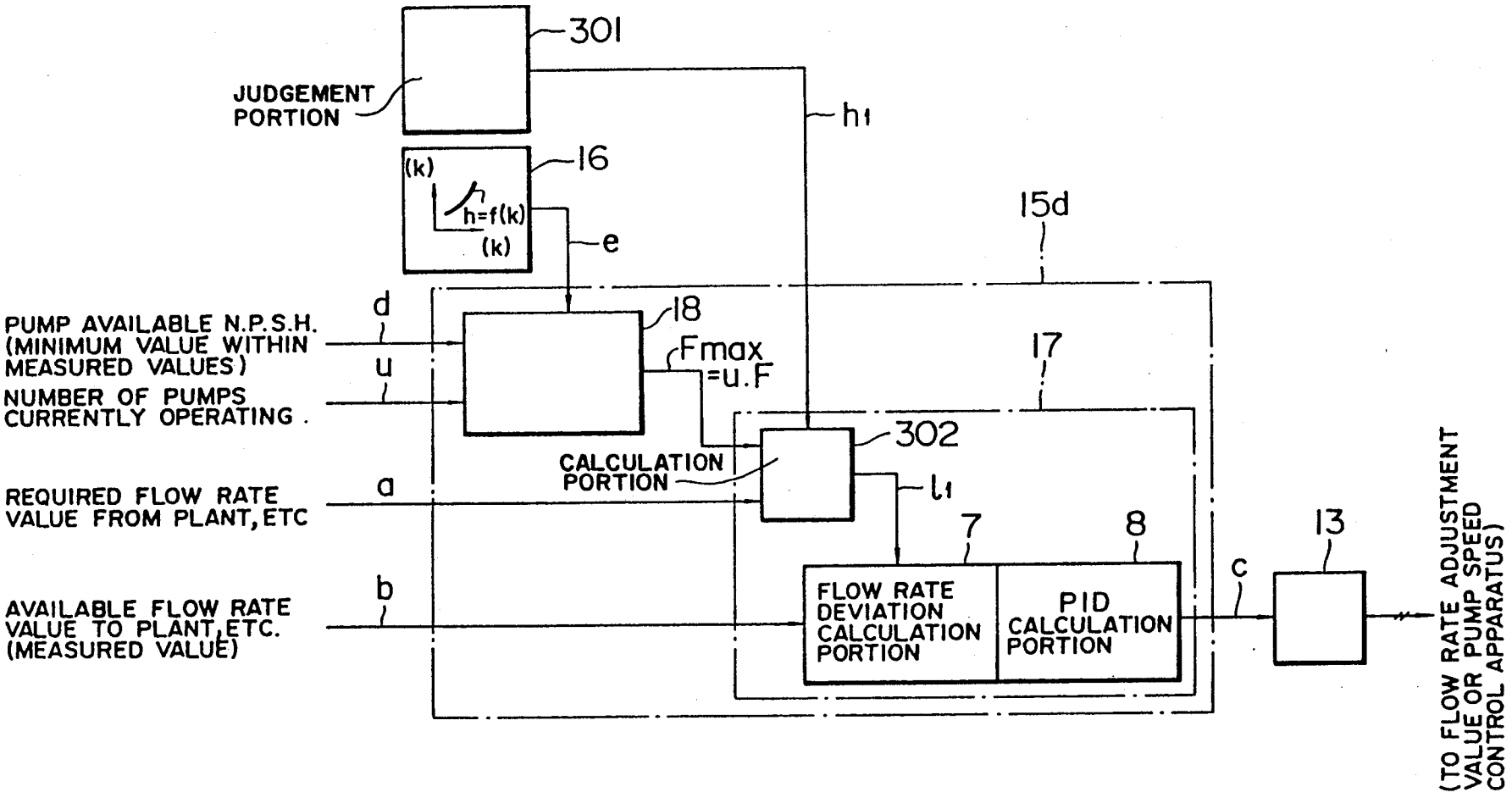
FIG. 28 through FIG. 30 show other embodiments, where

FIG. 28 shows a suitable embodiment used in a plant and the block diagram shown in FIG. 3, has been improved as described below.

More specifically, instead of the low-value priority portion 43 configuring the flow rate adjustment portion 15 of FIG. 3, the set value calculation portion 302 is configured using a flow rate adjuster 15*d*, and a flow rate restriction possible judgment portion 301 has been newly added so that the flow rate restriction possible signal $h_1$ for the pump and which is the output signal of this flow rate restriction possible judgment portion 301 is input to the set value calculation portion 302 and furthermore, the set value signal $1_1$ for the pump and which is this output signal, is input to the flow rate deviation calculation portion 7.

The following is a description of the operation of this embodiment.

In the same manner as the embodiment shown in FIG. 3, the available N.P.S.H. value d, the number of currently operating pumps u, and the required N.P.S.H. for the pump and from the required N.P.S.H. input portion 16 are input to the second calculation portion 18 and the total allowable maximum flow rate value Fmax (=u·F) for the currently operating pumps is calculated and output.

Here, the available N.P.S.H. value d is the minimum of the measured values but as in the embodiment shown in FIG. 10, when available N.P.S.H. measurement apparatus $19_{-1}$ to $19_{-n}$ are disposed to each of the pumps $2_{-1}$ to $2_{-n}$, the number of currently operating pumps u is 1 (u=1) as there is the available N.P.S.H. for the said pump. Accordingly, the total allowable maximum flow rate value Fmax in this case for the pumps that are currently operating is the allowable maximum flow rate value for one pump and is input to the set value calculation portion 302. On the other hand, the required flow rate set value "a" from the plant is also input to the set value calculation portion 302.

Here, the required flow rate set value "a" from the plant is, as shown in the embodiment in FIG. 10, the required N.P.S.H. value $a_x$ from the plant and with respect to the said pump (such as pump no. x, for example) when the required flow rate set values al through $a_n$ are calculated and output to each of the flow rate adjustment portions by a total flow rate adjustment portion 92 provided in order to perform control of the pump speed or the degree of opening of a flow rate adjuster valve provided on the delivery side of each of the pumps $2_{-1}$ to $2_{-n}$ process piping system in which a plural number of pumps $2_{-1}$ to $2_{-n}$ are disposed in parallel.

Furthermore, the flow rate restriction possible judgment portion 301 judges whether or not it is possible to restrict the delivery flow rate of the said pump, and these results are also input to the set value calculation portion 302 as the flow rate restriction possible signal $h_1$.

In the set value calculation portion 302, when the flow rate restriction possible signal $h_1$ is for flow rate restriction possible, the lower of the total allowable maximum flow rate value Fmax and the required flow rate set value "a" (such as $a_x$) from the plant and with respect to that pump is calculated and is output as the set value signal $1_1$ for that pump. Conversely, when the flow rate restriction possible signal $h_1$ is for flow rate restriction not possible, then irrespective of the value of the total allowable maximum flow rate value Fmax, the required flow rate set value "a" (such as $a_x$), from the plant and with respect to that pump is output as the set value signal $1_1$ for that pump. Then, this set value signal $1_1$ is input as the set value to the flow rate deviation calculation portion 7 that configures the first calculation portion 17.

On the other hand, the actual flow rate value (measured value) to the plant is also input to the flow rate deviation calculation portion 7 where the deviation between the two is calculated, and the control signal c is calculated in the PID calculation portion 8 and is output.

However, as in the embodiment shown in FIG. 10, there is provided a total flow rate adjustment portion 92 that calculates the available N.P.S.H. $a_1$ through $a_n$ to each of the flow rate adjustment portions, and when these are output to the set value calculation portion 302 of each of the pumps $2_{-1}$ to $2_{-n}$, the actual flow rate value (measured value) b to the plant becomes the actual flow rate values (measured values) $b_1$ through $b_n$ to the plant from each of the pumps.

Then, in the PID calculation portion 8, when the flow rate restriction possible signal $h_1$ for a pump is flow rate restriction possible, the lower of the total allowable maximum flow rate value Fmax for that pump and the required flow rate set value "a" from the plant and with respect to that pump is made the set value, and the signal c that performs control so that the actual flow rate value (measured value) b to the plant and from the pump is made this set value. Conversely, when the flow rate restriction possible signal $h_1$ is for flow rate restriction not possible, the required flow rate set value "a" from the plant with respect to that pump is made the set value, and the signal c that controls so that the actual flow rate value (measured value) b to the plant and from the pump is in agreement with this set value, is calculated and output.

Figure 29:
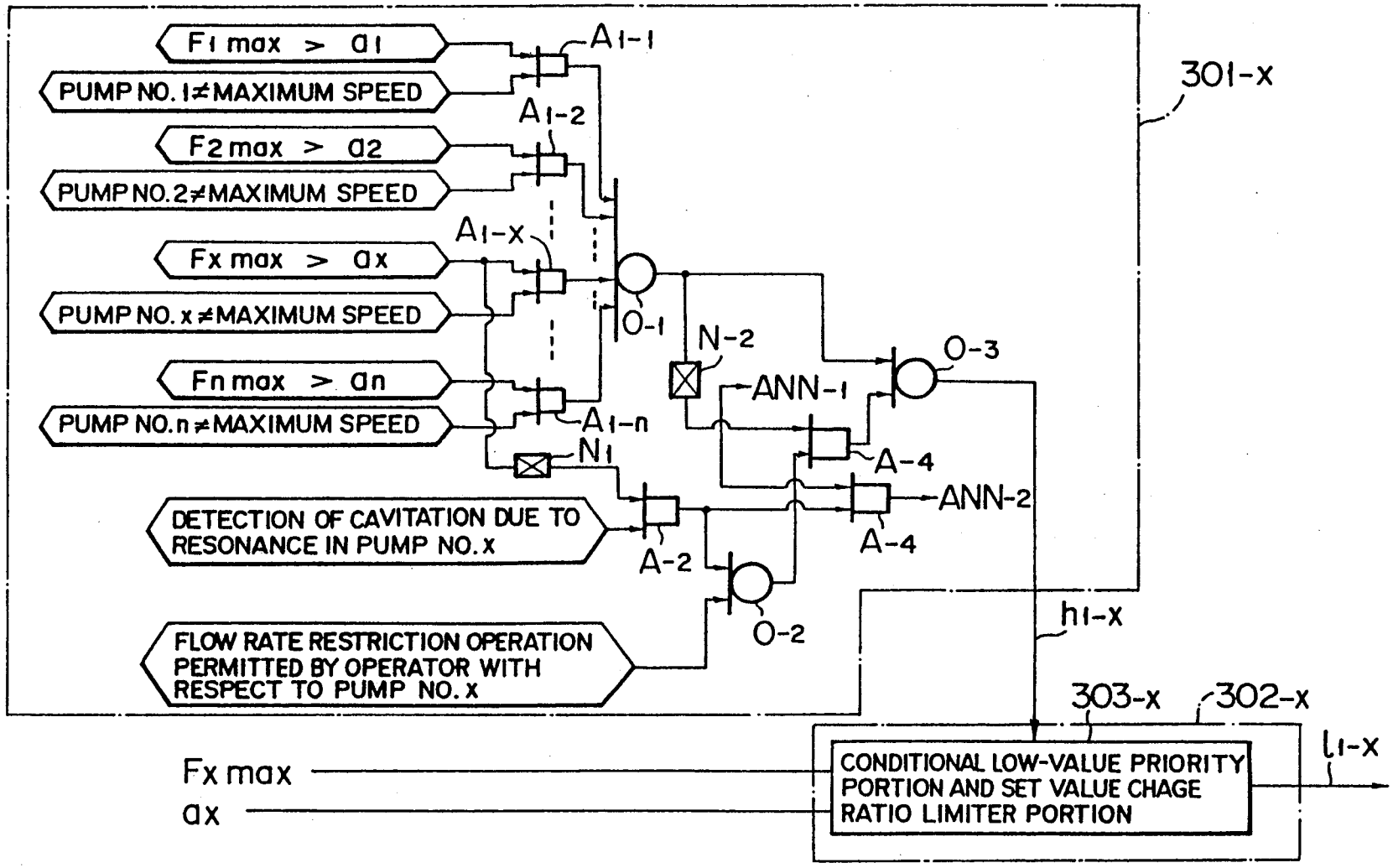
Figure 30:
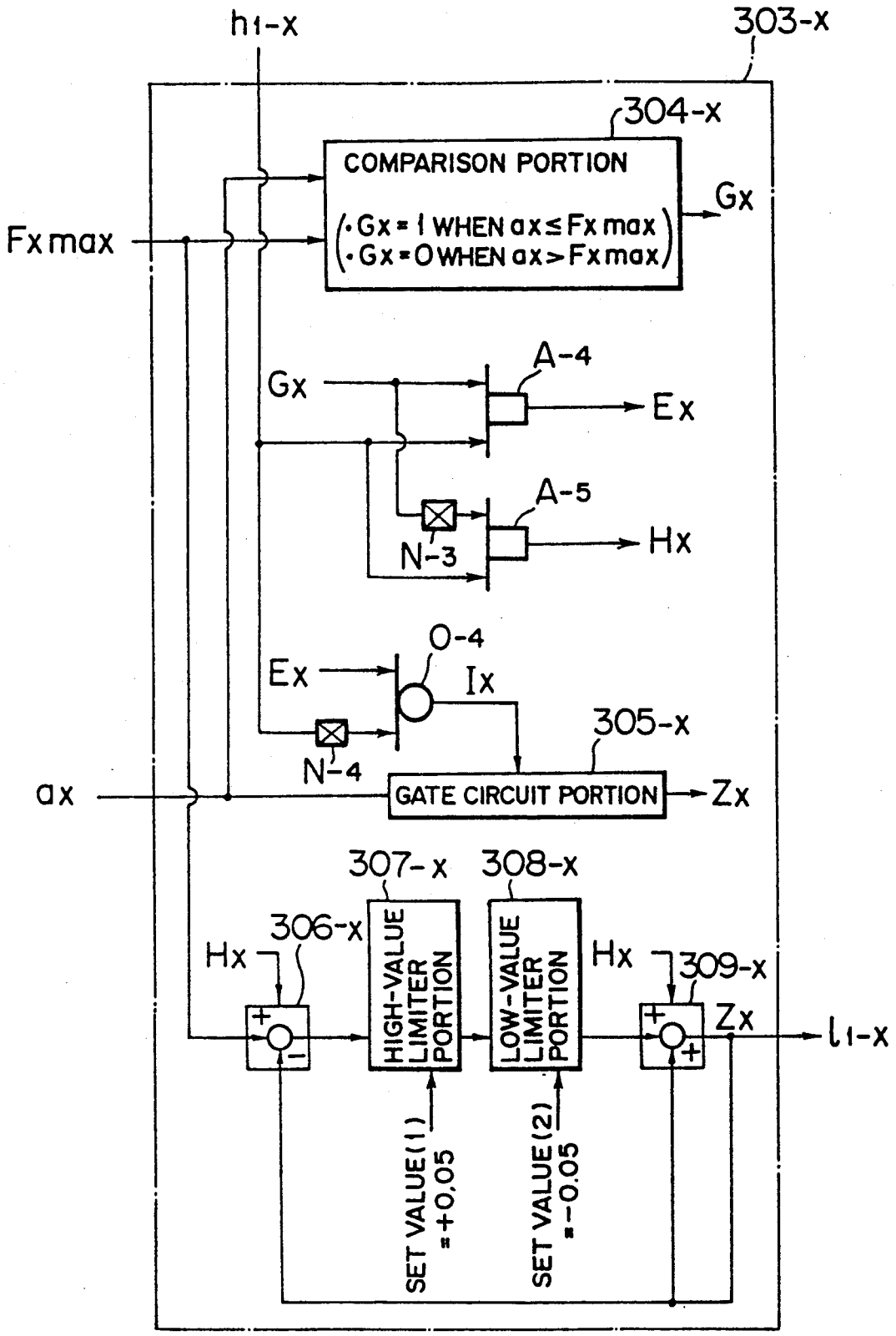

FIG. 29 and FIG. 30 show details of each portion of the configuration block diagram shown in FIG. 28.

FIG. 29 is a block diagram that shows details of the flow rate restriction possible judgment portion 301 and the set value calculation portion 302, and as in the embodiment shown in FIG. 10, there are provided a flow rate restriction possible judgment portion 301 and a set value calculation portion 302 in a process piping system where there is a plural number of pumps $2_{-1}$ to $2_{-n}$ disposed in parallel. Here, $301_{-x}$ denotes a flow rate restriction possible judgment portion for pump no. x, and $302_{-x}$ denotes a set value calculation portion for pump no. x.

The description will commence from the flow rate restriction possible judgment portion $301_{-x}$ for pump no. x.

The input signals to the set value calculation portion $302_{-x}$ from the second calculation portion 18, that is the total allowable maximum flow rate value Fmax (x=1 through n) for the pump no. x, and the required flow rate set value $a_x$ from the plant are used to obtain the following comparison equation:

total allowable maximum flow rate value Fmax for pump no. x > required flow rate set value $a_x$ from the plant The establishment of this comparison equation means that the relationship available N.P.S.H. > required N.P.S.H.

is still established.

On the other hand, in the present embodiment, pump speed control is performed as the method of controlling the delivery flow rate of the pump and so the speeds (measured values) for each of the pumps $2_{-1}$ to $2_{-n}$ are detected. Here, the maximum speed that is possible for pump operation is determined by the structure of the pumps $2_{-1}$ to $2_{-n}$ due to their design and manufacture and so the comparison equation pump no. x≠maximum speed reached when these two are compared. This comparison equation shows that the speed of pump no. x has not reached the maximum speed and so the speed of pump no. x can be further increased so that it is possible to increase the delivery flow rate to the plant.

Accordingly, the establishment of the logical product (AND circuit $A_{1-x}=1$) of the relationship total allowable maximum flow rate value Fxmax for pump no. x > required flow rate set value $a_x$ from plant and the relationship pump no. x ≠ maximum speed reached means that for pump no. x, it is possible to increase the delivery flow rate to the plant by increasing the speed even more, and at the same time establish the relationship available N.P.S.H. > required N.P.S.H.

Then, for each of the logical products (AND circuits $A_{1-1}$ through $A_{1-n}$) of the relationship equations described above, the establishment of the logical sum (OR circuit $O_{-1}=1$) for from pump no. 1 through pump no. n means that it is possible to increase the delivery flow rate to the plant by further increasing the speed while at the same time establishing the relationship available N.P.S.H. > required N.P.S.H.

for any of the pumps from pump no. 1 through pump no. n.

More specifically, for as long as this logical sum is established (i.e. the OR circuit $O_{-1}$ is 1), then for those pumps for which it appears likely that the relationship available N.P.S.H. < required N.P.S.H.

will be established, then even if the speed of the pump is for example reduced and the delivery flow rate to the plant in order to establish the relationship available N.P.S.H. > required N.P.S.H.

then, of the pumps from pump no. 1 through pump no. n., the speed can still be increased for those pumps for which the logical product (the AND circuit is 1) in the above described relationship and it is possible to supplement the insufficient portion described above.

This is to say that it is possible to perform control so that the actual flow rate value to the plant is made in agreement with the required flow rate set value (objective value) from the plant while at the same time performing control so that the relationship available N.P.S.H. > required N.P.S.H.

is established, and the flow rate restriction possible signal $h_{1-x}=1$ for the pump no. x is established.

On the other hand, if for the logical products (AND circuits $A_{1-1}$ through $A_{1-n}$) of the relationship equations described above, the non-establishment of the logical sum (OR circuit $O_{-1}=0$) for from pump no. 1 through pump no. n such as when, for example, there is a pump where the relationship available N.P.S.H. < required N.P.S.H.

appears that it will be established, then it is not possible to supplement the reduction portion described above by increasing the delivery flow rate to the plant by increasing the speed of any of the pumps for from any of the pumps from pump no. 1 through pump no. n so as to established the relationship available N.P.S.H. > required N.P.S.H.

More specifically, in cases such as this, it is not possible to perform control so that the relationship available N.P.S.H. > required N.P.S.H.

is always established, while at the same time performing control so that the actual flow rate value to the plant is made in agreement with the required flow rate set value (objective value) from the plant.

However, even in cases where the logical sum described above is not established (OR circuit $O_{-1}$ is zero), and for example, the relationship available N.P.S.H. < required N.P.S.H.

is established, and when flow rate restriction possible operation is performed by an operator with respect to a pump no. x after the detection of cavitation in pump no. x by the sound, the flow rate restriction possible signal $h_{1-x}$ for pump no. x is established via the NOT circuits $N_{-1}$, $N_{-2}$, AND circuits $A_{-2}$, $A_{-3}$ and OR circuits $O_{-2}$, $O_{-3}$ and priority is given to the protection of the pump (pump no. x), the speed of the pump can be reduced to reduce the delivery flow rate to the plant so as to establish the relationship available N.P.S.H. > required N.P.S.H.

even if the actual flow rate value to the plant, is for example, less than the required flow rate value (objective value) from the plant.

Moreover, when cavitation is detected by the sound in pump no. x, it is possible to provide a detection means such as that shown in FIG. 13 to detect the sound of cavitation in pump no. x when it reaches a set value of a size where there is destruction of the pump.

More specifically, the logical product of the detection of cavitation by the sound in pump no. x and available N.P.S.H. of pump no. x < required N.P.S.H. of pump is established (AND circuit $A_{-2}$ is 1) means that pump no. x is in a status where there is the occurrence of cavitation, and that the cavitation sound of pump no. x has reached a set value of a size that indicates destruction of the pump by cavitation.

In addition, flow rate restriction operation possible by an operator and with respect to the pump no. x is performed in cases such as when the operator becomes aware of the situation for pump no. x by a prior alarm signal, acknowledges that the actual flow rate value to the plant is less than the required flow rate set value (objective value) to the plant and takes measures to protect the pump no. x and allows the speed of the pump to be reduced so as to automatically and always establish the relationship available N.P.S.H. > required N.P.S.H.

and therefore reduce the delivery flow rate to the plant.

Then, the flow rate restriction possible signal $h_{1-x}$. for the pump no. x and which is the output signal from the flow rate restriction possible judgment portion 301$_{-x}$, is input to the conditional low-value priority portion and the set value change ratio control portion 303$_{-x}$ that configure the set value calculation portion 302 for the pump no. x.

To this conditional low-value priority portion and the set value change ratio control portion 303$_{-x}$ are input the total allowable maximum flow rate value $F_x$max for pump no. x and the required flow rate set value $a_x$ for pump no. x and from the plant.

Then, the set value signal 1$_{-x}$ for pump no. x is output form the conditional low-value priority portion and the set value change ratio control portion 303$_{-x}$ but when the flow rate restriction possible signal $h_{1-x}=1$ for pump no. x, the lower value of the total allowable maximum flow rate value $F_x$max for pump no. x and the required flow rate set value $a_x$ from the plant is made the set value and the required flow rate set value $a_x$ from the plant and with respect to the pump no. x is output as the set value when the flow rate restriction possible signal $h_{1-x}=0$ for the other pump no. x.

Moreover, when the flow rate restriction possible signal $h_{1-x}$, for the pump no. x changes from the status where it is 0, to the status where it is 1, such change may be performed in steps. In such cases, it is likely that there will be disturbance for the PID calculation portion 8 that has the set value signal $\mathbf{1}_{1-x}$ as the set value and so the conditional low-value priority portion and the set value change ratio control portion 303$_{-x}$ has a set value change ratio control portion so that the set value signal $\mathbf{1}_{1-x}$ for pump no. x changes gradually and not in steps.

FIG. 30 shows a detailed view of this conditional low-value priority portion and the set value change ratio control portion 303$_{-x}$, and which uses a digital calculator.

To the conditional low-value priority portion and the set value change ratio control portion 303$_{-x}$ are input the total allowable maximum flow rate value $F_x$max for pump no. x, the required flow rate set value $a_x$ from the plant, and the flow rate restriction possible signal $h_{1-x}$ for the pump no. x.

Then, first of all, the comparator portion 304$_{-x}$ for pump no. x compares the total allowable maximum flow rate value $F_x$max for pump no. x, the required flow rate set value $a_x$ from the plant and if $a_x \leqq F_x$max, and output signal $G_x=1$, $a_x>F_x$max, then the output signal $G_x=0$ is output.

In addition, the result of the logical product (AND circuit $A_{-4}$) of the flow rate restriction possible signal $h_{1-x}$ and the output signal $G_x$ is made $E_x$, the result of the logical product (AND circuit $A_{-5}$) of the denial of $h_{1-x}$, and $G_x$ (NOT circuit $N_{-3}$) is made $H_x$, and the result of the logical sum (OR circuit $O_{-4}$) of the denial of $h_{1-x}$ (NOT circuit $N_{-4}$) and $E_x$ is made $I_x$. Then, to the gate circuit portion 305$_{-x}$ for pump no. x are input $a_x$ and $I_x$, and $Z_x$ is output but when $I_x=1$, that gate is opened and the input $a_x$ is output as it is (that is, $Z_x=a_x$), and when $I_x=0$, the gate is closed and the input $a_x$ is not output.

On the other hand, the total allowable maximum flow rate value $F_x$max for pump no. x has addition calculation ($F_x$max$-Z_x$), performed with this total allowable maximum flow rate value $F_x$max for pump no. x and $-Z_x$ only when $H_x=1$, and is then output. However, when $H_x=0$, is input to the first adder portion 306$_{-x}$ for pump no. x and which has no output for any value. Then, this result is input to the high-value limiter portion 307$_{-x}$, When the input signal is greater than a predetermined set value (such as +0.05, for example) the high-value limiter portion 307$_{-x}$ outputs a value the same as that set value, and when the input signal is less than this, outputs the input signal as is. Then, this result is input to the low-value limiter portion 308$_{-x}$. When the input signal is less than a predetermined set value (such as −0.05, for example) the low-value limiter portion 308$_{-x}$ outputs a value the same as that set value, and when the input signal is greater than this, outputs the input signal as is.

Moreover, in this embodiment, the controllability of the delivery flow rate of the pump in an operating status and the process piping system are considered so that the set value for the high-value limiter portion 307$_{-x}$ is made for example +0.05, and so that the set value for the low-value limiter portion 308$_{-x}$ is made for example −0.05.

Then, this result has an addition calculation between $Z_x$ and the output value of the low-value limiter portion 308$_{-x}$ performed on when $H_x=1$, and when $H_x=0$, is input to the second adder portion 309$_{-x}$, for pump no. x and that has no output for any value. This result is output as the output signal of the conditional low-value priority portion and the set value change ratio control portion 303$_{-x}$, that is, as the set value signal $\mathbf{1}_{1-x}$ for pump no. x.

The following is a description of this operation.

When the digital calculator shown in FIG. 30 is used, if $a_x \leqq F_x$max (in this case, $G_x=1$), and $h_{1-x}=1$ (in this case, $E_x=1$, $H_x=0$) or $h_{1-x}=0$, then $I_x=1$ and so $Z_x=a$, is output from the gate circuit portion 305$_{-x}$ for pump no. x, and as a result, $a_x$ is output as the set value signal $\mathbf{1}_{1-x}$, for pump no. x.

On the other hand, if $a_{x>Fx}$max (in this case, $G_x=0$), and $h_{1-x}=1$ (in this case, $E_x=0$, $H_x=1$) then the calculation of $F_x$max and $Z_x$ is performed between the first calculation portion 306$_{-x}$ and the second calculation portion 309$_{-x}$, and as a result, the set value $\mathbf{1}_{1-x}=F_x$max for pump no. x is output, but the change ratio when there is the change from this $a_x$ to $F_x$max changes for increments of more than −0.05 and less than +0.05 for each calculation cycle of the digital calculator.

More specifically, if the digital calculator shown in FIG. 30 is used, then, when the flow rate restriction possible signal $h_{1-x}$ for pump no. x is $h_{1-x}=1$, the value which is the smaller of the required flow rate set value $a_x$ from the plant and with respect to the pump no. x and the total allowable maximum flow rate value $F_x$max is output, and when $h_{1-x}=0$, and there is the change from the status where $h_{1-x}=0$ to the status where $h_{1-x}=1$, there are instances where $\mathbf{1}_{1-x}$ changes in steps and this step change may cause disturbance to the PID calculation portion 8 but this can be prevented if the change from $a_x$ to $F_x$max is made gradually.

Figure 31:
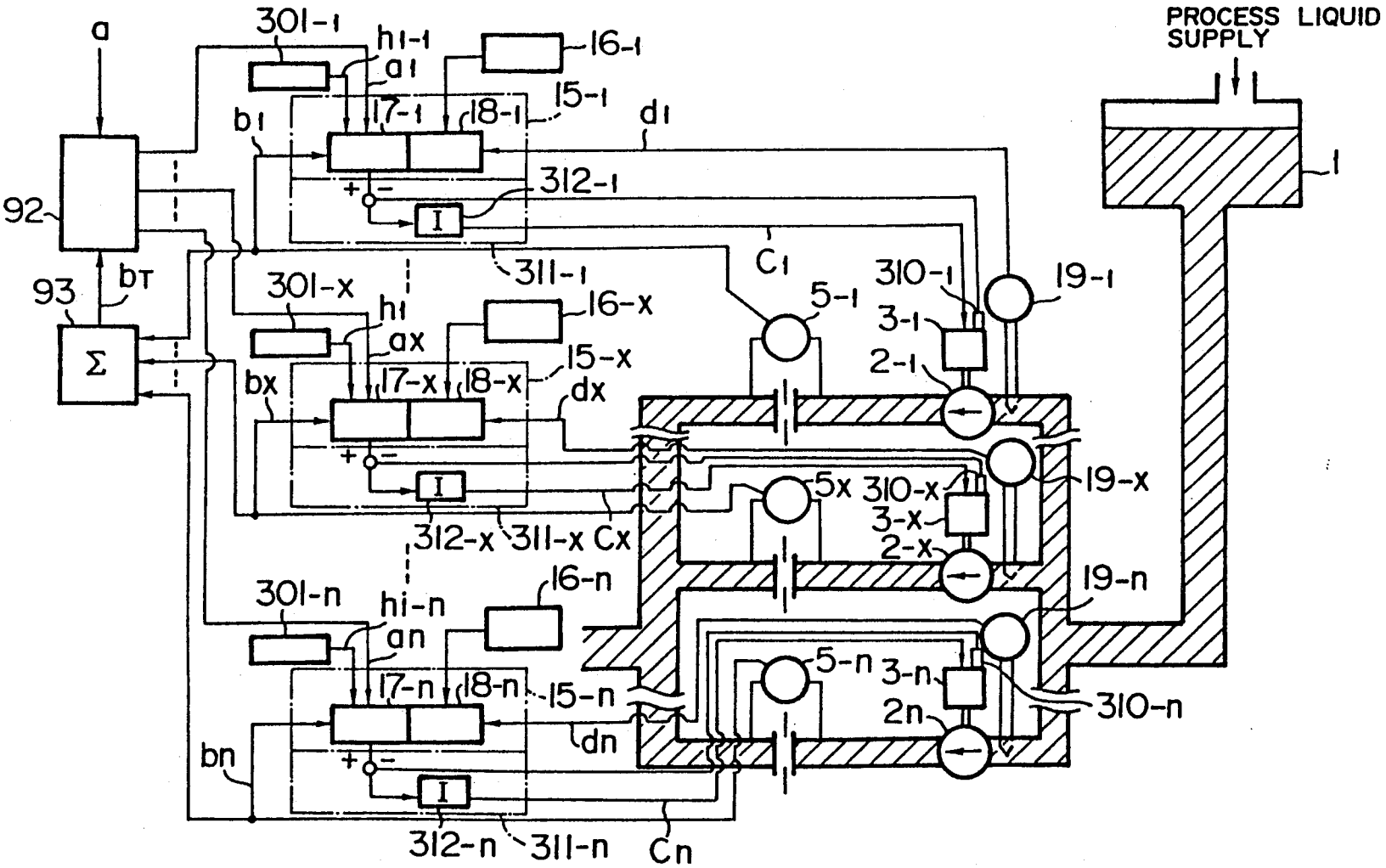
FIG. 31 is a system diagram.

FIG. 31 shows a system diagram for the case where the embodiments shown in FIG. 28 through FIG. 30 have been applied, in the case where, in the process piping system shown in FIG. 10 there are disposed a plural number of pumps 2$_{-1}$ to 2$_{-n}$ in parallel, where speed control for each of the pumps 2$_{-1}$ to 2$_{-n}$ is performed, and where a total flow rate adjustment portion 92 is provided to calculate the required flow rate set value $a_1$ through $a_n$ to each of the flow rate adjustment portions and output it to the set value calculation portion 302. However, in this Figure, the flow rate restriction possible judgment portion 301$_{-x}$ for pump no. x in FIG. 29, the condition of the detection of cavitation in pump no. x by sound is deleted.

In addition, in the same Figure, in order to improve the controllability of the required flow rate set value $a_1$ through $a_n$ of the pump, both of the output signals for the first calculation portion 17$_{-x}$(x=1 through n), and the actual speed detected by the speed detector portions 310$_{-1}$ through 310$_{-n}$ for each pump and mounted to each of the pumps $a_1$ through $a_n$ have deviation calculation first performed by the rotation feedback calculation portions 311$_{-1}$ through 311$_{-n}$ for each pump and then the result of the performance of integration calculation by the integration calculation portions 312$_{-1}$ through 312$_{-n}$ for each pump is input to the pump drive apparatus 3$_{-1}$ through 3$_{-n}$ for each pump as the speed control signals $C_1$ through $C_n$ to each pump.

The use, in this manner, of the rotation feedback calculation portions 311$_{-1}$ through 311$_{-n}$ for each pump, can perform feedback calculation by integration so that the output signals of the first calculation portion 17$_{-x}$ (x=1 through n) and the actual speed of each pump are in agreement.

Accordingly, if the embodiments described above are used, then it is of course possible to obtain the same effect as the embodiment shown in FIG. 10, and in addition, as shown in FIG. 31 in a piping system where a plural number of pumps 2$_{-1}$ to 2$_{-n}$ are disposed in parallel, in a pump delivery flow rate control apparatus disposed on the delivery side of the pumps and that performs speed control of a pump or flow rate control, when there is pump delivery flow rate control with the required flow rate set value from the plant as the objective value, then as long as there is surplus in the relationship maximum allowable flow rate > required flow rate set value (objective value)

for any of the pumps, it is possible to automatically perform control so that the actual flow rate value to the plant is brought into agreement with the required flow rate set value (objective value) from the plant while at the same time always establishing the relationship available N.P.S.H. > required N.P.S.H.

More specifically, for those pumps where it appears likely that the relationship available N.P.S.H. < required N.P.S.H.

will not be established, the speed of those pumps is either reduced or the degree of opening of the flow rate control valve provided to the delivery side is restricted so that the delivery from the pump to the plant is reduced and so that the relationship available N.P.S.H. > required N.P.S.H.

is always established.

On the other hand, by increasing the speed or further opening as described above of the flow adjustment valve provided on the delivery side of those pumps for which there is a surplus in the relationship maximum allowable flow rate > required flow rate set value (objective value), increases the flow to the plant and supplements the reduction portion, and enables control so that the total actual flow rate value to the plant is brought into agreement wit the required flow rate set value (objective value) from the plant.

Furthermore, when there is no more surplus for maximum allowable flow rate > required flow rate set value (objective value), for all pumps then when the relationship available N.P.S.H. > required N.P.S.H.

is established for as many pumps as is possible, then with respect to the remaining pumps there is control so that the total actual flow rate value to the plant is made equal to the required flow rate set value (objective value) from the plant even if the relationship available N.P.S.H. < required N.P.S.H.

is established for a pump, for as long as the flow rate restriction possible signal is not given because of impending pump destruction due to cavitation and as has been empirically judged by an operator.

However, for example, if the relationship available N.P.S.H. < required N.P.S.H.

is established for a specific pump and cavitation to a degree that will actually cause pump destruction occurs and the flow rate restriction possible signal is output, or when there is operation by the close monitoring of the situation for the pump by an operator and it is judged that there are conditions that the pump cannot withstand and when the total available flow rate value to the plant can even be below the required flow rate set value (objective value) from the plant and there is manual operation so as to output the flow rate restriction possible signal or when some other registered flow rate restriction possible signal is output, then it is possible for the delivery flow rate for pumps where available N.P.S.H. > required N.P.S.H.

is automatically restricted and there is control of the delivery flow rate of the pump so as to establish the relationship available N.P.S.H. > required N.P.S.H.

Moreover, in this case, the available flow rate value to the plant is controlled to be beneath the required flow rate set value (objective value) from the plant but it is possible for the operator to recognize beforehand via an alarm or the like when such conditions are about to occur and so it is possible for such countermeasures to be taken beforehand.

Accordingly, for example, even when there is temporary cavitation, there is the extremely great effect for the plant of having to perform control so that the available delivery flow rate value to the plant is in agreement with the required flow rate set value (objective value).

Furthermore, when there is no more surplus so that maximum allowable flow rate > required flow rate set value (objective value)

for all pumps, then when the flow rate restriction possible signal is output, there begins automatic restriction of the delivery flow rate for pumps where available N.P.S.H. < required N.P.S.H.

but when this is done, the set value for flow rate control of the delivery flow rate control apparatus for that pump may change in steps but a conditional low-value priority portion and the set value change ratio control portion can be built in so that this set value can be changed gradually so that it does not change in stages and so that disturbance to the control is prevented.

In the embodiment shown in FIG. 31, the description was given for the example of the case when speed control is performed for the pump but it is also possible to have degree of opening control of a flow rate adjuster valve that is disposed on the delivery side of the pump.

In this case, the speed (measured value) of each of the pumps in the flow rate restriction possible judgment portion 301$_x$ of the pump no. x in FIG. 29 is judged and instead of the proportional equation pump no. x $\neq$ maximum speed reached the degree of opening of each of the flow rate adjuster valves is detected and the proportional equation flow rate adjuster valve for pump no. x $\neq$ fully open instead.

In addition, when degree of opening control of the flow rate adjuster valve is performed, a feedback mechanism is generally built into the flow rate adjuster valve itself and so the rotation feedback calculation portions 311$_1$ through 311$_n$ need not necessarily be provided for each of the pumps shown in FIG. 31.

On the other hand, when speed control is performed for the pump, the available speed detected by the speed detector portions 310$_1$ through 310$_n$ for each pump, and the output signals from the first calculation portion 17$_x$ (x = 1 through n) first have deviation calculation performed at the rotation feedback calculation portions 311$_1$ through 311$_n$ and, then there can be a speed feedback portion so that the results of performing integration calculation at the integration calculation portions 312$_{-1}$ through 312$_{-n}$ are input to each of the pump drive apparatus 3$_{-1}$ through 3$_{-n}$ as the speed control signals $c_1$ through $c_n$ to each pump.

Moreover, in this embodiment, a feedback calculation portion and an integration calculator were used but the present invention is not limited to this, as a proportional or a differential calculation can be used instead.

In addition, the description was given for when for all pumps there is no more surplus in maximum allowable flow rate > required flow rate set value (objective value)

as the establishment condition for the flow rate restriction possible signal $h_{1-x}$ for the flow rate restriction possible judgment portion 310$_{-x}$ for the pump no. x of FIG. 29, the relationship available N.P.S.H. of pump no. x < required N.P.S.H.

is established and when cavitation is detected by sound for pump no. x, or when there is the input of restriction possible operation by the operator and with respect to pump no. x, but the present invention is not limited to this, as it is also possible to append other conditions as well.

In addition, the logical sum (OR circuit $O_{-1}$) for from the pump no. 1 through pump no. x, for the logical product (AND circuit $A_{1-1}$ through $A_{1-n}$) of the relationship total allowable maximum flow rate value $F_x$max > required flow rate set value $a_x$ and the relationship pump no. x $\neq$ maximum speed reached, as the establishment conditions for the flow rate restriction possible signal $h_{1-x}$, was provided for each of the pumps in this embodiment but it is also possible to provide only one circuit which is shared.

Furthermore, in this embodiment, as shown in FIG. 30, one example of the set value calculation portion 302$_{-x}$ for pump no. x was shows when configured from a conditional low-value priority portion and the set value change ratio control portion 303$_{-x}$ using a digital calculation portion; but this need not necessarily be so, since for example, when the flow rate restriction possible signal $h_{1-x}$ for pump no. x indicates that flow rate restriction is possible, and it appears that available N.P.S.H. < required N.P.S.H.

will be established for a pump, then in order that the relationship available N.P.S.H. > required N.P.S.H.

always be established, the lower of the values of required flow rate set value $a_x$ from the plant and the total allowable maximum flow rate value $F_x$max from the plant (for pump no. x) is calculated and this is output as the set value signal $1_{1-x}$, for pump no. x, while on the other hand, when the flow rate restriction possible signal $h_{1-x}$ for pump no. x has a flow rate restriction appended to it, then there is the same effect if there is a function so that the required flow rate set value $a_{-x}$ for pump no. x is output as the set value signal $1_{1-x}$ for any value of total allowable maximum flow rate value $F_x$max for that pump (pump no. x).

In addition, when there is only one pump as in the case of the embodiments shown in FIG. 11, FIG. 12, FIG. 21 and FIG. 25, when there is a plural number of pumps disposed in series, when there is a plural number of pumps disposed in parallel, or when there is a flow rate adjuster valve after the point of confluence when there is a plural number of pumps disposed in parallel, and when the embodiment shown in FIG. 28 through FIG. 30 is applied, and there is no other choice but to perform control so that the available flow rate value to the plant becomes less than the required flow rate set value (objective value) from the plant in order to establish the relationship available N.P.S.H. > required N.P.S.H.

the operator recognizes via an alarm or the like that there is such a situation and manually performs an operation so as to output the flow rate restriction possible signal, thereby enabling prior handling of this.

In each of the embodiments described above, the description was given for a PID calculation portion 8 used in the first calculation portion 17 of the flow rate adjustment portion 15. Instead of this, it is also possible to input the control parameters and their objective values, and time differential values and the like so that it is possible for a controller that applies them to be incorporated when an operator is running the plant.

Figure 32:
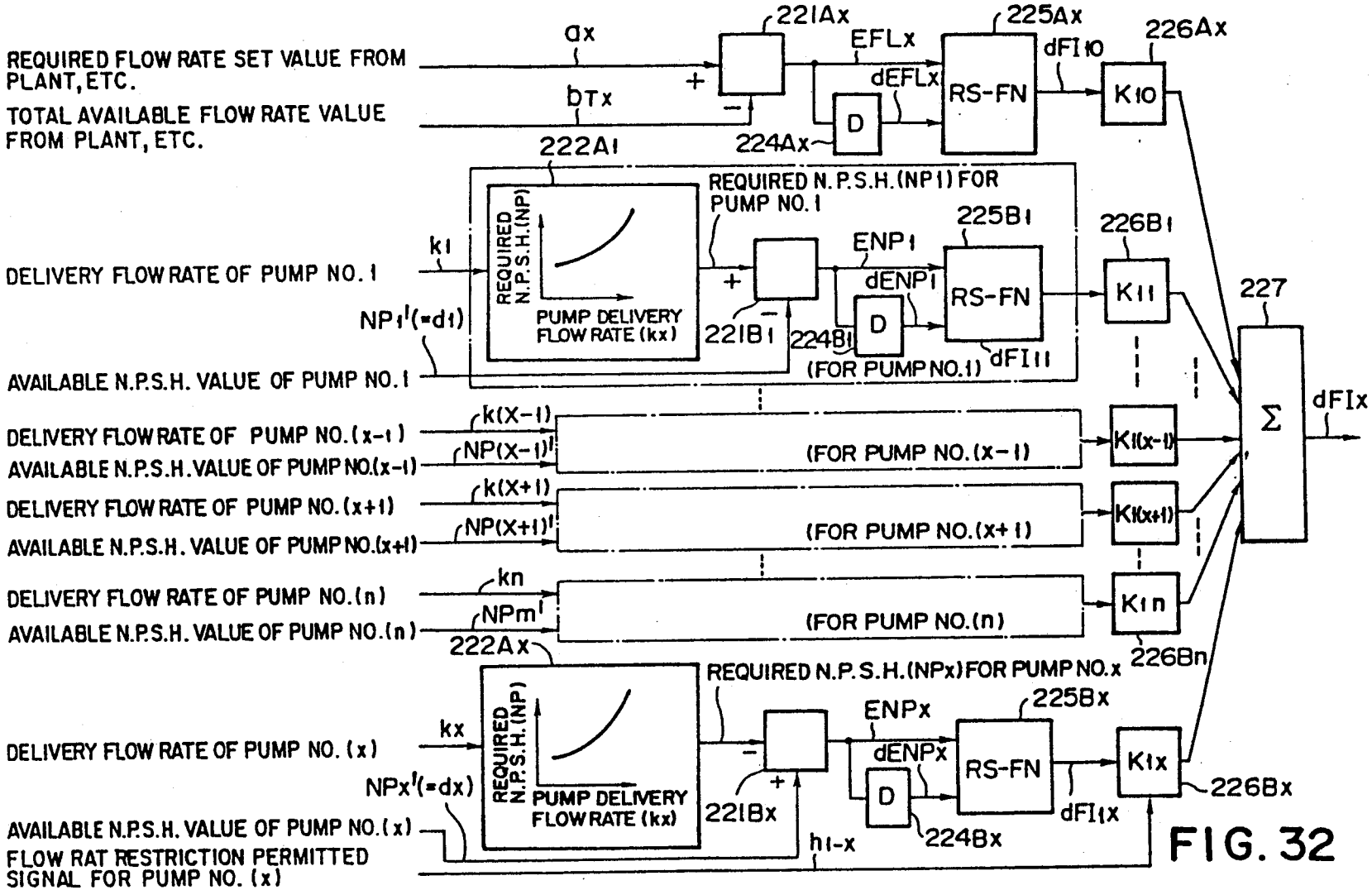
FIG. 32 is a block diagram of another embodiment of the flow rate adjuster portion.

FIG. 32 shows one example of this.

In a process piping system where a flow rate adjustment portion as shown in FIG. 32 performs control of the speed of a pump or a flow rate adjuster valve disposed on the delivery side of each pump when a plural number of pumps 2$_{-1}$ to 2$_{-n}$ are disposed in parallel as shown in FIG. 31, it is possible to use the flow rate adjustment portion as the flow rate adjustment portion 15$_{-1}$ through 15$_{-n}$ of the delivery flow rate control apparatus of the pumps.

When for example, an operator operates the plant of the process piping system:

(a) When the total available flow rate value to the plant is extremely small when compared to the required flow rate value from the plant, then for those pumps for which there is a surplus in the relationship available N.P.S.H. > required N.P.S.H.

the delivery flow rate is quickly increased in accordance with that surplus value and the difference between the total available flow rate value and the required flow rate set value. Then, when the total available flow rate value to the plant has either approached the required flow rate value from the plant, or is relatively distant and the approach speed is too fast or when there is no surplus left in the relationship equation available N.P.S.H. > required N.P.S.H.

for that pump (such as pump no. x in the case of the controller for pump no. x), or when the change ratio is too large even when there is a surplus, and the amount of increment of the delivery flow rate is made smaller in accordance with this.

(b) When any of the pumps other than the pump in question and the relationship available N.P.S.H. < required N.P.S.H.

has become established, then if there is a sufficient surplus in the relationship available N.P.S.H. > required N.P.S.H.

in that pump to the degree to which both the available N.P.S.H. and the required N.P.S.H. are large, then the delivery flow rate of that pump is quickly increased in accordance with the surplus value and the difference described above. Then, when the difference between the available N.P.S.H. and the required N.P.S.H. in the relationship for the pump other than the pump in question and for which the relationship available N.P.S.H. < required N.P.S.H.

is established, has become smaller or when the change ratio is still relatively large even if the difference between the two is still relatively large, and there is no surplus in the relationship available N.P.S.H. > required N.P.S.H.

or when there is still a large change ratio even if there is a relative surplus, the increase amount of the delivery flow rate is decreased in accordance with this.

(c) If, in the pump in question, the establishment of the relationship available N.P.S.H. < required N.P.S.H.

has begun, then for as long as the flow rate restriction possible signal is input to that pump, the described above flow rate to that pump is quickly restricted in accordance with the difference between the two. Then, when the difference between the two has become small or when there is a large change ratio even if the difference between the two is still comparatively large, the amount of restriction of the delivery flow rate is made smaller in accordance with this.

This control rule for plant operation such as this by an operator is taken as the flow rate adjustment portion 15$_{-1}$ through 15$_{-n}$ of FIG. 31 so that it is possible to obtain the flow rate adjustment portion output signal in order to perform speed control of the pump or degree of opening control of the flow rate valves provided on the delivery side of each pump.

The following will be a description of the configuration of one example of the flow rate adjustment portion 15$_{-x}$ for pump no. x.

To the adder 221X$_x$ that is provided to the flow rate adjustment portion 15$_{-x}$ are input the required flow rate set value $a_x$ from the plant and the total available flow rate value $b_{Tx}$ to the plant.

In addition, the delivery flow rate $k_1$ of pump no. 1 through the delivery flow rate $k_{(x-1)}$ of pump no. x−1, the delivery flow rate $k_{(x+1)}$ of pump no. x+1 through the delivery flow rate $k_n$ of pump no. n, and the available N.P.S.H. $NP_1'$ of pump no. 1 through the available N.P.S.H. $NP(_{x-1})$ of pump no. (x−1), and the available N.P.S.H. $NP(_{x-1})$ of pump no. (x+1) through the available N.P.S.H. $NP_x'$ of pump no. n are each input for pumps other than the pump in question (pump no. x), and furthermore, the delivery flow rate $k_x$ for pump no. x, the available N.P.S.H. $NP_x'$ and the flow rate restriction possible signal $h_{1-1}$ are input for the pump in question.

Here, the delivery flow rate $k_1$ of pump no. 1 through the delivery flow rate $k_{(x-1)}$ of pump no. x−1 and the delivery flow rate $k_{(x+1)}$ of pump no. x+1 through the delivery flow rate $k_n$ of pump no. n are input to the function memories 222A$_1$ through 222A$_{(x-1)}$ and 222A$_{(x+1)}$ through 222A$_n$ for the delivery flow rate - required N.P.S.H. value curves of the pump and the output, that is, the available N.P.S.H. $NP_1'$ of pump no. 1 through the available N.P.S.H. $NP(_{x-1})'$ of pump no. (x−1), and the available N.P.S.H. $NP(_{x+1})'$ of pump no. (x+1) through the available N.P.S.H. $NP_n'$ of pump no. n are each input for pumps other than the pump in question (pump no. x), and furthermore, the delivery flow rate $k_x$ for pump no. x, the available N.P.S.H. $NP_x'$ and the flow rate restriction possible signal $h_{1-1}$ are input for the pump in question.

Here, the delivery flow rate $k_1$ of pump no. 1 through the delivery flow rate $k_{(x-1)}$ of pump no. x−1 and the delivery flow rate $k_{(x+1)}$ of pump no. x+1 through the delivery flow rate $k_n$ of pump no. n are input to the function memories 222A$_1$ through 222A$_{(x-1)}$ and 222A$_{(x+1)}$ through 222A$_n$ for the delivery flow rate required N.P.S.H. value curves of the pump and the output, that is, the required N.P.S.H. $NP_1$ through $NP_{(x-1)}$ and $NP_{(x+1)}$ through $NP_n$ are made the objective values and input to the adders 221B$_1$ through 221B$_{(x-1)}$ and 221B$_{(x+1)}$ through 221B$_n$. On the other hand, the available N.P.S.H. $NP_1'$ of pump no. 1 through the available N.P.S.H. $NP_{(x-1)}'$ of pump no. (x−1), and the available N.P.S.H. $NP_{(x+1)}'$ of pump no. (x+1) through the available N.P.S.H. $NP_n'$ of pump no. n are also input to the adders 221B through 221B$_{(x-1)}$ and 221B$_{(x+1)}$ through 221B$_n$.

In addition, the respectively $k_x$ of pump no. x is input to the function memory 222A$_x$ for the delivery flow rate - required N.P.S.H. value curves of the pump no. x and that output is input to the adder 221B$_x$ having the available N.P.S.H. value $NP_x$ as the objective value. 0n the other hand, the available N.P.S.H. $NP_x'$ for pump no. x is also input to the adder 221B$_x$.

Then, in each of the adders 221A$_x$, 221B$_1$ through 221B$_{(x-1)}$, 221B$_{(x+1)}$ through 221B$_n$ and 221B$_x$ are calculated the following deviations between each of the set values (objective value) that are input and the actually measured values $$EFL_x = a_x - b_{T1}$$
$$ENP1 = NP1 - NP1'$$

$$\downarrow$$

$$ENP_{(x-1)} = NP_{(x-1)} - NP_{(x-1)}'$$
$$ENP_{(x+1)} = NP_{(x+1)} - NP_{(x+1)}'$$

$$\downarrow$$

$$ENP_n = NP_n - NP_n'$$
$$ENP_x = NP_x - NP_x'$$

(where $EFL_x$, ENP1 through $ENP_{(x-1)}$, $ENP_{(x+1)}$ through $ENP_n$ and $ENP_x$ are referred to generically as e, when no distinction is to be made between them).

Then, the results are input to each of the controllers 225A$_x$, 225B$_1$ through 225B$_{(x-1)}$, 225B$_{(x+1)}$ through 25BN and 225B$_x$ and at the same time to each of the differentiators 224A$_x$, 224B$_1$ through 224B$_{(x-1)}$, 224B$_{(x+1)}$ through 224BN and 224B, where the following time differentials of each of these deviations are calculated as $$dEFL_x = dEFL_x/dt$$
$$dENP_1 = dENP_1/dt$$
$$\downarrow$$
$$dENP_{(x-1)} = dENP_{(x-1)}/dt$$
$$dENP_{(x+1)} = dENP_{(x+1)}/dt$$
$$\downarrow$$
$$dENP_n = dENP_n/dt$$
$$dENP_x = dENP_x/dt$$

(where $dEFL_x$, $dENP_1$ through $dENP_{(x-1)}$, $dENP_{(x+1)}$ through $dENP_n$ and $dENP_x$ are referred to generically as $\Delta e$, when no distinction is to be made between them).

Then, these calculation results are also input to each of the controllers 225$A_x$, 225$B_1$ through 225$B_{(x-1)}$, 225$B_{(x+1)}$ through 225BN and 225$B_x$.

By this, to each of the controllers 225$A_x$, 225$B_1$ through 225$B_{(x-1)}$, 225$B_{(x+1)}$ through 225BN and 225$B_x$ are also input the deviations for each of the status amounts, and the differential values $\Delta e$ for the deviations, and each of the output signals $\Delta u$ is calculated on the basis of control rules that are the same as those in the embodiment shown in FIG. 22.

In FIG. 32, the numerals 226$A_x$, 226$B_1$ through 226$B_{(x-1)}$, 226$B_{(x+1)}$ through 226BN and 226$B_x$ are variable gain proportionators that can change the gain according to the plant load. In this example, the gain is substantially constant across the full load band of the plant. In addition, the flow rate restriction possible signal $h_{1-x}$ for pump no. x is input to the variable gain proportionator 226$B_x$ in order to turn this variable gain ON and OFF.

In addition, the numeral 227 is an adder that adds the total available flow rate value to the plant, to each of the control outputs relating to the available N.P.S.H. values for pump no. 1 through no(x+1) and no(x+1) through no. n, and pump no. x., and the output from this adder 227 is used as the output of the flow rate adjustment portion 15.$_1$ through 15.$_n$.

In the configuration described above, the required flow rate set value $a_x$ from the plant is input as the set value (objective value). In addition, the required flow rate set value ax from the plant is input as a set value (objective value). In addition, the available N.P.S.H. $NP_1'$ of pump no. 1 through the available N.P.S.H. $NP_{(x-1)}'$ of pump no. (x−1), and the available N.P.S.H. $NP_{(x+1)}'$ of pump no. (x+1) through the available N.P.S.H. $NP_n'$ of pump no. n from the delivery flow rate $k_1$ of pump no. 1 through the delivery flow rate $k_{(x-1)}$ of pump no. x−1 and the delivery flow rate $k_{(x-1)}$ of pump no. x+1 through the delivery flow rate $k_n$ of pump no. n are calculated as set values. Also, the available N.P.S.H. value $NP_x$ of pump no. x and from the delivery flow rate of the currently operating pump no. x is calculated as a set value (objective value).

In each of the calculators 221$X_x$, 221$B_1$ through 221$B_{(x-1)}$, 221$B_{(x+1)}$ through 221$B_n$ and 221$B_x$, each of these set values (objective values) is compared with the total available flow rate value $b_{Tx}$ to the plant and which is the actual current status value of the process piping system, the available N.P.S.H. $NP_1'$ of pump no. 1 through the available N.P.S.H. $NP_{(x-1)}'$ of pump no. (x−1), the available N.P.S.H. $NP_{(x+1)}'$ of pump no. (x+1) and the available N.P.S.H. $NP_n'$ of pump no. n and the available N.P.S.H. $NP_x$ of pump no. x are compared and the feedback deviations $$EFL_x = a_x - b_{T1}$$
$$ENP_1 = NP_1 - NP_1'$$
$$\downarrow$$
$$ENP_{(x-1)} = NP_{(x-1)} - NP_{(x-1)}'$$
$$ENP_{(x+1)} = NP_{(x+1)} - NP_{(x+1)}'$$
$$\downarrow$$
$$ENP_n = NP_n - NP_n'$$
$$ENP_x = NP_x - NP_x'$$

Then, the results are input to each of the differentiators 224$A_x$, 224$B_1$ through 224$B_{(x-1)}$, 224$B_{(x+1)}$ through 224BN and 224$B_x$ where the following time differentials of each of these deviations are calculated as $$dEFL_x = dEFL_x/dt$$
$$dENP_1 = dENP_1/dt$$
$$\downarrow$$
$$dENP_{(x-1)} = dENP_{(x-1)}/dt$$
$$dENP_{(x+1)} = dENP_{(x+1)}/dt$$
$$\downarrow$$
$$dENP_n = dENP_n/dt$$
$$dENP_x = dENP_x/dt$$

Then, these deviations e and the differential values $\Delta e$ of these deviations are input to the corresponding controllers, that is, $e=EFL_x$ and $\Delta e=dEFL_x$ are input to controller 225$A_x$, each $e=ENP_1$ through $ENP_{(x-1)}$ and each $\Delta e$ $dENP_1$ through $dENP_{(x-1)}$ to each of the controllers 225$B_1$ through 225$B_{(x-1)}$ and each $e=ENP_{(x+1)}$ through $ENP_n$ and each $\Delta e=dENP_{(x+1)}$ through dEPN are input to each of the controllers 225$B_{(x+1)}$ through 225$B_n$ and $e=ENP_x$ and $\Delta e=dENP_x$ are input to the controller 225$B_x$ so that each of the control outputs $dFI_x$, $dFI_{11}$ through $dFI_{1(x-1)}$, $dFI_{1(x+1)}$ through $dFI_{in}$ and $dFI_{1x}$ are output.

More specifically, the total available flow rate value to the pumps are input as $e=EFL_x$, $\Delta e=dEFL_x$ as has been described above, and each of the patterns $P_{e1}$ through $P_{c5}'$ and $P\Delta_{e1}$ through $P\Delta_{e5}$ is used to calculate each of the measurement values $\mu_{c1}$ through $\mu c_5$, $\mu\Delta_{c1}$ through $\mu\Delta c_5$. Furthermore, the smallest values $\mu MIN_1$ through $\mu MIN_5$ is determined and the base portion patterns $PB\Delta U_1$ through $PB\Delta U_5$ of the control output patterns $P\Delta U_1$ through $P\Delta U_5$ are obtained. Furthermore, combinations of these base portion patterns $PB\Delta U_1$ through $PB\Delta U_5$ are used to calculate the obtained maximum value pattern $P\mu MAX\Delta U$. The average value of this pattern, that is the weighted average value of the control output $\Delta U$ that spreads over a certain range is calculated to obtain the final control output $dFI_{0x}$.

The control outputs $dFI_{0x}$, $dFI_{11}$ through $dFI_{1(x-1)}$, $dFI_{(x+1)}$ through $dFI_{1n}$ and $dFI_{1x}$ from each of the controllers 225$A_x$, 225$B_1$ through 225$B_{(x-1)}$, 225$B_{(x+1)}$ through 225BN and 225$B_x$ are input to each of the variable gain proportionators 226$A_x$, 226$B_1$ through 226$B_{(x-1)}$, 226$B_{(x+1)}$ through 226BN and 226$B_x$, pass through the adder 227 are the weighted average dFIx is calculated as $$dFI_x = (K_{0x} \times dFI_{0x}) + (K_{11} \times dFI_{11} \text{ through } K_{1(x-1)} \times dFI_{1(x-1)}) + K_{1(x+1)} \times dFI_{1(x+1)} \text{ through } K_{1n} \times dFI_n) + (K_{1x} \times dFI_{1x})$$

Moreover, here, to the variable gain proportionator 226B$_x$ is input the flow rate restriction possible signal $h_{1-x}$ for pump no. x in order to control the ON and OFF of this proportional calculation so that this proportional calculation is performed when the flow rate restriction possible signal $h_{1-x}=1$ for pump no. x, and when the flow rate restriction possible signal $h_{1-x}$ for pump no. x=0, this calculation is not performed and this signal output for flow rate restriction is not given.

Accordingly, by the use of this $dFI_x$ as the output signal of the flow rate adjustment portion 15.$_1$ through 15.$_x$ of FIG. 31, in a process piping system having a plural number of pumps 2.$_1$ to 2.$_n$ disposed in parallel, degree of opening control of the flow rate adjuster valve provided to the delivery side of each pump, or speed control of each pump can be automatically performed by a method using the control rule used by an operator.

In addition, there is also the same effect as the embodiment described above in that the delivery flow rate of the pump is reduced in order to establish the relationship available N.P.S.H. > required N.P.S.H.

only when there is the flow rate restriction possible signal with respect to the pump in question.

Furthermore, if this example is used, adjusting the variable gain makes it possible to perform smooth control when there is a normal delivery flow rate control so that the total available flow rate value to the plant agrees with the required flow rate set value from the plant. Then, when there is a pump other than the pump in question and for which the relationship available N.P.S.H. > required N.P.S.H.

will be established, fairly slight control is performed in order to increase the delivery flow rate of that pump. Also, when the relationship available N.P.S.H. > required N.P.S.H.

is established for that pump and when the flow rate restriction possible signal has been established with respect to that pump, the effect becomes greater since control can be performed to sharply reduce the delivery flow rate and thus protect the pump.

Furthermore, in each of the embodiments shown in FIG. 28 through FIG. 31, when there is a pump for which the relationship available N.P.S.H. < required N.P.S.H.

appears as if it will be established and when the flow rate restriction possible signal has been established with respect to that pump, then first of all, the speed of that pump can be reduced or the degree of opening of the flow rate adjustment valve provided on the delivery side of that pump can be restricted as to always establish the relationship available N.P.S.H. > required N.P.S.H.

and so as to reduce the delivery flow rate from the pump to the plant and thus established the relationship available N.P.S.H. > required N.P.S.H.

When this is done, the total available flow rate value to the plant is reduced from the required flow rate set value "a" from the plant by the amount that the delivery flow rate has been reduced, but this portion is compensated for by varying the degree of opening of the flow rate adjustment valve provided on the delivery side or by increasing the speed of a pump that has a surplus for maximum allowable flow rate > required flow rate set value (objective value)

so that it is possible to perform control so that the total available flow rate value to the plant is in agreement with the required flow rate set value (objective value) from the plant. Accordingly, the total available flow rate value to the plant is controlled while decreasing.

However, by incorporating a flow rate adjustment portion shown in FIG. 32, when there is a pump for which the relationship available N.P.S.H. < required N.P.S.H.

will be established and when the flow rate restriction possible signal is given with respect to that pump, then control is performed so as to either reduce the speed of that pump or restrict the degree of opening of a flow rate adjuster valve provided on the delivery side while at the same time there is either an increase of the speed of pumps for which there is a surplus in maximum allowable flow rate > required flow rate set value (objective value)

or the degree of opening of a flow rate adjuster valve provided on the delivery side is increased so that it is possible to have control for the total available flow rate value to the plant so that it is in agreement with the required flow rate set value (objective value) from the plant and therefore enable the excellent effect of enabling total flow rate value to the plant without there being any decrease.

Moreover, it is also possible to use the output $dFI_x$ as the control signal c when a flow rate adjustment portion (first calculation portion) having the configuration described above is used instead of the flow rate adjustment portion 15 of the embodiment shown in FIG. 3.

In the PID calculation portion 8 used in each of the embodiments described above, the description was given for when each of the gains for the PID was a fixed value but this need not necessarily be so since it is also possible to have each of the variable gains for the PID changed midway through control.

This will be described with reference to FIG. 33. In this Figure, the set value signal $1_{1-x}$ for pump no. x is input to the flow rate deviation calculation portion 7, and the available flow rate value b to the plant is input as an available value (measured value). Then, the result of the calculation of the difference between the two is input to the PID calculation portion 8 where PID calculation for delivery flow rate control of the pump is performed, and the control signal c that is the result of this is output.

However, the control apparatus (PID calculation portion) is generally configured from a proportional calculation portion, an integral calculation portion and a differential calculation portion where P represents proportional operation, I represents integration operation and D represents differential operation, with the parameters for control operation and that determines the strengths of the P (proportional), I (integration) and D (differential) operation being the proportional gain, the integrating time and the differentiating time.

Then, the values for these parameters differ according to the process piping system, the characteristics of the equipment configuration and the characteristics of the control apparatus. In general, the sensitivity increases but the stability deteriorates when there is a large proportional gain. In addition, when there is control using only proportional operation, there is an offset remaining and so in accordance with the current status of the control system, the integrating time is adjusted so that there is an integrating operation as well as a proportional operation. Furthermore, depending upon the status of the control system, the integrating time is adjusted and the differentiating time is also suitably varied to increase the stability and the responsiveness.

When these control apparatus are mounted to an actual machine and there is test operation of the equipment configuring the process piping system, the proportional gain, the integrating time and the differentiating time are adjusted for the control apparatus and are fixed at the optimum values.

However, the status of the control system differs according to the conditions for the fluid that is flowing through the process piping system, as well as to other conditions and so the optimum values for the proportional gain, the integrating time and the differentiating time also change along with changes in the plant load. Accordingly, when the optimum value for a rated load uses a fixed value, there is the sacrifice of controllability for other loads.

Figure 33:
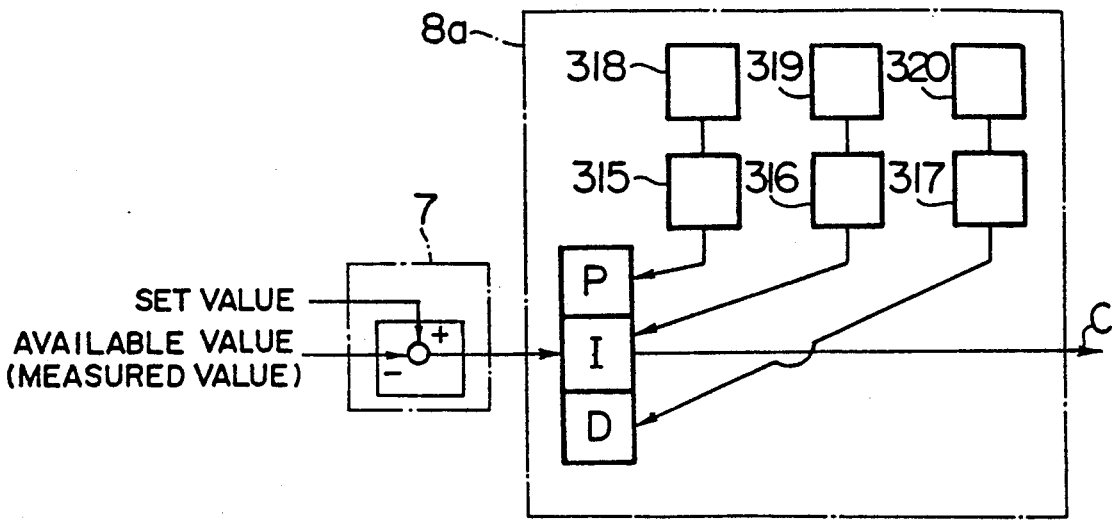
FIG. 33 is a block diagram of another example of a PID calculation portion.

However, if a proportional gain determining portion 318 is provided to the PID calculation portion 8 in FIG. 33, that output signal is input to a proportional gain setting portion 315, and that output signal is input to the proportional calculation portion P. In addition, an integrating time determining portion 319 is provided and that output signal is input to an integrating time setting portion 316, and that output signal is input to the integrating time portion I. Furthermore, a differentiating time determining portion 320 is provided, and that output signal is input to a differentiating time setting portion 317, and that output signal is input to the differentiating time portion D.

The following is a description of this operation.

The proportional gain determining portion 318, integrating time determining portion 319 and differentiating time determining portion 320 use the available N.P.S.H. of the pump or the delivery flow rate to the plant to output signals in accordance with the status of the process piping system. Then, the proportional gain setting portion 315, integrating time setting portion 316 and differentiating time setting portion 317 that receive these signal values respectively input a proportional gain value, integrating time value and differentiating time value corresponding to the size of these signal values, to the proportional calculation portion P, integral calculation portion I and the differential calculation portion D. Then, in the PID calculation portion 8*a*, those changing proportional gain values, integrating time values and differential time values are used to perform the proportional, integral and differential calculations.

The following is a description of one example of the proportional gain determining portion 318, integrating time determining portion 319 and differentiating time determining portion 320 described above.

In this example, the proportional gain determining portion 318, integrating time determining portion 319 and differentiating time determining portion 320 use the same block diagram as that of FIG. 32, and the control rule that is used when the operator runs the plant is applied.

More specifically, when the operator runs the plant of such a process piping system:

(a) When the total available flow rate value to the plant is extremely small when compared to the required flow rate value from the plant, then for those pumps for which there is a surplus in the relationship available N.P.S.H. > required N.P.S.H.

the delivery flow rate is quickly increased in accordance with that surplus value and the difference between the total available flow rate value and the required flow rate set value, or in many cases, the delivery rate is quickly reduced in accordance with the total available respectively and the required flow rate set value by adjusting the values for the proportional gain, the integrating time and the differentiating time, or when the total available flow rate value to the plant has either approached the required flow rate value from the plant, or is relatively distant and the approach speed is too fast or when there is no surplus left in the relationship:

available N.P.S.H. > required N.P.S.H.

for that pump (such as pump no. x in the case of the controller for pump no. x), or when the change ratio is too large even when there is a surplus, and the amount of increment of the delivery flow rate is made smaller in accordance with this, then the values for the proportional gain, the integrating time and the differentiating time are adjusted so that the increase amount becomes small in accordance or so that it is dropped to the objective value when the deviation between the total available flow rate value and the required flow rate value becomes smaller.

(b) When any of the pumps other than the pump in question and the relationship available N.P.S.H. < required N.P.S.H.

has become established, then if there is a sufficient surplus in the relationship available N.P.S.H. > required N.P.S.H.

in that pump to the degree to which both the available N.P.S.H. and the required N.P.S.H. are large, then the delivery flow rate of that pump is quickly increased in accordance with the surplus value and the difference described above. Then when the difference between the available N.P.S.H. and the required N.P.S.H. in the relationship for the pump other than the pump in question and for which the relationship available N.P.S.H. < required N.P.S.H.

is established, has become smaller or when the change ratio is still relatively large even if the difference between the two is still relatively large, and there is no surplus in the relationship available N.P.S.H. > required N.P.S.H.

or when there is still a large change ratio even if there is a relative surplus, the values for the proportional gain, the integrating time and the differentiating time are adjusted so as to lessen the increase amount of the delivery flow rate in accordance with this or so as to drop them stably to the objective values at the same time as the relationship available N.P.S.H. > required N.P.S.H.

inverts.

(c) If in the pump in question, the establishment of the relationship available N.P.S.H. < required N.P.S.H.

has begun, then for as long as the flow rate restriction possible signal is input to that pump, the described above flow rate to that pump is quickly restricted in accordance with the difference between the two. Then, when the difference between the two has become small or when there is a large change ratio even if the difference between the two is still comparatively large, the values for the proportional gain, the integrating time and the differentiating time are adjusted so as to lessen the increase amount of the delivery flow rate in accordance with this or so as to drop them stably to the objective values at the same time as the relationship available N.P.S.H. > required N.P.S.H.

inverts.

This control rule for when there is plant operation such as that by an operator, is realized by a block diagram that is the same as that of FIG. 31, and in the same the proportional gain determining portion 318, integrating time determining portion 319 and differentiating time determining portion 320, the input of $dFI_x$ obtained in the same manner as described in FIG. 32, to the proportional gain setting portion 315, integrating time setting portion 316 and differentiating time setting portion 317 incorporated into the PID calculation portion 8*a* shown in FIG. 33 enables the change of the proportional gain value, the integrating time and the differentiating time of the proportion, integration and differentiation. Moreover, the description of the block diagram of FIG. 32 is the same and so will be omitted here.

Figure 34:
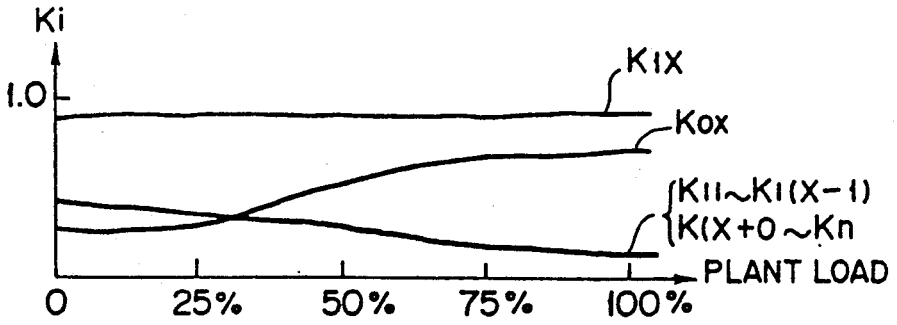
FIG. 34 is a graph showing one embodiment of the gain in a variable gain proportionator of the proportional gain determining portion.

In this example, the variable gain proportionators 226$A_x$, 226$B_1$ through 226$B_{(x-1)}$, 226$B_{(x+1)}$ through 226$B_n$ and 226$B_x$ can change the gain according to the plant load. FIG. 34 shows one example of a variable gain proportionator in the proportional gain setting portion 315.

The use of such a PID calculation portion 8*a* has the effect of enabling the automatic change midway of each of the gains of the PID corresponding to the status of the process piping system at that time through the use of the available N.P.S.H. of a pump or the flow rate value to the plant and the plant load while using a control rule for when there is plant operation by an operator.

According to this example, slight control is performed when there is normal delivery flow rate control so that the total available flow rate value to the plant is made to agree with the required N.P.S.H. from the plant. Then, slight control is performed so as to increase the delivery flow rate to the plant when there is a pump for which the relationship available N.P.S.H. < required N.P.S.H.

hat it will be established. Then, when the relationship available N.P.S.H. < required N.P.S.H.

is established and the flow rate restriction possible signal is established with respect to a pump, there is also the great effect of being able to sharply decrease the delivery flow rate so as to protect the pump.

It is also possible to apply the PID calculation portion 8*a* having the configuration described above to a suction head have PID calculation portion 8 shown in FIG. 16, FIG. 17 and FIG. 20.

Figure 35:
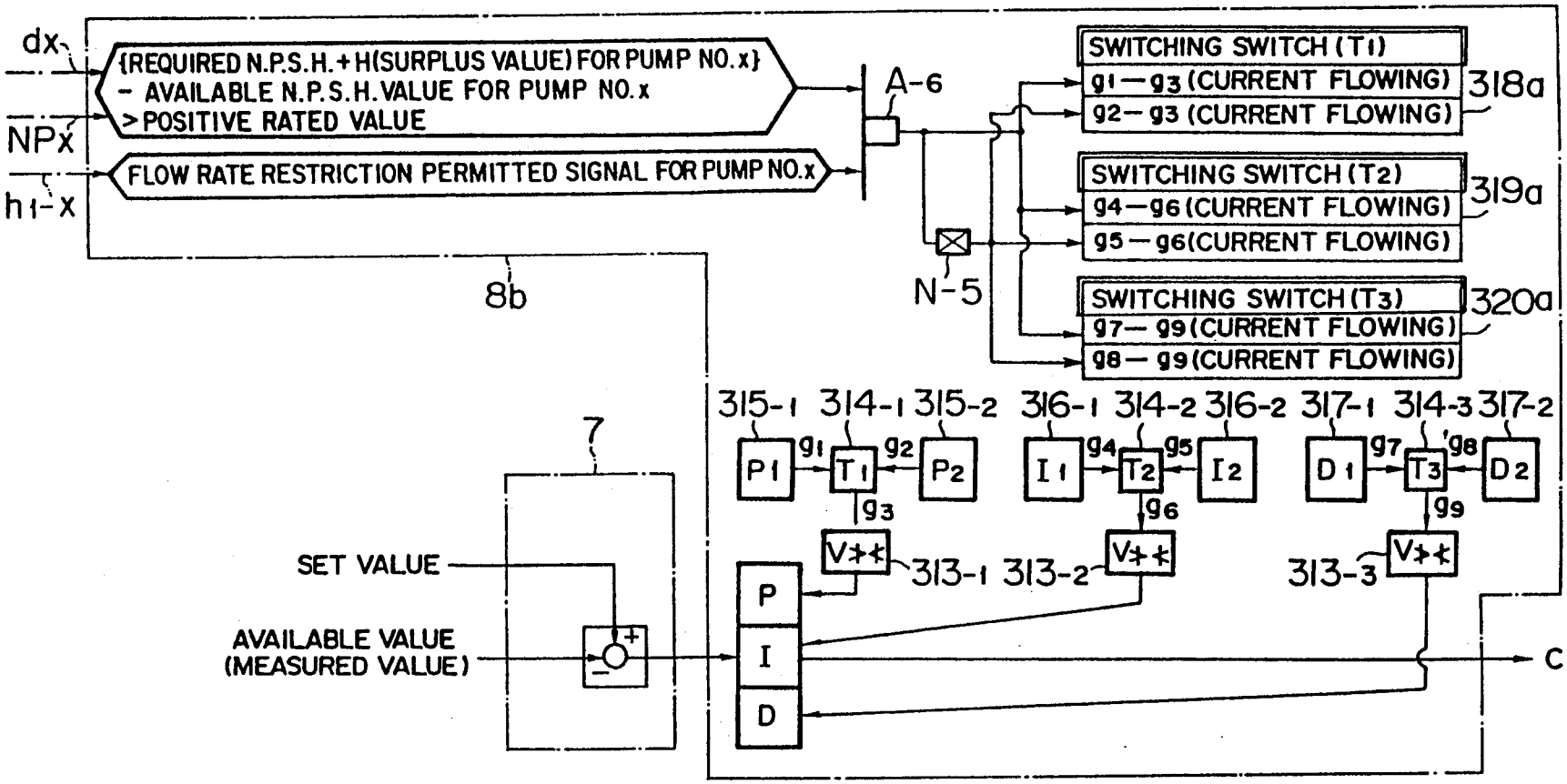
FIG. 35 is a block diagram showing another embodiment of the PID calculation portion.

In the example described above, the PID calculation portion 8*a* used a controller that can use unchanged the control rule for when there the plant is run by an operator but it also possible to configure a PID calculation portion 8*b* using a relatively simple controller shown in FIG. 35.

More specifically, the proportional gain determining portion 318, integrating time determining portion 319 and differentiating time determining portion 320 of the PID calculation portion 8*a* are configured using the logic blocks 318*a*, 319*b* and 320*c*. Then, the results of these logical equations switch the switching switches ($T_1$, $T_2$ and $T_3$) 314$_{-1}$, 314$_{-2}$ and 314$_{-3}$ so that the proportional gain setters ($P_1$ or $P_2$) 315$_{-2}$ or 315$_{-2}$, the integrating time setting portions ($I_1$ or $I_2$) 316$_{-1}$ or 316$_{-2}$ and the differentiating time setting portion ($D_1$ or $D_2$) 317$_{-1}$ or 317$_{-2}$ are selected. The proportional gain value, integrating time value and differentiating time value selected in this manner are input to the proportional calculation portion P, integral calculation portion I and the differential calculation portion D via the change ratio limiter portions 313$_{-1}$, 313$_{-2}$ and 313$_{-3}$ so that the values do not change in steps, and PID calculation is performed.

The following is a description of the logical equations described above. First, the pump delivery flow rate - required N.P.S.H. value curve used for the pump no. x shown in FIG. 32, and the delivery flow rate $k_x$ for pump no. x is used to obtain the required N.P.S.H. $NP_x$ for pump no. x. In addition, the available N.P.S.H. value $d_x$ for pump no. x is also input. On the other hand, the flow rate restriction possible signal $h_{1-x}$ for pump no. x is also input.

Then, these status values are used to obtain the logical product (AND circuit $A_{-6}$) of ((required N.P.S.H. value for pump no. x + H) − available N.P.S.H. for pump no. x) > (positive rated value) (1)

flow rate possible signal for pump no. x (2)

Moreover, $O_{-5}$ is a NOT circuit.

Then, when this logical product is established (AND circuit $A_{-6}=1$), the relationship available N.P.S.H. < required N.P.S.H.

is established and the flow rate restriction possible signal $h_{1-x}$ is also established and so the objective value "required N.P.S.H. value for pump no. x+H" for control of the "available N.P.S.H. value of pump no. x - a positive rated value" is reached, the switching switch ($T_1$) 314$_{-1}$ selects the side of the proportional gain setting portion ($P_1$) 315$_{-1}$, the switching switch ($T_2$) 314$_{-2}$ selects the side of the integrating time setting portion ($I_1$) 315$_{-2}$, and the switching switch ($T_3$) 314$_{-3}$ selects the side of the differentiating time setting portion ($D_1$) 315$_{-2}$ so that the delivery flow rate of the pump no. x is restricted in the fastest possible time.

Then, when the "available N.P.S.H. value of pump no. x" has reached "available N.P.S.H. value of pump no. x—a positive rated value", the switching switch ($T_1$) 314$_{-1}$ selects the side of the proportional gain setting portion ($P_2$) 315$_{-2}$, the switching switch ($T_2$) 314$_{-2}$ selects the side of the integrating time setting portion ($I_2$) 315$_{-2}$, and the switching switch ($T_3$) 314$_{-3}$ selects the side of the differentiating time setting portion ($D_2$) 317$_{-2}$ so that the amount of overshoot is reduced from the objective value and stable control is performed, and the values for the proportional gain amount value, the integrating time value and the differentiating time value are returned to the original values.

Moreover, when the relationship available N.P.S.H. > required N.P.S.H.

is practically reached for pump no. x, that is when there is normal pump delivery flow rate control, the switching switch ($T_1$) 314$_{-1}$ selects the side of the proportional gain setting portion ($P_2$) 315$_{-2}$, the switching switch ($T_2$) 314$_{-2}$ selects the side of the integrating time setting portion ($I_2$) 315$_{-2}$, and the switching switch ($T_3$) 314$_{-3}$ selects the side of the differentiating time setting portion ($D_1$) 317$_{-2}$ and the values for the proportional gain amount value, the integrating time value and the differentiating time value are returned to the original values and stable control is performed.

Here, the values for the proportional gain amount value, the integrating time value and the differentiating time value are switched during control by the switching switches ($T_1$, $T_2$, $T_3$) 314$_{-1}$, 314$_{-2}$ and 314$_{-3}$ but disturbance will occur if there is step change and so the proportional gain value, integrating time value and differentiating time value selected in this manner are input to the proportional calculation portion P, integral calculation portion I and the differential calculation portion D via the change ratio limiter portions 313$_{-1}$, 313$_{-2}$ and 313$_{-3}$ so that the values either increase or decrease gradually without steps.

When a PID calculation portion 8*a* having this configuration is used, the configuration becomes relatively simple, and if during pump delivery flow rate control, the relationship available N.P.S.H. for a pump < required N.P.S.H. for a pump occurs and the flow rate restriction possible signal $h_{1-x}$ is input for that pump, then the delivery flow rate is quickly reduced until the available N.P.S.H. value reaches the required N.P.S.H. value, in order to protect the pump, and after this, the proportional gain value, integrating time value and differentiating time value of the PID calculation portion 8 are changed automatically to normal values so that stable control can be performed.

In addition, when there is normal pump delivery flow rate control, the proportional gain value, integrating, time value and differentiating time value of the PID calculation portion 8*b* are changed automatically to normal values so that there is relatively soft and stable control, that as a result, improves the controllability.

Moreover, this PID calculation portion 8*b* can of course use a PID calculation portion 8 shown in FIG. 16, FIG. 17 and FIG. 20.

EFFECT OF THE INVENTION

According to the present invention as has been described above, it is possible to perform control so that there is the required set value from the plant (objective value) while holding the relationship available N.P.S.H. > required N.P.S.H.

In addition, it is also possible to make the delivery flow rate agree with the required flow rate set value (objective value) from the plant, and to smoothly restrict the delivery flow rate of the pump so that this relationship continues to be established when the relationship available N.P.S.H. > required N.P.S.H.

cannot be established, and to enable control to a value that is as close as possible to the required flow rate set value from the plant. Because of this, in addition to preventing the occurrence of trouble due to cavitation because of a flow rate greater than the maximum allowable flow rate of the pump flowing, a rise in the temperature of the process liquid on the suction side of the pump or a drop in the pressure on the suction side of the pump, it is also possible to perform delivery rate control.

In addition, according to the invention the insertion of a low temperature process liquid to the suction side of the pump enables the supply of high-pressure process vapor to the liquid surface of the process liquid on the suction side of the pump and which is held in the tank, and the adjustment of the liquid that resupplies the process liquid to the tank that temporarily holds the process liquid on the suction side of the pump allows the available N.P.S.H. to be increased so that it is possible to maintain the required flow rate set value from the plant while at the same time maintaining the relationship available N.P.S.H. > required N.P.S.H.

and therefore prevent the delivery pressure from dropping due to cavitation of the pump.

Furthermore, according to the invention even if the relationship available N.P.S.H. > required N.P.S.H.

did exist and there is the generation of light cavitation that can be ignored, the abnormal sound that is generated at such times is incorporated into the control so that it is possible to prevent the definite generation of cavitation.

In addition, according to the invention even if cavitation generates temporarily for example, there are plants for which the available flow rate value to the plant must be controlled to be in agreement with a required flow rate value (objective value) from a plant but with respect to plants such as this, it is possible to establish the relationship available N.P.S.H. > required N.P.S.H.

with respect to as many pumps as is possible and therefore meet this requirement, and with respect to the remaining pumps, restrict the delivery flow rate of those pumps so that the relationship available N.P.S.H. > required N.P.S.H.

is quickly established via flow rate restriction possible signals when cavitation that will actually destroy the pump has been judged empirically by an operator.

What is claimed is:

1. A control apparatus for controlling a delivery flow rate of a pump pressure-feeding processing liquid within a process pipe system comprising:

detecting means for detecting available N.P.S.H. of a pump on the basis of a pressure and a temperature of the process liquid within a suction portion of the pump;

calculating means for calculating an allowable maximum flow rate of the pump so as to maintain the relationship available N.P.S.H. > required N.P.S.H.; and outputting means for outputting a control signal to control delivery flow rate of the pump on the basis of the smaller of the allowable maximum flow rate and a required flow rate of the pump; wherein the detecting means for detecting the available N.P.S.H. of the pump comprises a high-pressure chamber that transmits the pressure of a process liquid, a low pressure chamber that is held at a saturation vapor pressure corresponding to the temperature of the process liquid, and a sensor diaphragm which partitions the high-pressure chamber and the low-pressure chamber, the high-pressure chamber and the low-pressure chamber being separated from the process liquid by respective sealing diaphragms.

2. A control apparatus for controlling a delivery flow rate of a pump pressure-feeding processing liquid within a process pipe system comprising:

detecting means for detecting available N.P.S.H. of a pump on the basis of a pressure and a temperature of the process liquid within a suction portion of the pump;

calculating means for calculating an allowable maximum flow rate of the pump so as to maintain the relationship available N.P.S.H. > required N.P.S.H.; and outputting means for outputting a control signal to control delivery flow rate of the pump on the basis of the smaller of the allowable maximum flow rate and a required flow rate of the pump; wherein the detecting means for detecting the available N.P.S.H. of the pump comprises a temperature/-saturation pressure conversion portion that determines a saturation vapor pressure of the process liquid from the temperature of the process liquid, and a subtractor portion that calculates a differential pressure between the pressure of the process liquid and the saturation vapor pressure of the process liquid.

3. A control apparatus for controlling a delivery flow rate of a pump pressure-feeding process liquid within a process pipe system comprising:

detecting means for detecting available N.P.S.H. of a pump on the basis of a pressure and a temperature of the process liquid within the suction portion of the pump;

liquid inserting means for inserting a low-temperature process liquid into the process liquid on the suction side of the pump; and outputting means for comparing the available N.P.S.H. determined by the detecting means and required N.P.S.H. of the pump and for outputting a control signal to the liquid inserting means in order to control an inserting amount of the liquid inserting means so as to hold the relationship available N.P.S.H. > required N.P.S.H.

4. A control apparatus for controlling a delivery flow rate of a pump pressure-feeding process liquid within a process pipe system comprising:

detecting means for detecting available N.P.S.H. of a pump on the basis of a pressure and a temperature of the process liquid within the suction portion of the pump;

liquid supply means for supplying a cooling liquid to a tank which temporarily stores the process liquid on the suction side of the pump and into which process vapor flows; and outputting means for comparing the available N.P.S.H. determined by the detecting means and required N.P.S.H. of the pump and for outputting a control signal to the liquid supply means in order to control a supplying amount of the liquid supply means so as to hold the relationship available N.P.S.H. > required N.P.S.H.

5. A control apparatus for controlling a delivery flow rate of a pump pressure-feeding process liquid within a process pipe system comprising:

detecting means for detecting available N.P.S.H. of a pump on the basis of a pressure and a temperature of the process liquid within the suction portion of the pump;

calculating means for calculating an allowable maximum flow rate of the pump so as to hold the relationship available N.P.S.H. > required N.P.S.H.;

detecting means for detecting an abnormal sound of a pump by an acoustic detector portion disposed in the vicinity of a pump and a predetermined limit flow rate signal; and outputting means for outputting a control signal to control the delivery flow rate of the pump on the basis of the smallest value, the allowable maximum flow rate, a required flow rate of the pump, or the predetermined flow rate.

6. A control apparatus for controlling a delivery flow rate of a pump pressure-feeding process liquid within a process pipe system having a speed control pump comprising:

detecting means for detecting required N.P.S.H. of a pump on the basis of a pressure and a temperature of the process liquid within the suction portion of the pump;

calculating means for calculating an allowable maximum flow rate of the pump so as to hold the relationship available N.P.S.H. > required N.P.S.H.; and flow rate judging means for outputting a flow rate restriction signal to a delivery valve of the pump when it is judged that it is not possible to perform emergency speed control according to the allowable maximum flow rate.

7. A control apparatus for controlling a delivery flow rate of a pump pressure-feeding process liquid within a process pipe system comprising:

detecting means for detecting available N.P.S.H. of a pump on the basis of a pressure and a temperature of the process liquid within the suction portion of the pump;

vapor supply means for supplying high pressure process vapor to press the process liquid on the suction side of the pump; and outputting means for comparing the available N.P.S.H. from the detecting means and required N.P.S.H. of the pump and for outputting a control signal to the vapor supply means in order to control a supplying amount of the vapor supply means so as to hold the relationship available N.P.S.H. > required N.P.S.H.

8. The control apparatus of claim 7, wherein a tank for holding the process liquid is provided on the upstream side of the pump, the vapor supply means being connected to the tank.

* * * * *